US009979086B2

(12) United States Patent
Ng et al.

(10) Patent No.: US 9,979,086 B2
(45) Date of Patent: May 22, 2018

(54) MULTIBAND ANTENNA ASSEMBLIES

(71) Applicant: Laird Technologies, Inc., Earth City, MO (US)

(72) Inventors: Kok Jiunn Ng, Perak (MY); Tze Yuen Ng, Kedah (MY); Ting Hee Lee, Penang (MY); Joshua Ooi Tze Meng, Selangor Darul Ehsan (MY); Ee Wei Sim, Penang (MY); En Chi Lee, Kedah (MY); Chee Seong Por, Penang (MY)

(73) Assignee: Laird Technologies, Inc., Earth City, MO (US)

( * ) Notice: Subject to any disclaimer, the term of this patent is extended or adjusted under 35 U.S.C. 154(b) by 145 days.

(21) Appl. No.: 14/616,263

(22) Filed: Feb. 6, 2015

(65) Prior Publication Data

US 2015/0188226 A1 Jul. 2, 2015

Related U.S. Application Data

(63) Continuation of application No. PCT/MY2012/000236, filed on Aug. 17, 2012.

(51) Int. Cl.
*H01Q 1/32* (2006.01)
*H01Q 5/335* (2015.01)
(Continued)

(52) U.S. Cl.
CPC ..... *H01Q 5/335* (2015.01); *H01Q 1/3275* (2013.01); *H01Q 5/00* (2013.01); *H01Q 5/385* (2015.01); *H01Q 9/42* (2013.01)

(58) Field of Classification Search
CPC ..... H01Q 5/335; H01Q 5/385; H01Q 5/00; H01Q 1/282; H01Q 1/325; H01Q 1/3275; H01Q 9/42
See application file for complete search history.

(56) References Cited

U.S. PATENT DOCUMENTS 5,977,931 A 11/1999 Openlander
6,292,156 B1 9/2001 Openlander
(Continued)

FOREIGN PATENT DOCUMENTS

CN 201655979 U 11/2010
CN 202363583 U 8/2012
(Continued)

OTHER PUBLICATIONS

International Search Report dated Mar. 13, 2013 issued in PCT Application No. PCT/MY2012/000236 (published Feb. 20, 2014 as WO2014/027875) which the instant application claims priority to, 2 pgs.

(Continued)

*Primary Examiner* — Dieu H Duong
(74) *Attorney, Agent, or Firm* — Harness, Dickey & Pierce, P.L.C.

(57) ABSTRACT

An exemplary embodiment of an multiband antenna assembly includes a printed circuit board having a plurality of elements thereon. The plurality of elements may include a radiating element, a matching element, a feed element configured to be operable as a feeding point for the multiband antenna assembly, and a shorting element configured to be operable for electrically shorting the radiating element to ground. The antenna assembly may be operable within at least a first frequency range and a second frequency range different than the first frequency range without requiring any matching lump components coupled to the printed circuit board.

20 Claims, 47 Drawing Sheets

(51) Int. Cl.

| | |
|---|---|
| ***H01Q 5/00*** | (2015.01) |
| ***H01Q 9/42*** | (2006.01) |
| ***H01Q 5/385*** | (2015.01) |

(56) References Cited

U.S. PATENT DOCUMENTS

| | | | | |
|---|---|---|---|---|
| 7,209,096 | B2 | 4/2007 | Chau | |
| 7,681,834 | B2 | 3/2010 | Facciano et al. | |
| 8,482,471 | B2 | 7/2013 | Su | |
| 8,654,026 | B2 | 2/2014 | Tsai et al. | |
| 2004/0036659 | A1 | 2/2004 | Langley et al. | |
| 2004/0233109 | A1 | 11/2004 | Ying et al. | |
| 2005/0200554 | A1* | 9/2005 | Chau | H01Q 1/2233 343/895 |
| 2005/0280588 | A1* | 12/2005 | Fujikawa | H01Q 1/242 343/702 |
| 2006/0092080 | A1 | 5/2006 | Lee | |
| 2007/0262914 | A1 | 11/2007 | Chau | |
| 2011/0109515 | A1* | 5/2011 | Rao | H01Q 1/243 343/702 |
| 2011/0210899 | A1* | 9/2011 | Aoki | H01Q 5/0062 343/749 |
| 2011/0273338 | A1 | 11/2011 | Wolf | |
| 2012/0223862 | A1* | 9/2012 | Kerselaers | H01Q 1/3275 343/700 MS |
| 2013/0069845 | A1* | 3/2013 | Swais | H01Q 1/42 343/872 |

FOREIGN PATENT DOCUMENTS

| | | |
|---|---|---|
| KR | 10-2009-0115254 | 11/2009 |
| WO | WO2010/114336 | 10/2010 |

OTHER PUBLICATIONS

Chinese Office Action dated Apr. 22, 2016 for Chinese Application No. 2012800753880 filed Feb. 17, 2015 which claims priority to the same parent application as the instant application, 14 pages.

* cited by examiner

MULTIBAND ANTENNA ASSEMBLIES

CROSS REFERENCE TO RELATED APPLICATION

This patent application is a continuation of and claims the benefit of International Application No. PCT/MY2012/00236 filed Aug. 17, 2012 (published as WO 2014/027875 on Feb. 20, 2014). The disclosure of the application identified in this paragraph is incorporated herein by reference in its entirety.

FIELD

The present disclosure relates to multiband antenna assemblies, which may be used for vehicular, machine to machine equipment, and/or in-building applications.

BACKGROUND

This section provides background information related to the present disclosure which is not necessarily prior art.

Multiband antennas typically include multiple antennas to cover and operate at multiple frequency ranges. A printed circuit board (PCB) having radiating antenna elements is a typical component of a multiband antenna assembly. Another typical component of a multiband antenna assembly is an external antenna, such as a whip antenna rod. The multiband antenna assembly may be mounted to an antenna mount (e.g., NMO (New Motorola) mount, etc.), which, in turn, is installed or mounted on a vehicle surface, such as the roof, trunk, or hood of the vehicle, or ground plane of a machine. The antenna mount may be interconnected (e.g., by a coaxial cable, etc.) to one or more electronic devices (e.g., a radio receiver, a touchscreen display, GPS navigation device, cellular phone, etc.) inside the passenger compartment of the vehicle, such that the multiband antenna is operable for transmitting and/or receiving signals to/from the electronic device(s) inside the vehicle by the antenna mount.

An antenna assembly may be combined with other application antennas for multi antenna configurations to support various needs, e.g., GPS antenna, UHF Whip, VHF Whip, LTE Whip, etc. Due to having greater design freedom, an antenna assembly can be duplicated into multiple antennas over a ground plane and subsequently having the antenna operate in Multiple Input and Multiple Output (MIMO) configuration.

SUMMARY

This section provides a general summary of the disclosure, and is not a comprehensive disclosure of its full scope or all of its features.

According to various aspects, exemplary embodiments are disclosed of multiband antenna assemblies. For example, an exemplary embodiment of a multiband antenna assembly may generally include at least one printed circuit board having a plurality of elements thereon. The plurality of elements may include a radiating element, a matching element, a feed element configured to be operable as a feeding point for the multiband antenna assembly, and a shorting element configured to be operable for electrically shorting the radiating element to ground. The antenna assembly may be operable within at least a first frequency range and a second frequency range different than the first frequency range without requiring any matching lump components coupled to the printed circuit board.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure in any way.

Figure 27A:
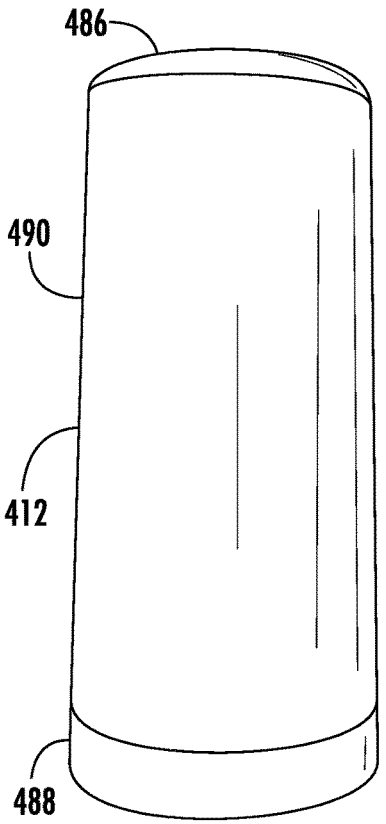
FIG. 27 is a front perspective view of an exemplary embodiment of a multiband antenna assembly that includes a PCB and spring fingers that electrically contact a conductor at the top of a radome, and also illustrating the multiband antenna assembly mounted to an exemplary NMO connector structure.
Figure 27B:
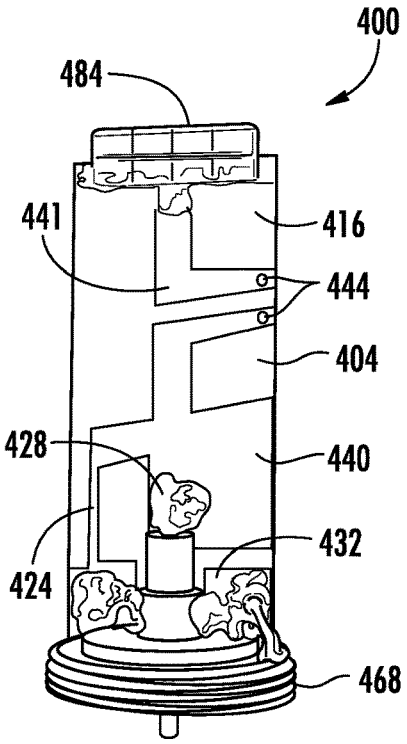
Figure 32:
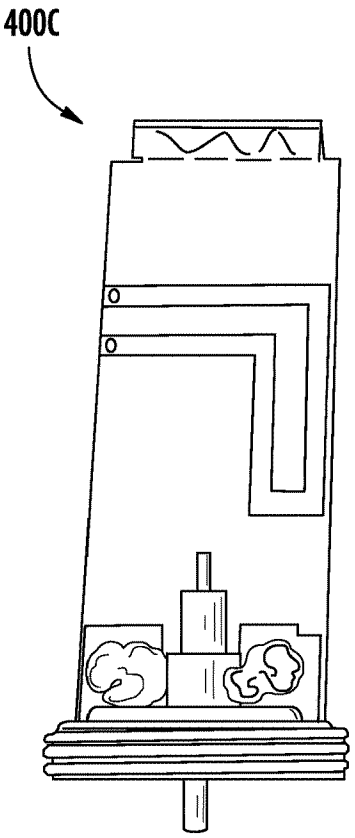
Figure 31:
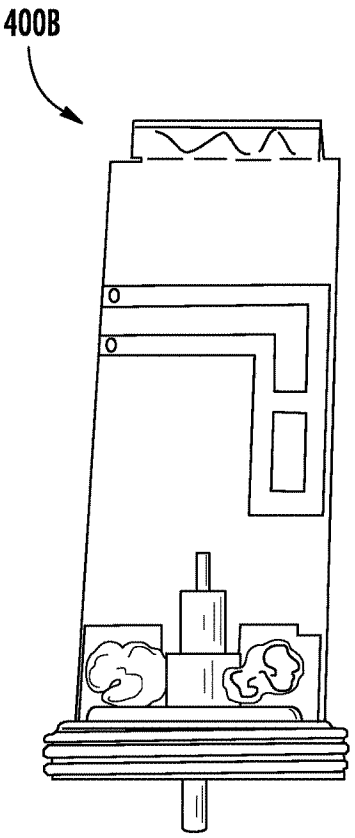
Figure 30:
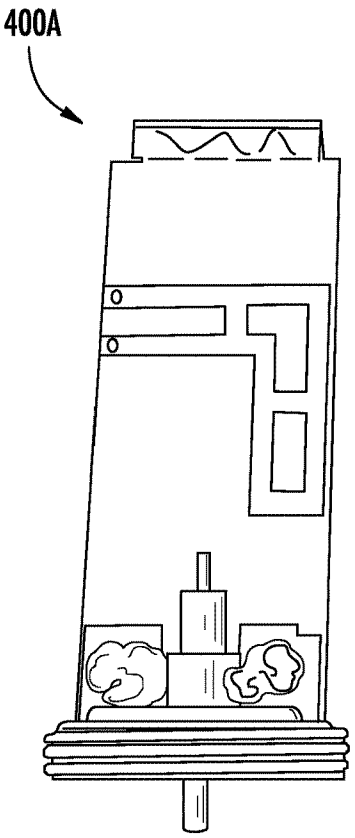
Figure 29:
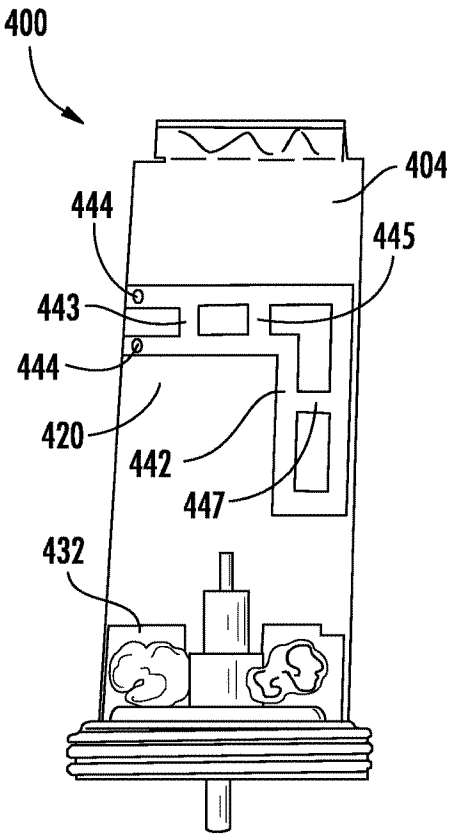
Figure 33:
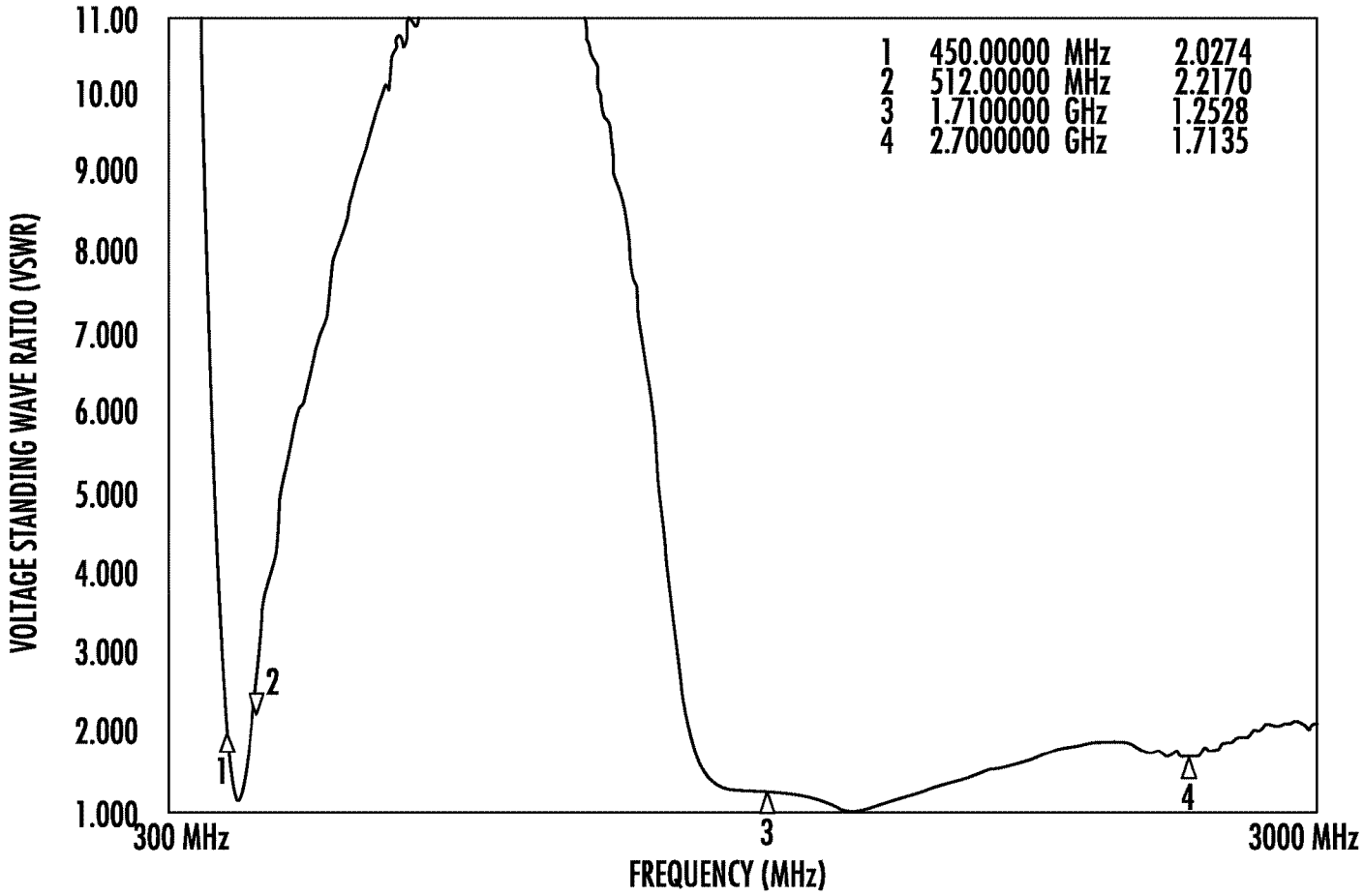
Figure 34A:
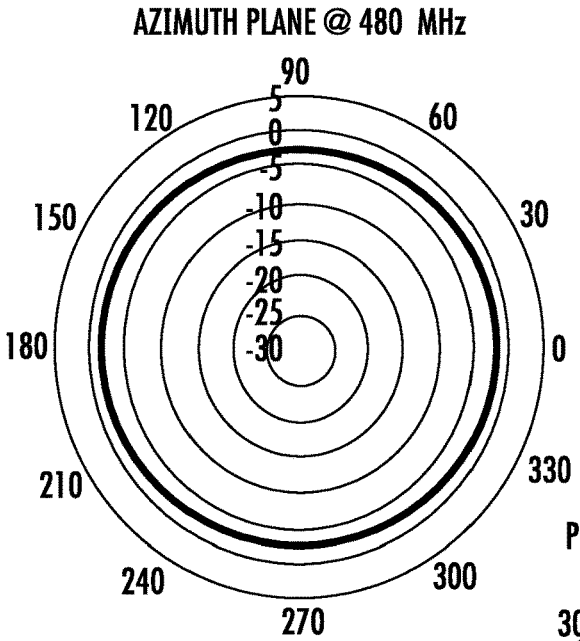
Figure 34B:
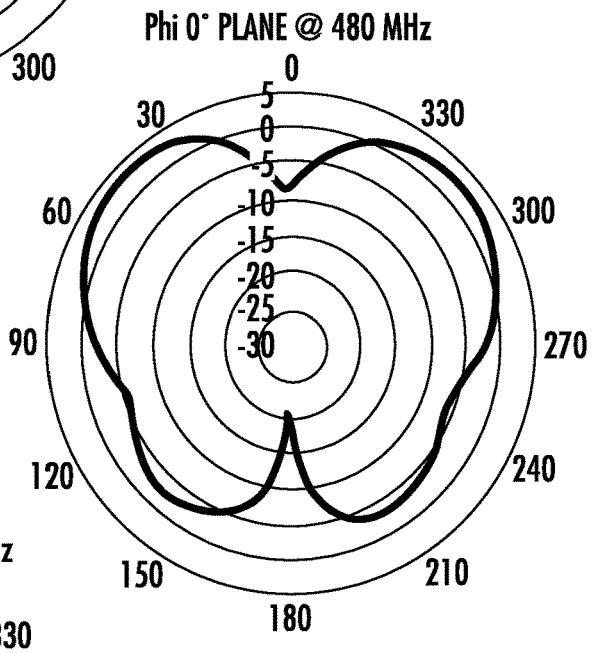
Figure 34C:
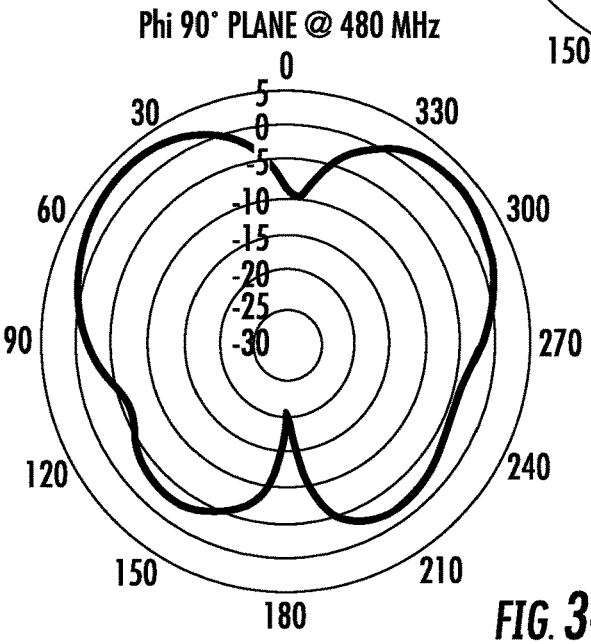
Figure 34D:
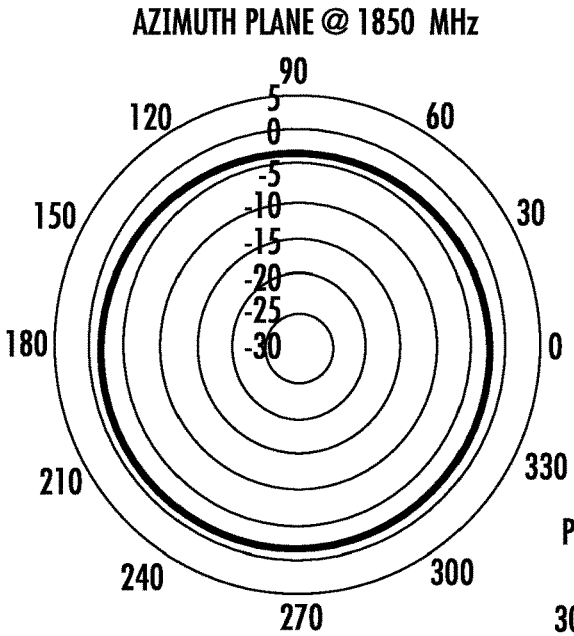
Figure 34E:
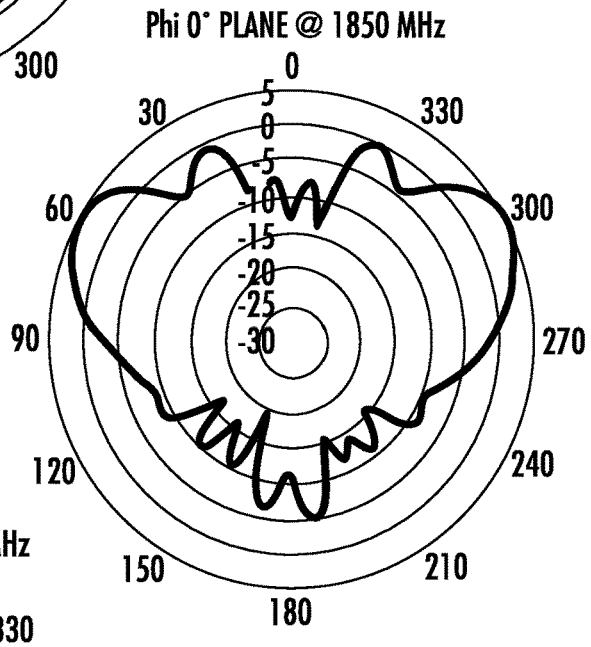
Figure 34F:
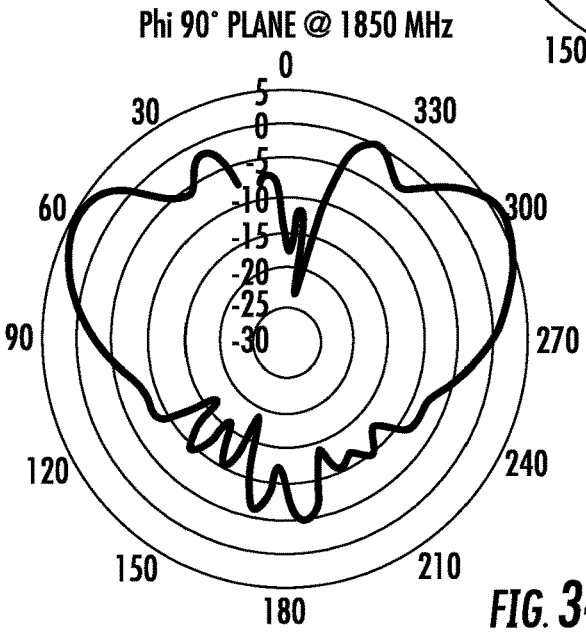
Figure 34G:
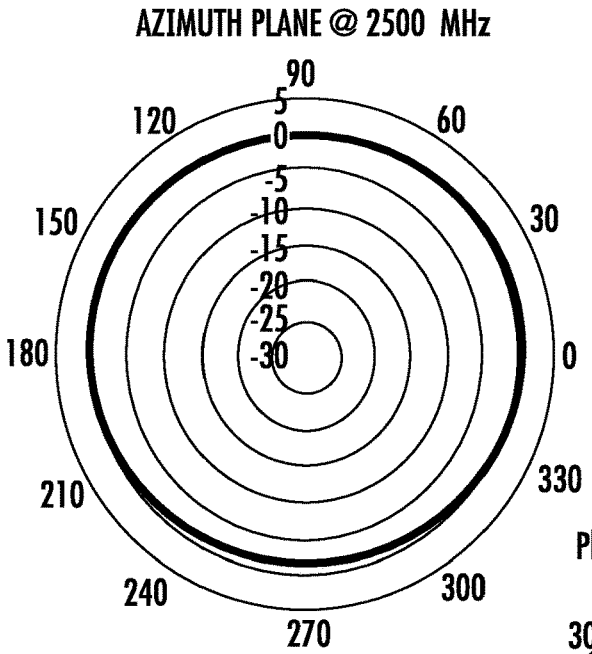
Figure 34H:
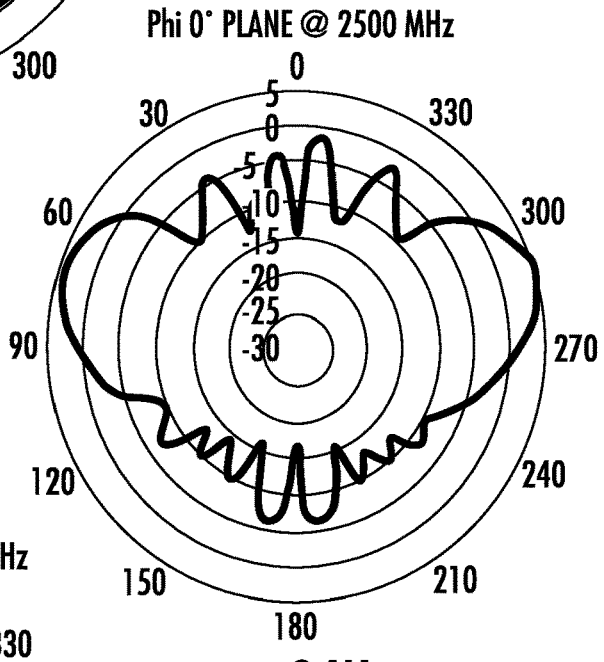
Figure 34I:
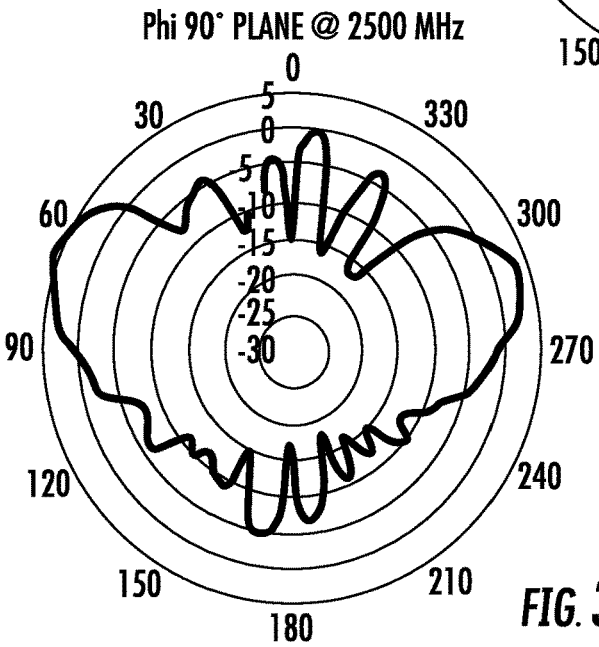
Figure 35:
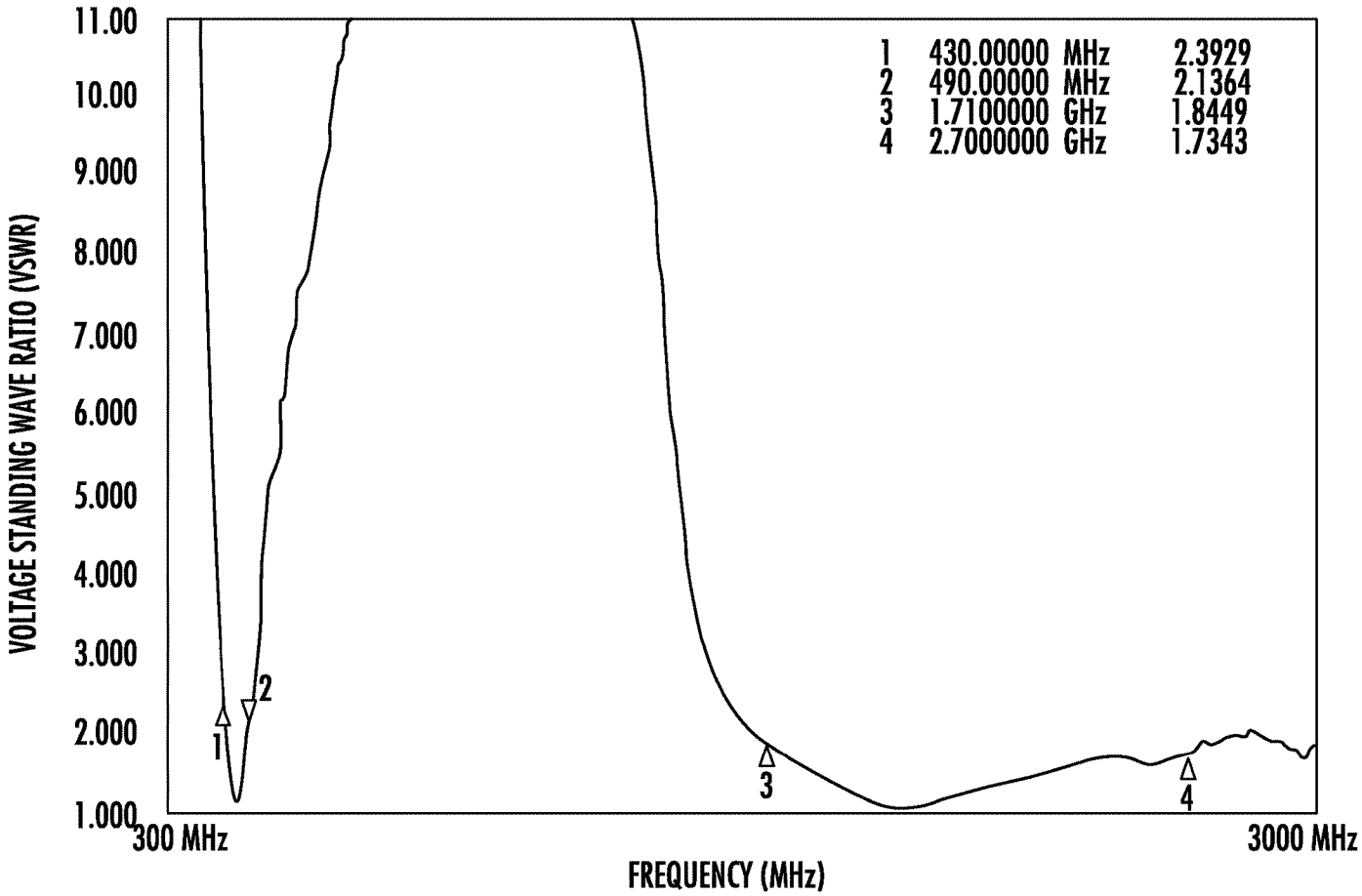
Figure 36:
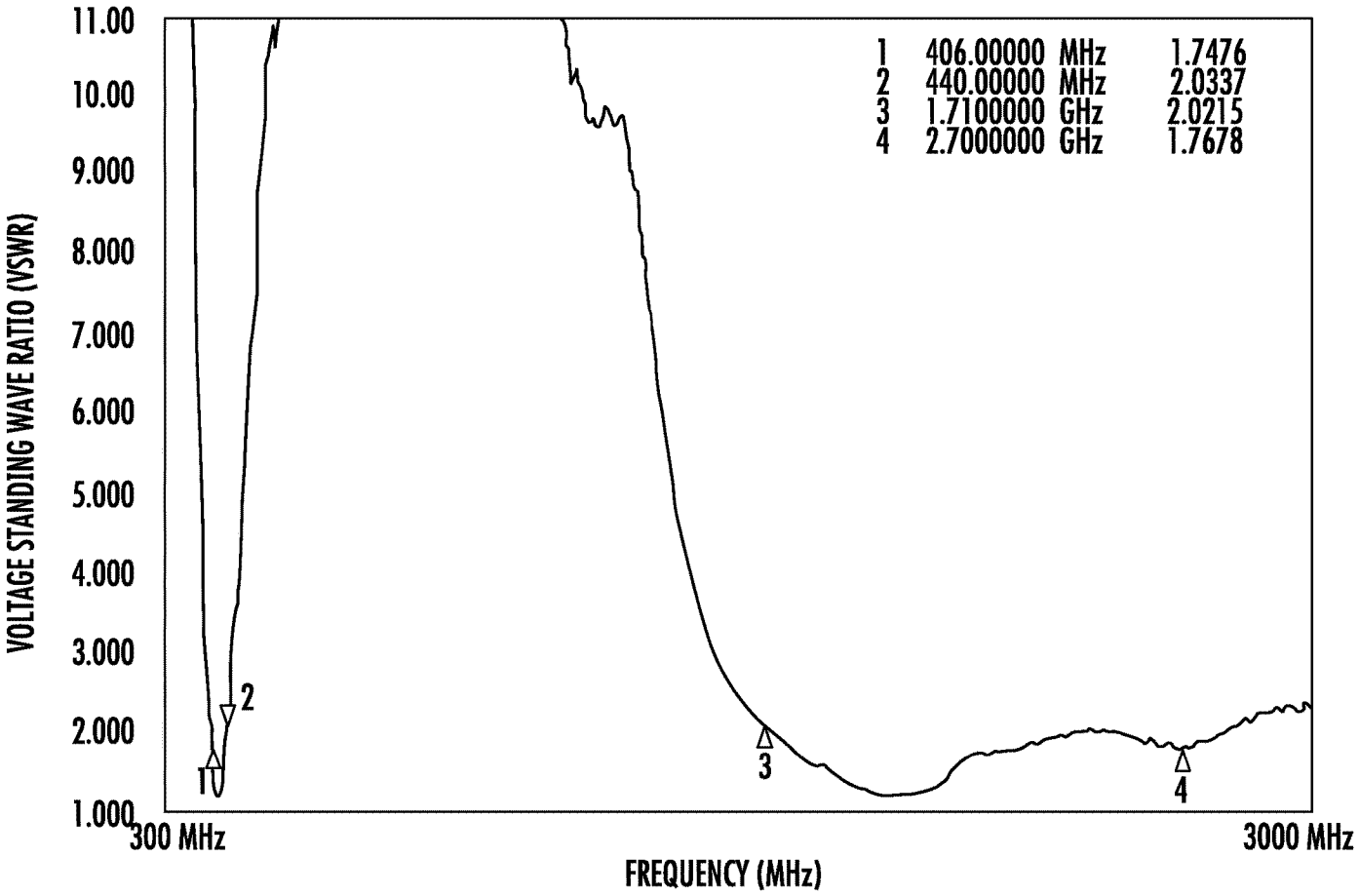
Figure 37:
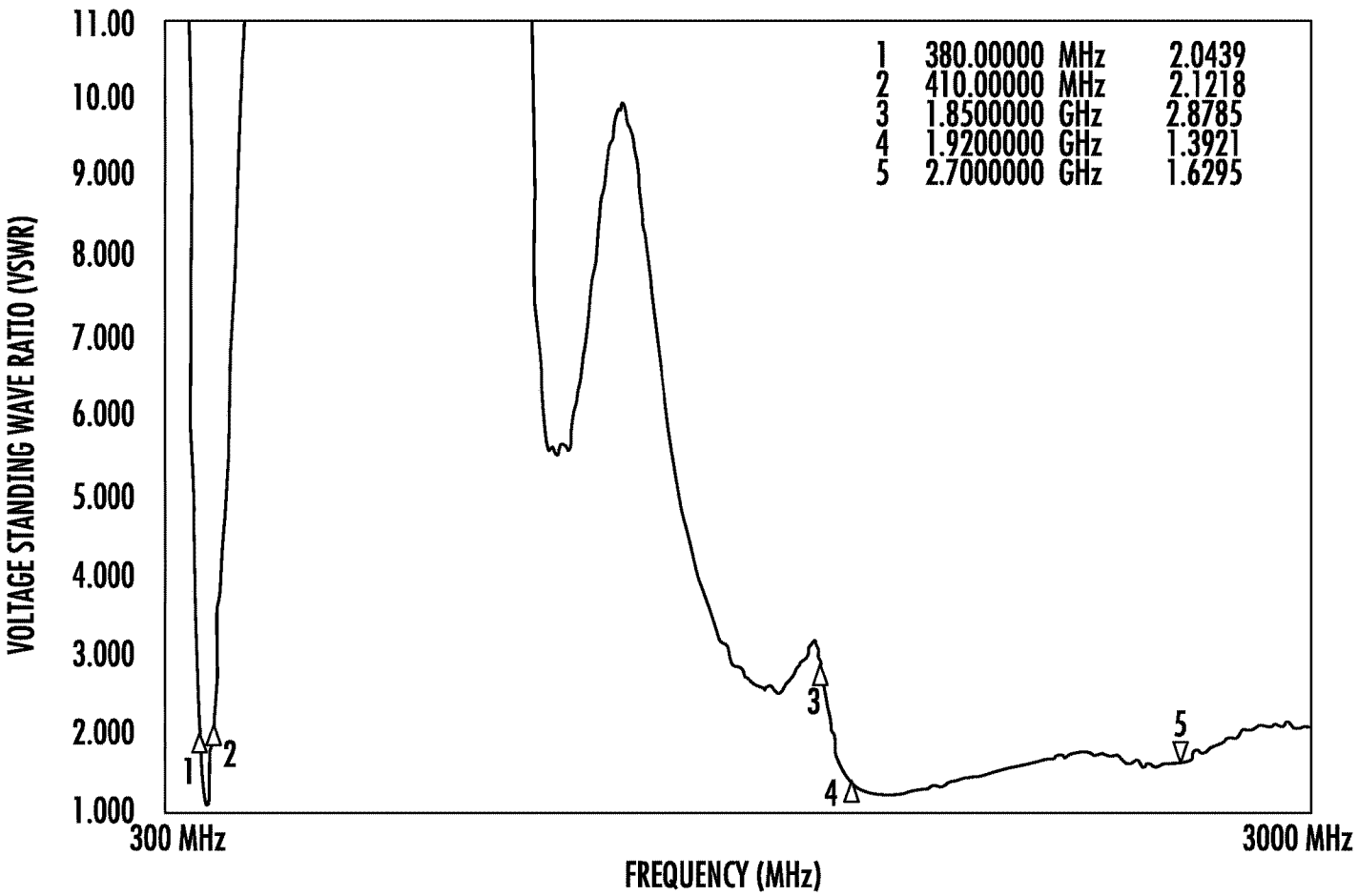
Figure 38:
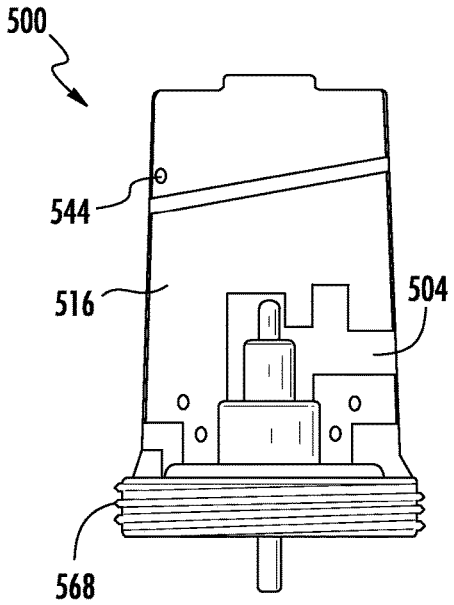
Figure 39:
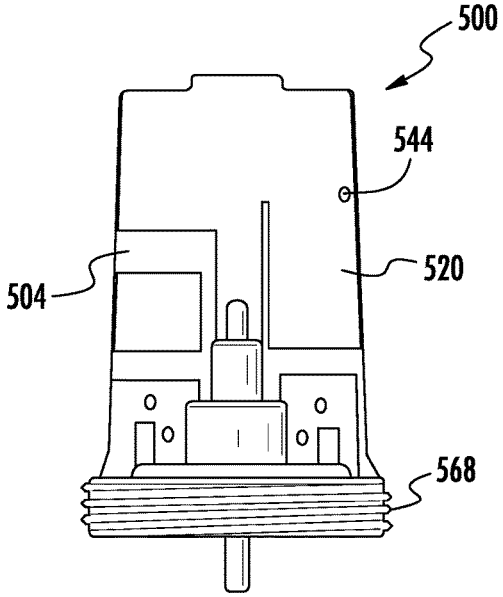
Figure 40:
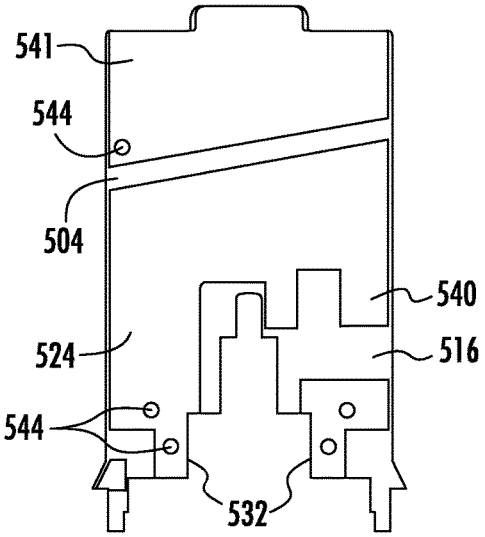
Figure 41:
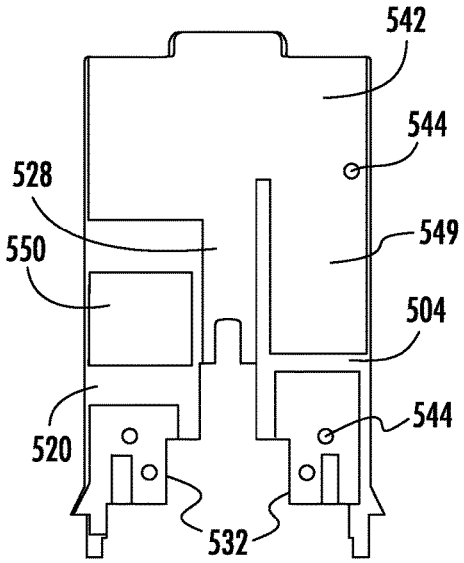
Figure 42:
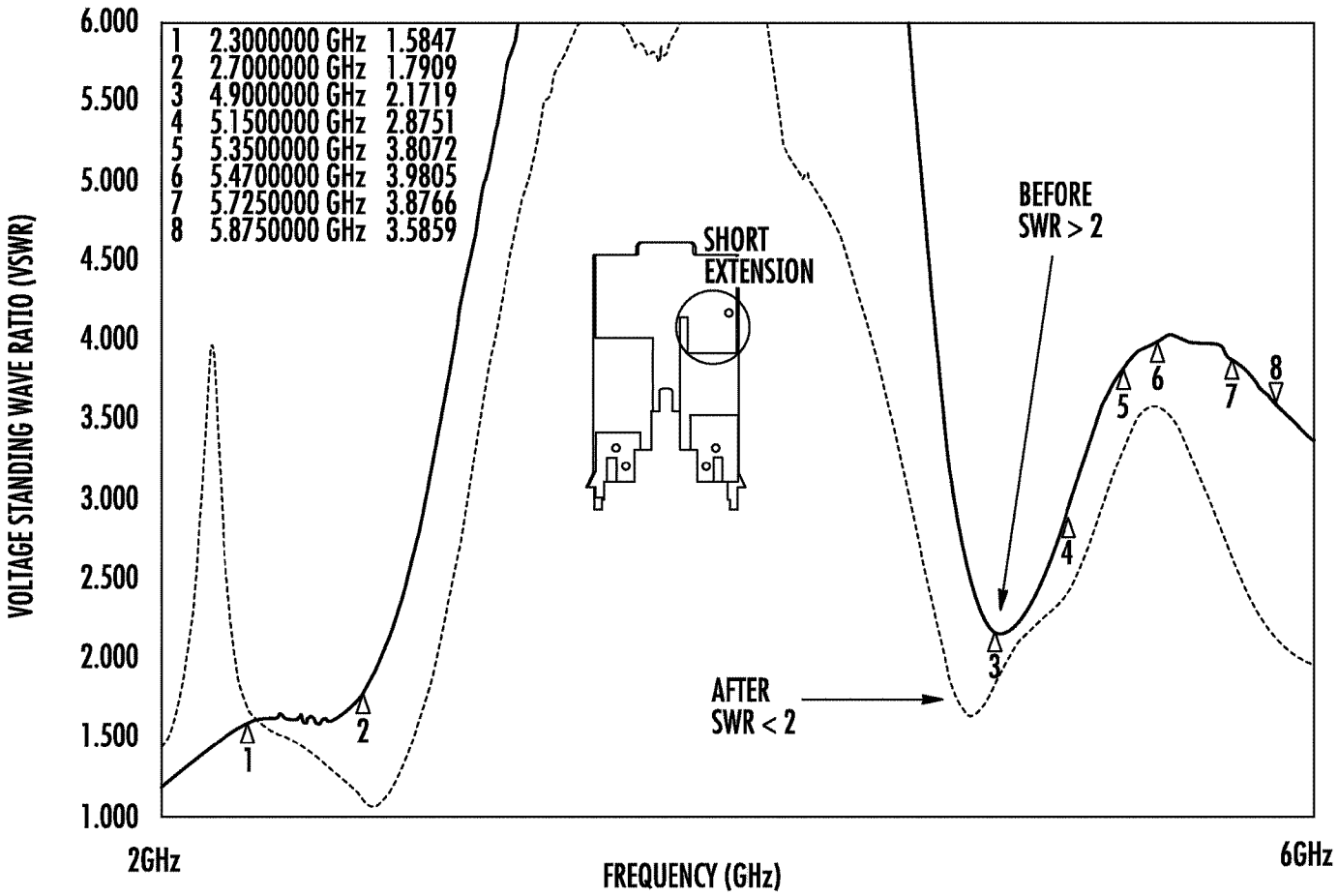
Figure 43:
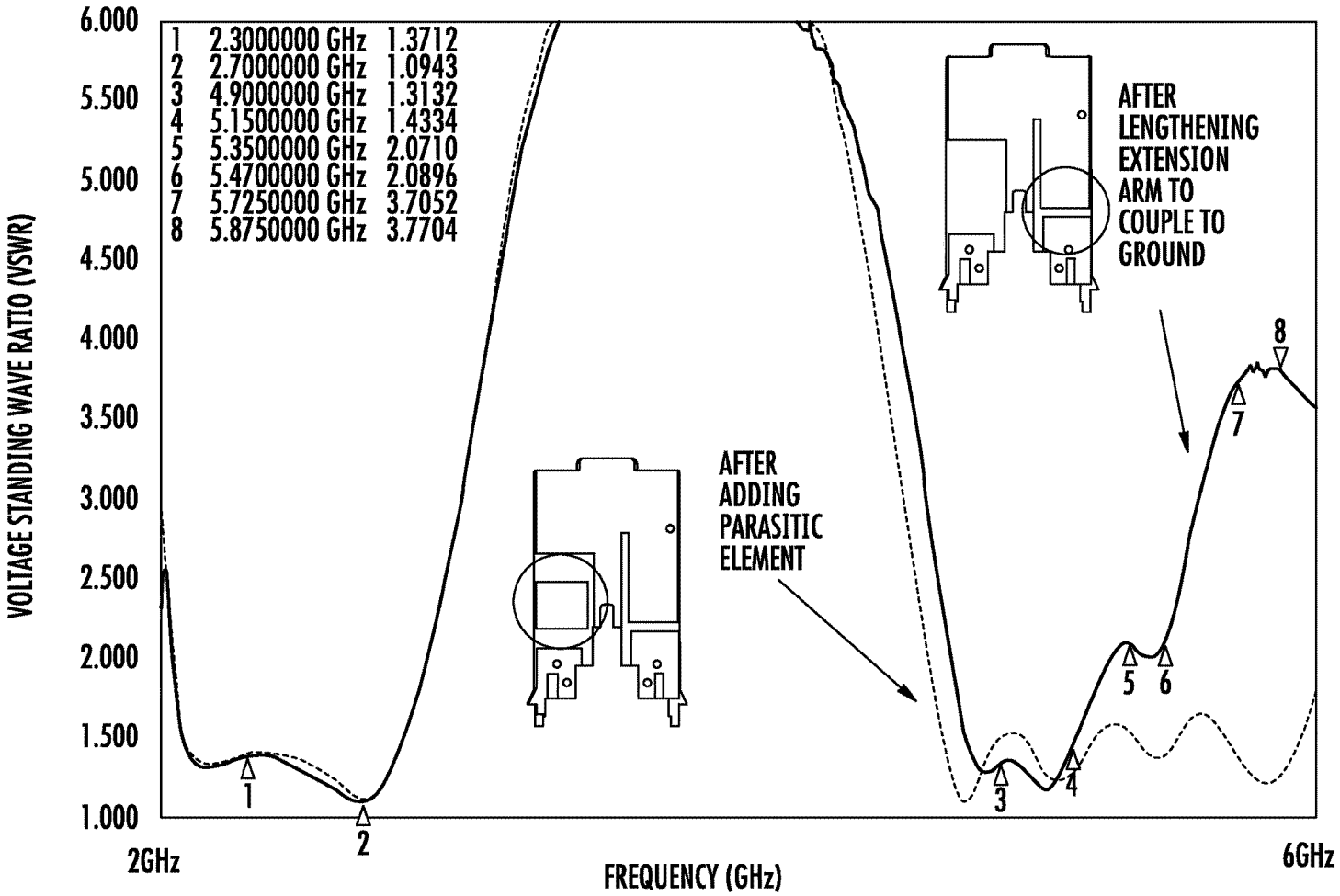
Figure 44A:
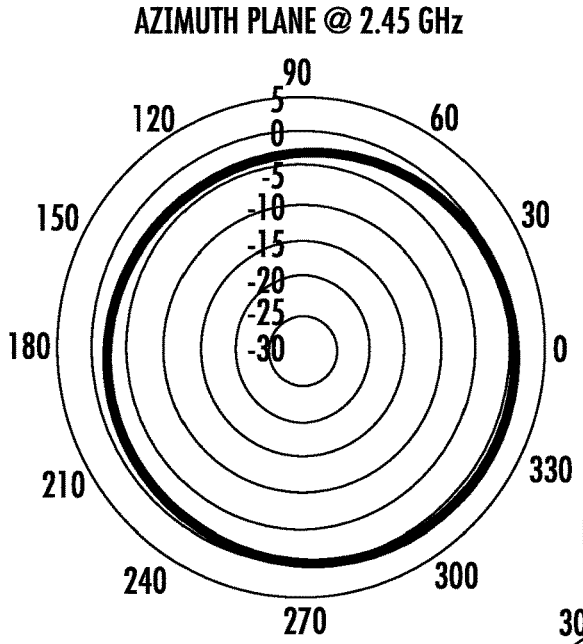
Figure 44B:
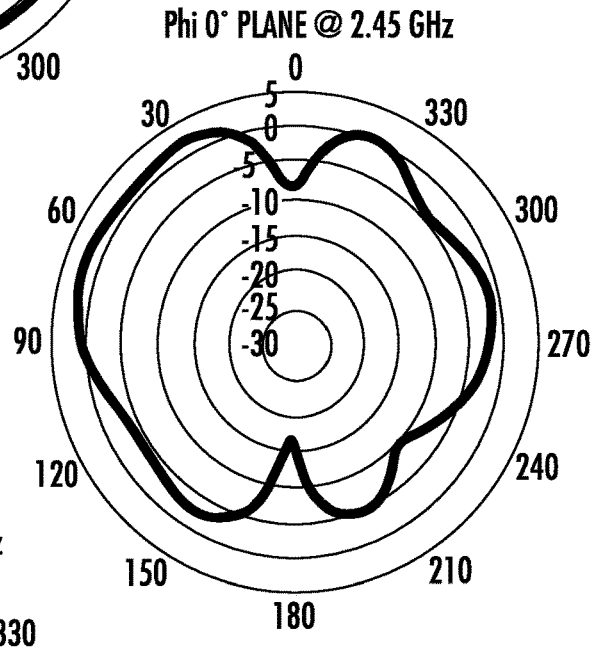
Figure 44C:
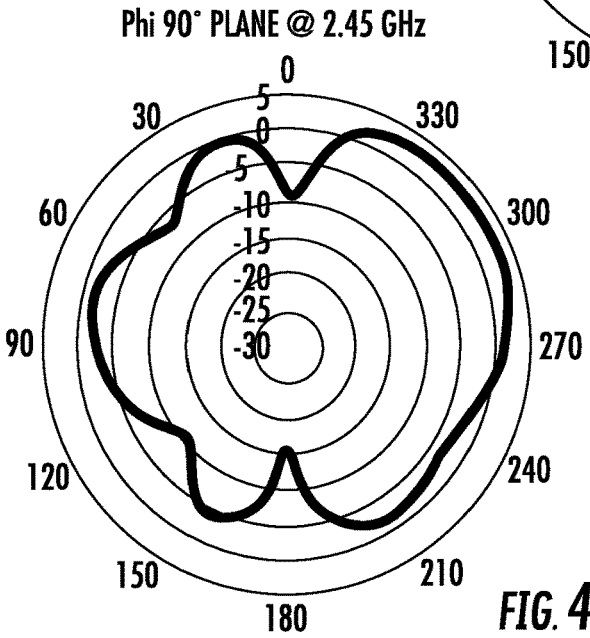
Figure 44D:
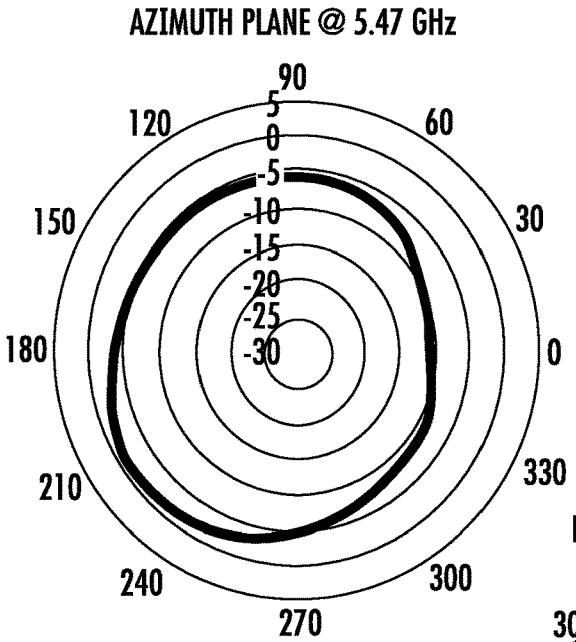
Figure 44E:
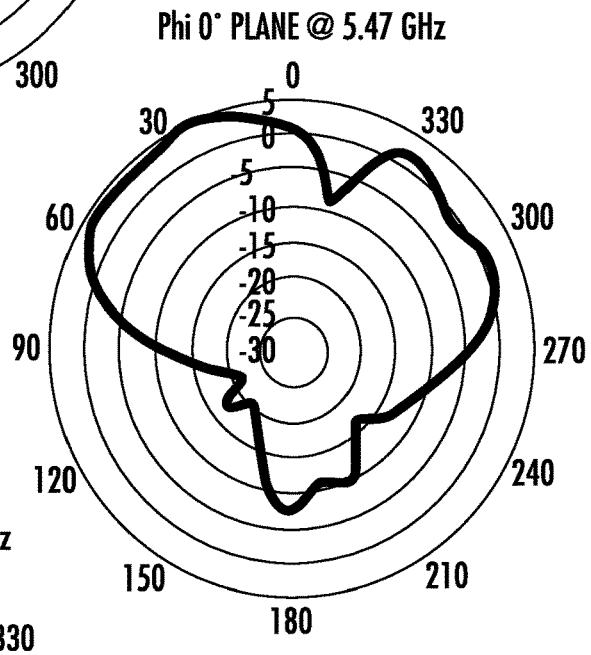
Figure 44F:
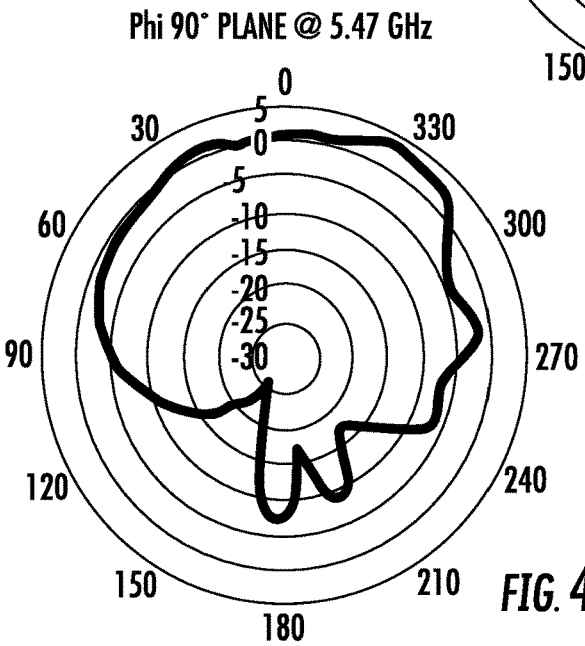

FIGS. 29, 30, 31, and 32 illustrate alternative PCB radiator structures tuned for different operating frequency ranges, which may be used on the back side of the multiband antenna assembly shown in FIG. 27;

FIG. 33 is an exemplary line graph illustrating voltage standing wave ratio (VSWR) versus frequency in megahertz (MHZ) measured for a prototype antenna assembly having features shown in FIGS. 27 and 29 with a two feet by two feet square ground plane and with NMO connector structure and a radome;

FIGS. 34A through 341 illustrate respective radiation patterns (azimuth plane, phi zero degree plane, and phi ninety degree plane) for a prototype antenna assembly having features shown in FIGS. 27 and 29 measured on a round plane having a seventy centimeter diameter at frequencies of 480 MHz, 1850 MHz, and 2500 MHz and with NMO connector structure and a radome;

FIG. 35 is an exemplary line graph illustrating voltage standing wave ratio (VSWR) versus frequency in megahertz (MHZ) measured for a prototype antenna assembly having features shown in FIGS. 27 and 30 with a two feet by two feet square ground plane and with NMO connector structure and a radome;

FIG. 36 is an exemplary line graph illustrating voltage standing wave ratio (VSWR) versus frequency in megahertz (MHZ) measured for a prototype antenna assembly having features shown in FIGS. 27 and 31 with a two feet by two feet square ground plane and with NMO connector structure and a radome;

FIG. 37 is an exemplary line graph illustrating voltage standing wave ratio (VSWR) versus frequency in megahertz (MHZ) measured for a prototype antenna assembly having features shown in FIGS. 27 and 32 with a two feet by two feet square ground plane and with NMO connector structure and a radome;

FIG. 38 is a perspective view illustrating an exemplary embodiment of a multiband antenna assembly, and also illustrating the multiband antenna assembly mounted to an exemplary NMO connector structure;

FIG. 39 is a back perspective view of the multiband antenna assembly shown in FIG. 38 and exemplary NMO connector structure;

FIG. 40 is a front view showing the PCB radiator structure of the multiband antenna assembly shown in FIG. 38;

FIG. 41 is a back view showing the PCB radiator structure of the multiband antenna assembly shown in FIG. 39;

FIG. 42 is an exemplary line graph illustrating voltage standing wave ratio (VSWR) versus frequency in gigahertz (GHz) measured for a prototype of an antenna assembly without a parasitic element, before and after adding a short extension arm, and with a two feet by two feet square ground plane and NMO connector structure;

FIG. 43 is an exemplary line graph illustrating voltage standing wave ratio (VSWR) versus frequency in gigahertz (GHz) measured for a prototype of an antenna assembly after lengthening the extension arm and then after adding a parasitic element, and with a two feet by two feet square ground plane and NMO connector structure;

FIGS. 44A through 44F illustrate respective radiation patterns (azimuth plane, phi zero degree plane, and phi ninety degree plane) measured for a prototype of the antenna assembly shown in FIGS. 38 and 39 at frequencies of 2.45

Figure 45:
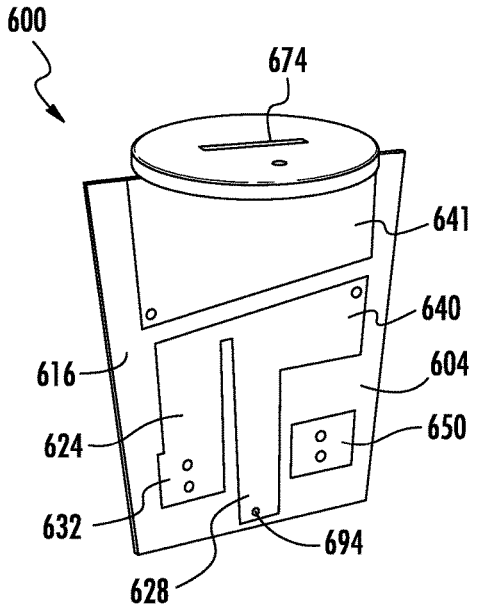
Figure 46:
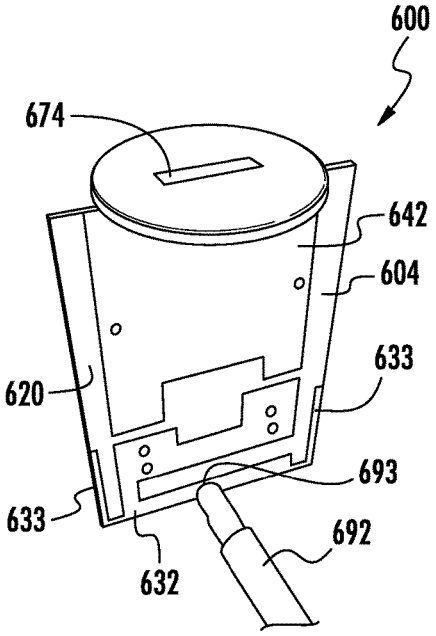
Figure 47:
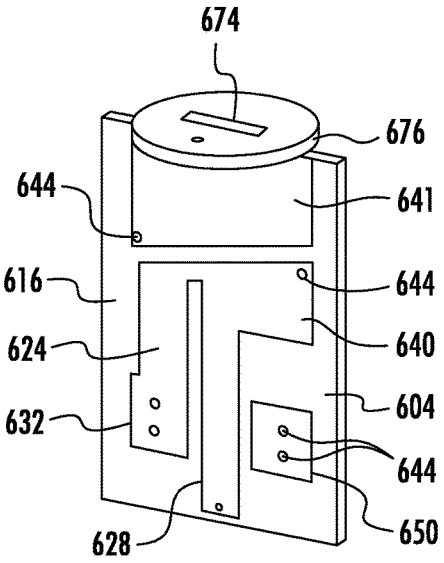
Figure 48:
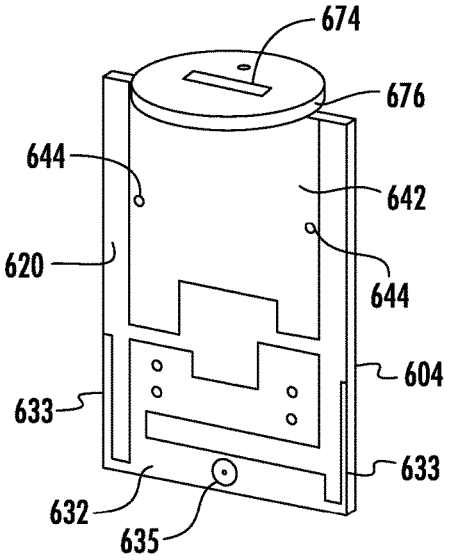
Figure 49:
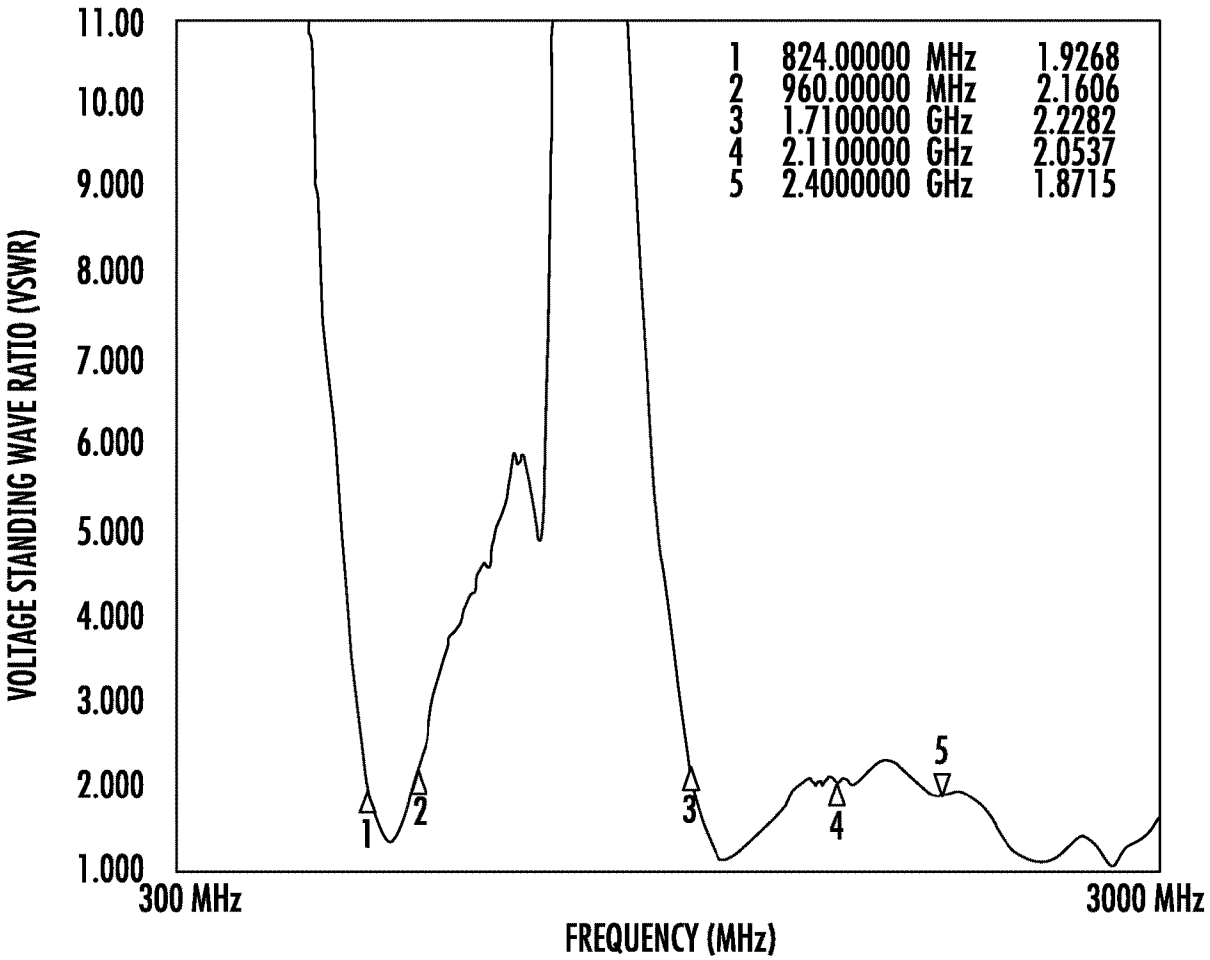
Figure 50:
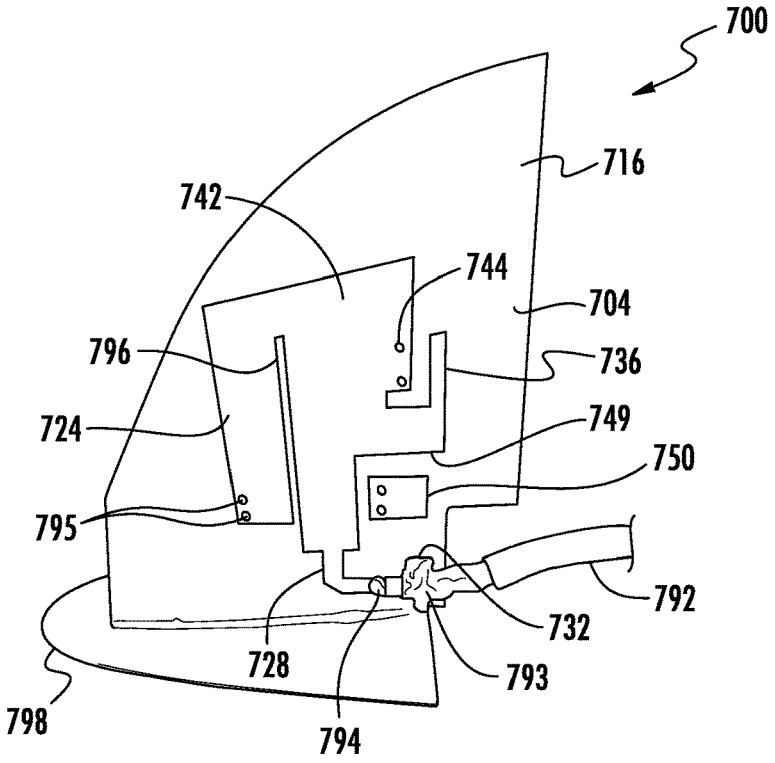
Figure 51:
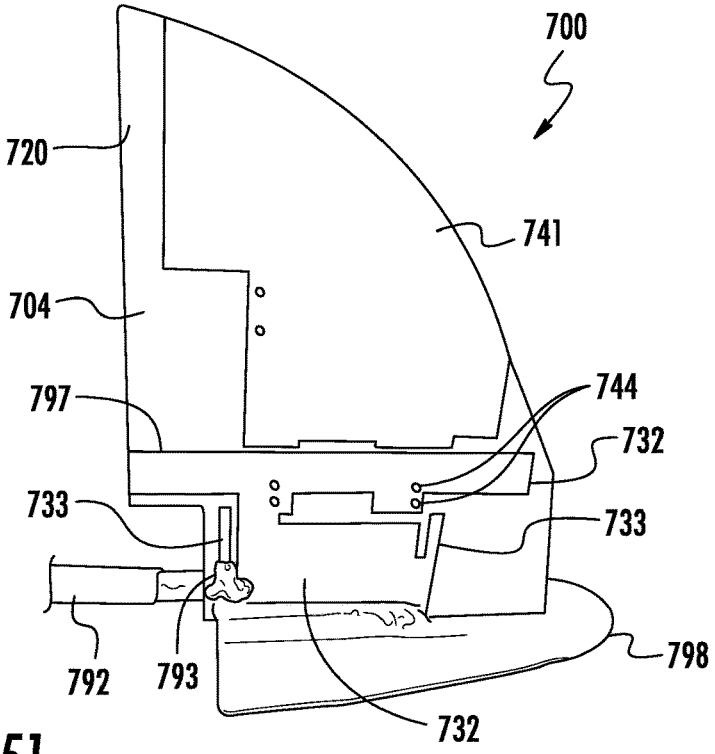
Figure 52:
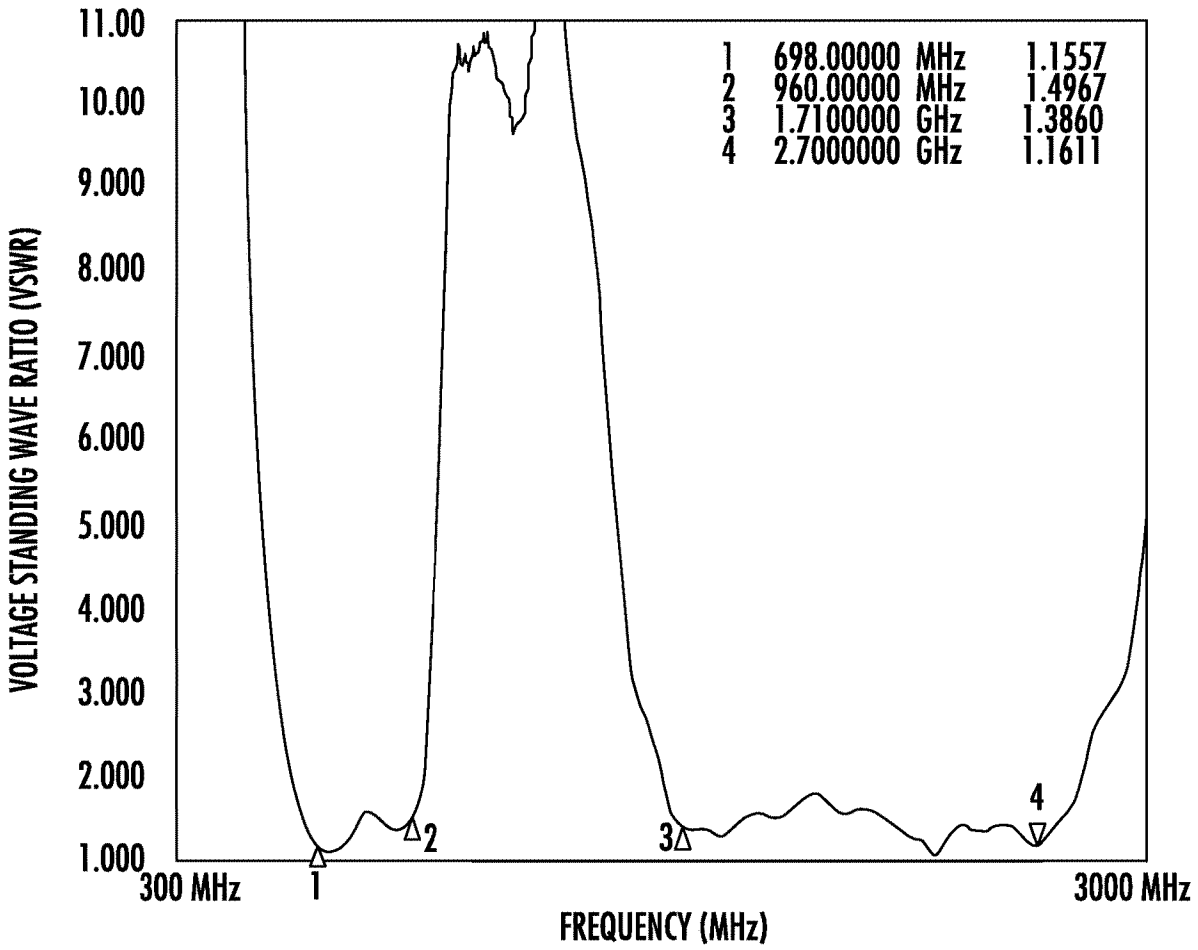
Figure 53:
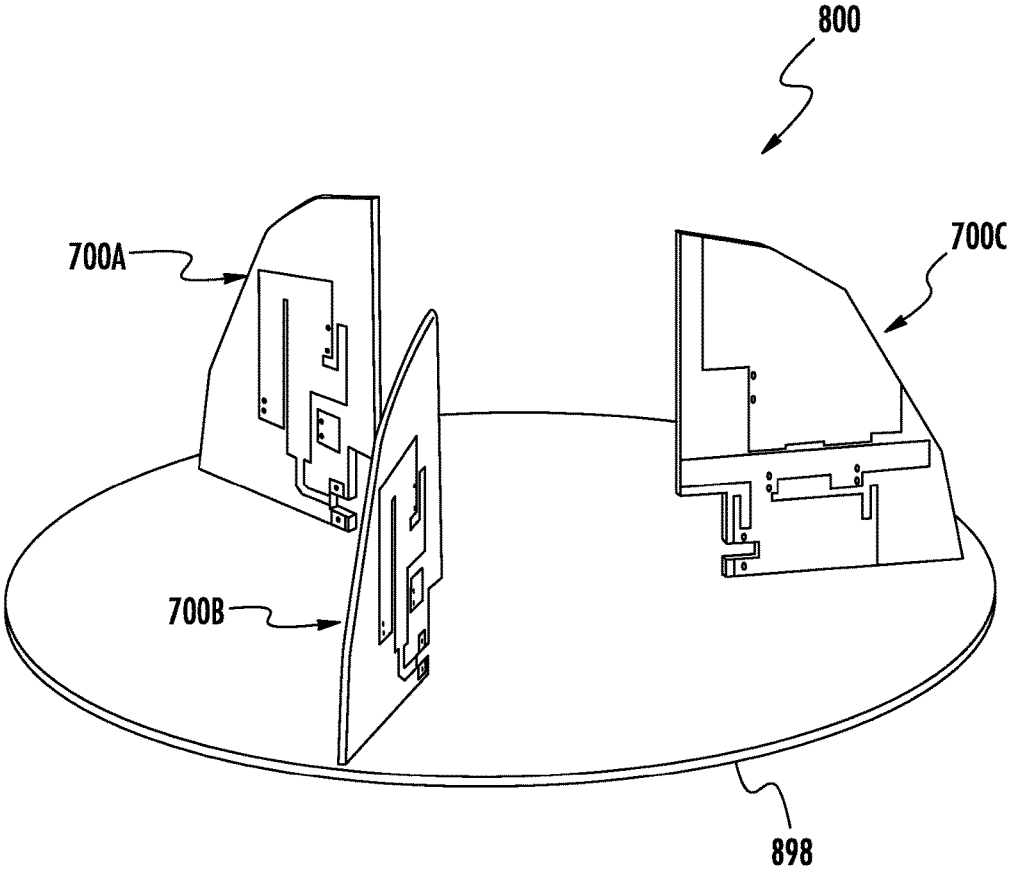
Figure 54A:
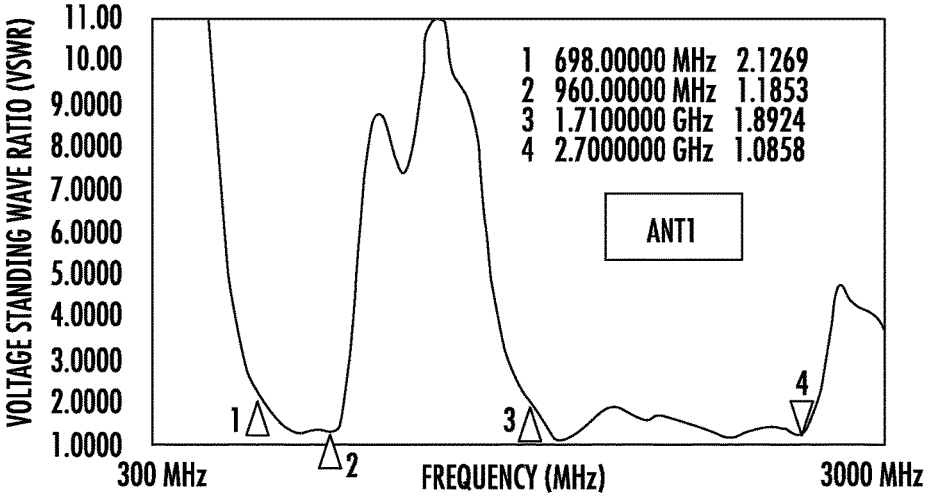
Figure 54B:
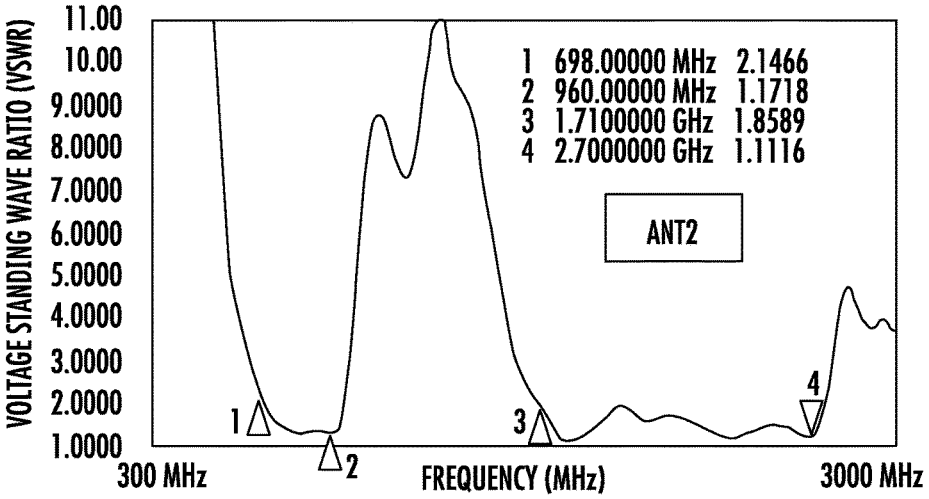
Figure 54C:
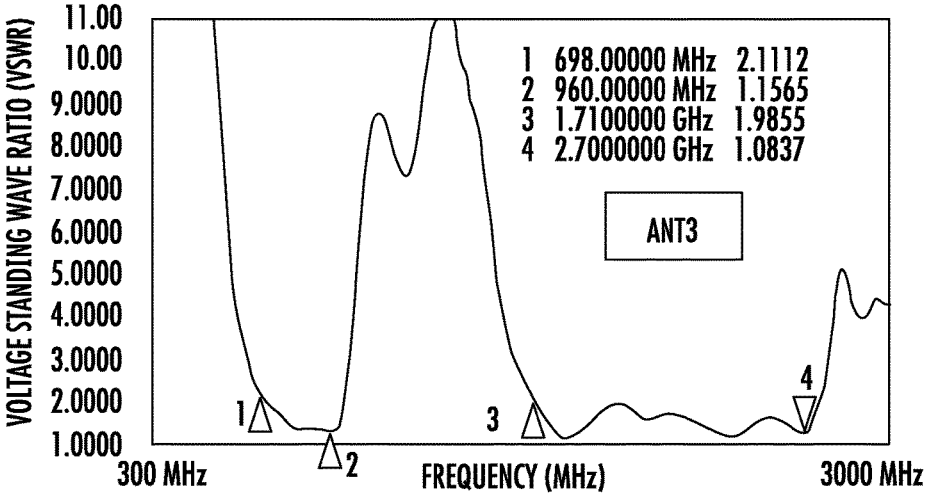
Figure 54D:
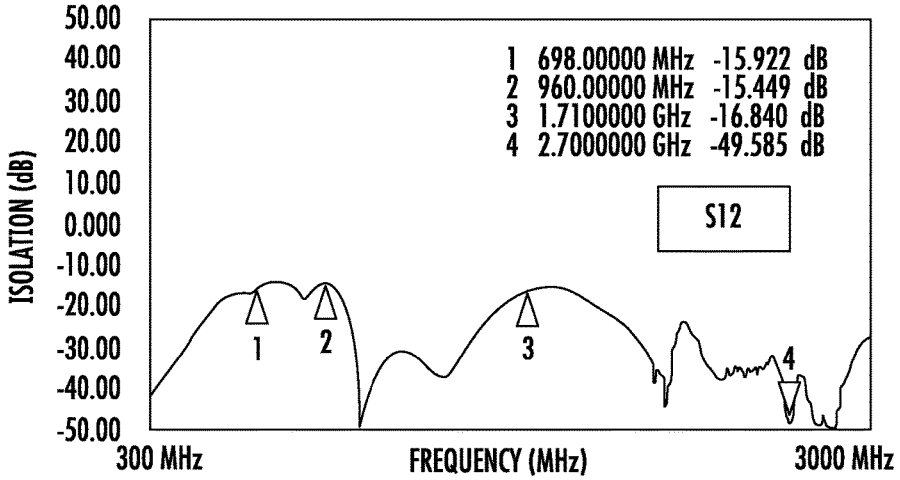
Figure 54E:
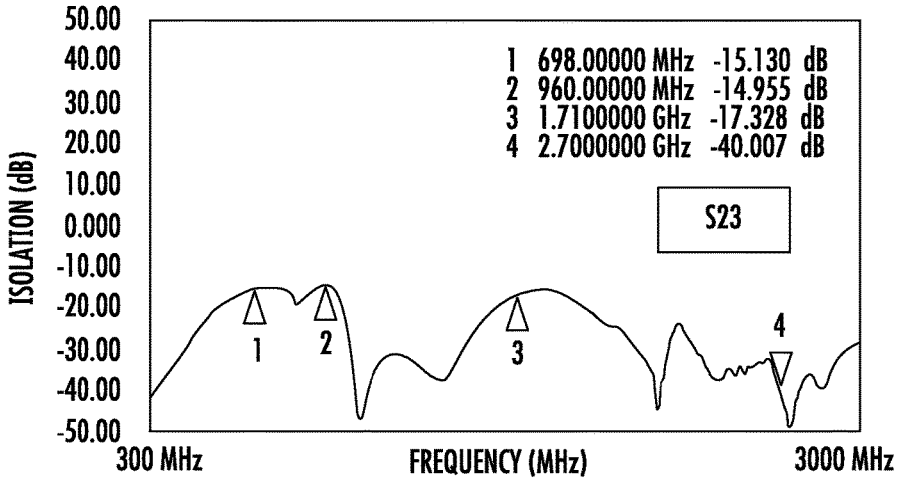
Figure 54F:
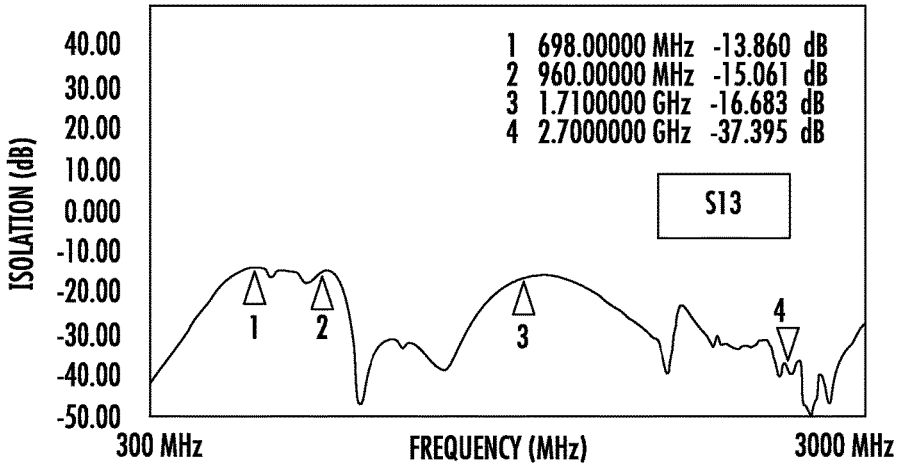
Figure 55:
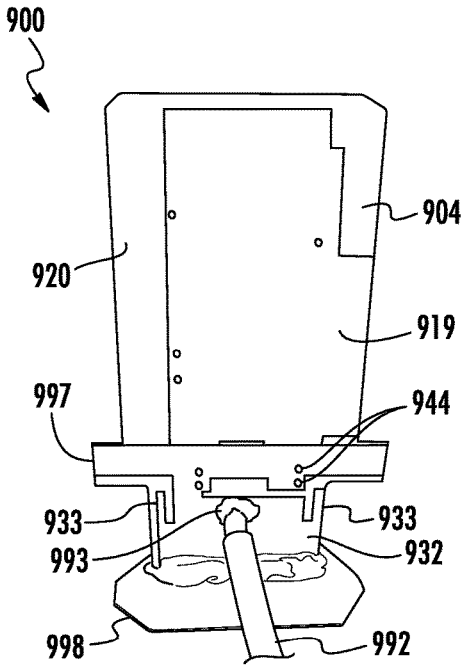
Figure 56:
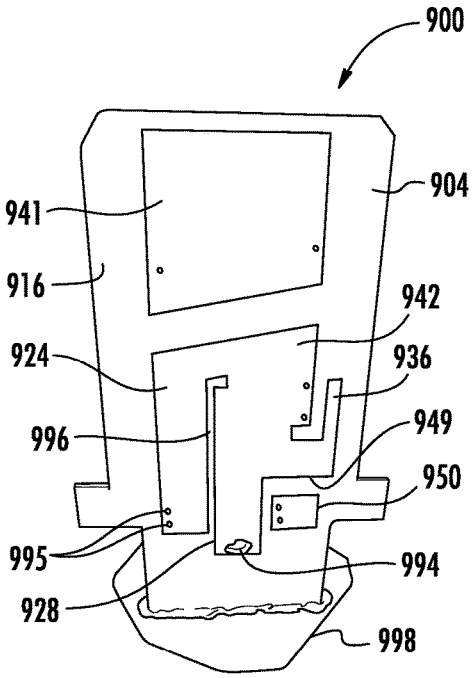
Figure 57:
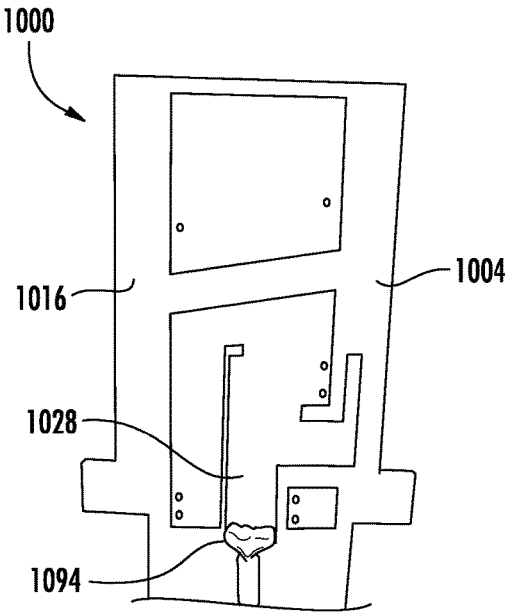
Figure 58:
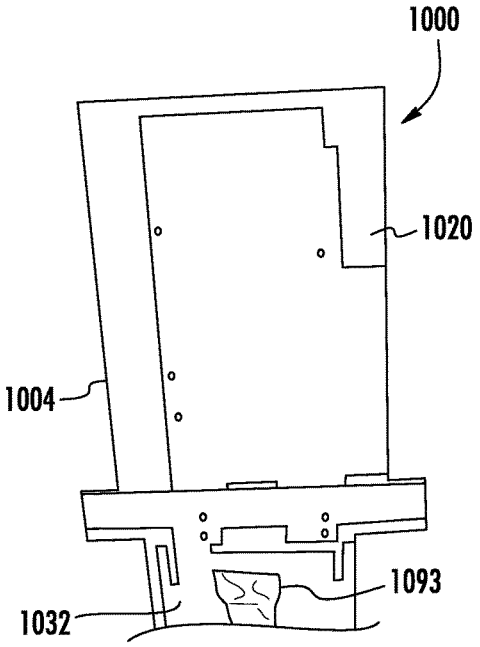

GHz and 5.47 GHz with a round ground plane with a 70 centimeter diameter and NMO connector structure;

FIG. 45 is a perspective view illustrating an exemplary embodiment of a multiband antenna, and also illustrating an exemplary feeding technique for the multiband antenna assembly;

FIG. 46 is a back perspective view of the multiband antenna assembly shown in FIG. 45;

FIG. 47 is a front view showing the PCB radiator structure of the multiband antenna assembly shown in FIG. 45;

FIG. 48 is a back view showing the PCB radiator structure of the multiband antenna assembly shown in FIG. 46;

FIG. 49 is an exemplary line graph illustrating voltage standing wave ratio (VSWR) versus frequency in megahertz (MHZ) measured for a prototype of the antenna assembly shown in FIGS. 46 and 47 on a two feet by two feet ground plane;

FIG. 50 is a perspective view illustrating an exemplary embodiment of a multiband antenna assembly for use with shark fin style antennas for vehicular applications, and also illustrating an exemplary feeding technique for the multiband antenna assembly;

FIG. 51 is a back perspective view of the multiband antenna assembly shown in FIG. 50;

FIG. 52 is an exemplary line graph illustrating voltage standing wave ratio (VSWR) versus frequency in megahertz (MHz) measured for a prototype of the antenna assembly shown in FIGS. 50 and 51 with a two feet by two feet ground plane;

FIG. 53 is a perspective view of a multiple-antenna system having three of the antenna assemblies shown in FIGS. 50 and 51 with 120° separation between the antenna assemblies and suitable for Multiple Input Multiple Output (MIMO) applications according to an exemplary embodiment of the present disclosure;

FIGS. 54A, 54B, and 54C are exemplary line graphs respectively illustrating voltage standing wave ratio (VSWR) measured for each of the three antenna assemblies of a prototype of the multiple-antenna system shown in FIG. 53;

FIGS. 54D, 54E, and 54F are exemplary line graphs respectively illustrating isolation (in decibels) versus frequency in megahertz (MHz) measured for each of the three antenna assemblies of a prototype of the multiple-antenna system shown in FIG. 53;

FIG. 55 is a perspective view illustrating an exemplary embodiment of a multiband antenna assembly and a center feeding technique for the multiband antenna assembly;

FIG. 56 is a back perspective view of the multiband antenna assembly shown in FIG. 55;

FIG. 57 is a perspective view illustrating an exemplary embodiment of a multiband antenna assembly and a bottom center feeding technique for the multiband antenna assembly; and FIG. 58 is a back perspective view of the multiband antenna assembly shown in FIG. 57.

DETAILED DESCRIPTION

Example embodiments will now be described more fully with reference to the accompanying drawings.

The inventors hereof have recognized that some existing multiband antenna assemblies having only printed circuit board radiating elements are sometimes required to fit within a relatively limited space or volume for vehicular applications, machine to machine equipment, in-building radomes, etc. But the inventors hereof have recognized the following drawbacks with such multiband antenna assemblies. For example, such multiband antenna assemblies have relatively low efficiency, low overall RF performance, narrow bandwidths, such as at Ultra High Frequency (UHF) band (e.g., 380 MHz to 527 MHz), and/or a radiation pattern of the low band that is not omnidirectional. Due to the narrow bandwidth, matching lump components may be used to broaden the bandwidth, and the antenna may be shorted to ground by an inductor or capacitor. This, in turn, may require manual tuning due to the matching components and/or additional matching lump components for tuning that may lead to component or performance loss. Lump component matching network implementation is prone to inconsistent results that may lead to poor yield in production. Manual tuning may be required to increase production yield, at the cost of increased cycle time leading to a more expensive antenna.

Accordingly, the inventors have disclosed herein exemplary embodiments of multiband antenna assemblies having matching elements printed on the boards thereby eliminating the need for lump components. In some exemplary embodiments disclosed herein, a multiband antenna assembly does not include any lump components like leaded capacitors, air wound inductors, or bended metal strips. Instead, a multiband antenna assembly includes matching elements printed on one or more printed circuit boards (broadly, substrates), which also include elements for multiband operation.

Figure 1:
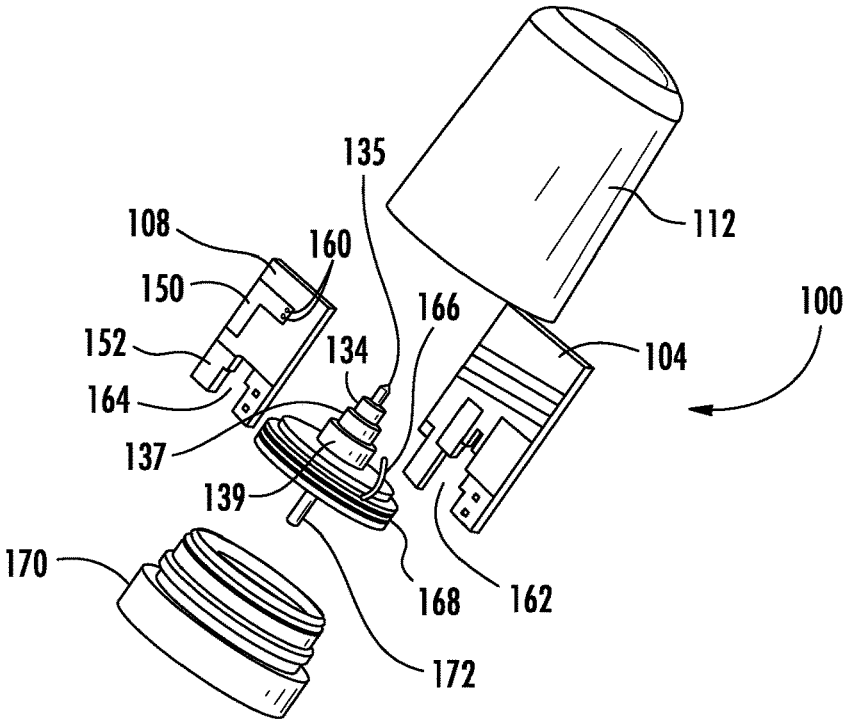
FIG. 1 is an exploded perspective view illustrating components of an exemplary embodiment of a multiband antenna assembly having a main PCB and a parasitic PCB, and also illustrating an exemplary radome and NMO connector structure that may be used with the multiband antenna assembly.
Figure 2:
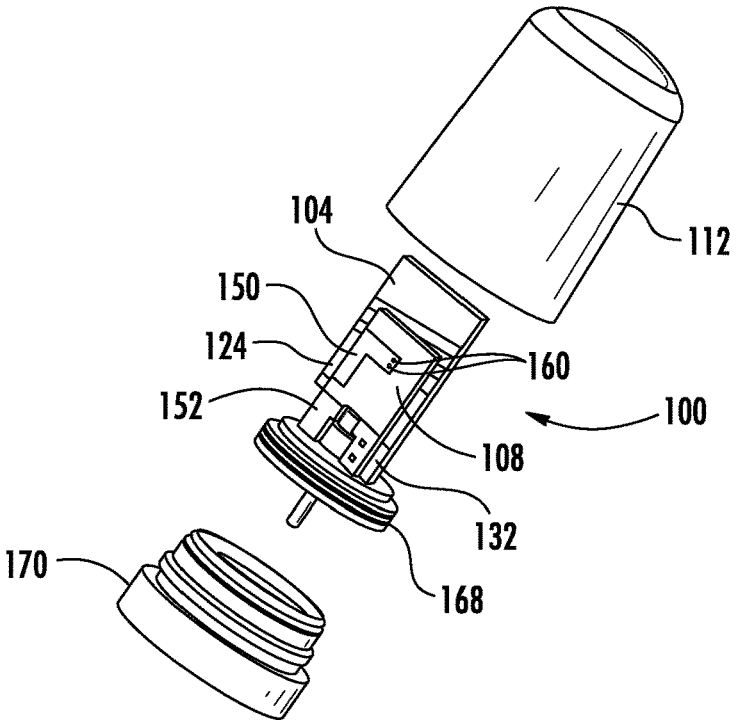
FIG. 2 is another exploded perspective view illustrating the multiband antenna assembly shown in FIG. 1 with its components assembled and mounted to the NMO connector structure.
Figure 3:
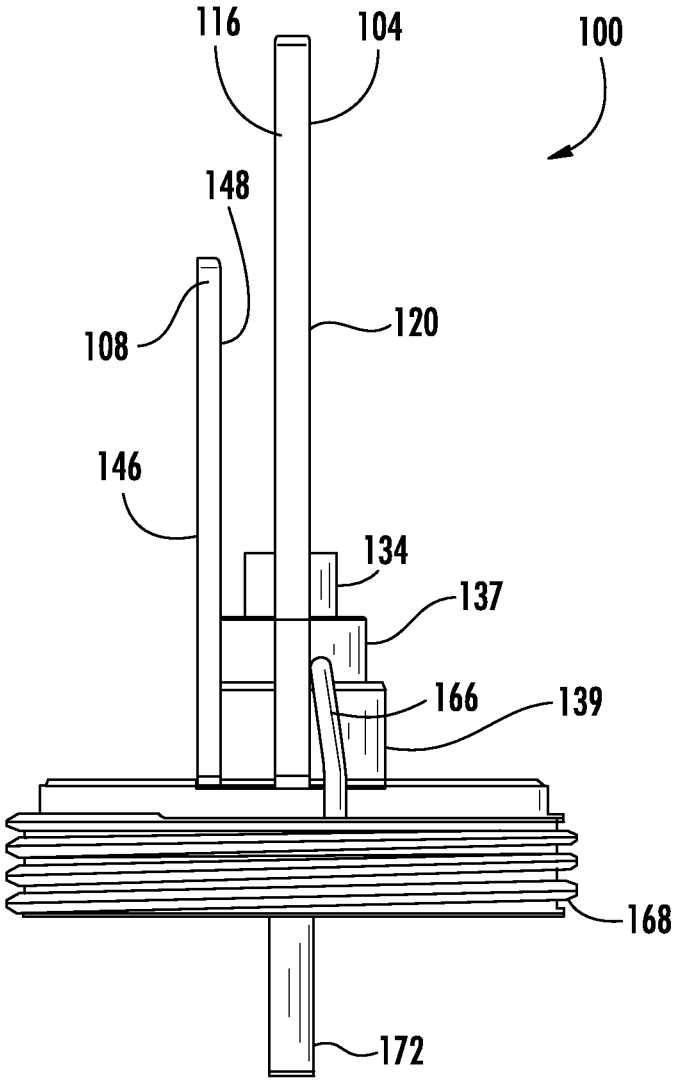
FIG. 3 is a side view of the multiband antenna assembly shown in FIG. 2.

With reference now to the figures, FIGS. 1 through 3 illustrate an exemplary embodiment of a multiband antenna assembly 100 embodying one or more aspects of the present disclosure. As shown in FIG. 1, the antenna assembly 100 generally includes a first or main printed circuit board (PCB) 104 and a second or parasitic printed circuit board (PCB) 108. The PCBs 104, 108 include various elements (e.g., electrically conductive traces, etc.) configured such that the multiband antenna assembly 100 is operable over and covers multiple frequency ranges or bands, including a first frequency range (or low band) from about 806 MHz to about 960 MHz and a second frequency range (or high band) from about 1710 MHz to about 2500 MHz. Advantageously, the inventors have recognized that having two PCBs allows utilization of a three dimensional space or volume (e.g., under antenna radome or sheath 112, etc.) with a broader bandwidth.

Figure 4:
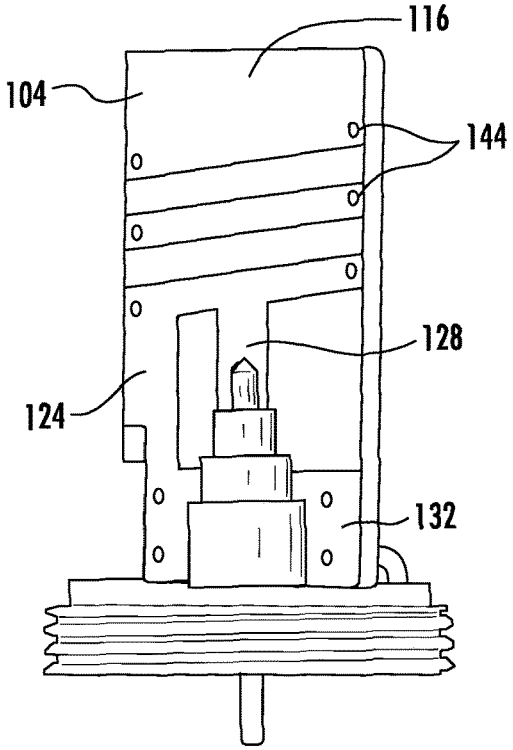
FIG. 4 is a view of the multiband antenna assembly shown in FIG. 2 without the second or parasitic PCB in order to better illustrate the front of the first or main PCB.
Figure 5:
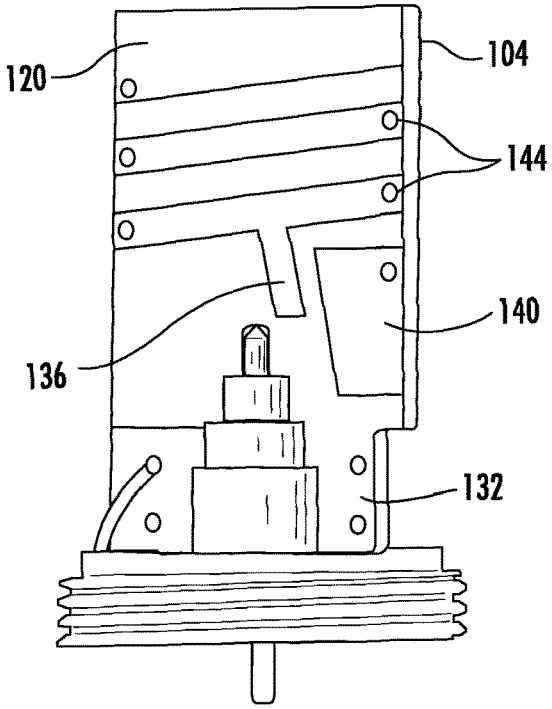
FIG. 5 is a view of the multiband antenna assembly shown in FIG. 2 and illustrating the back of the main PCB.

With reference to FIGS. 4 and 5, the main PCB 104 is a double-sided PCB with elements on its front or first side 116 (FIG. 4) and back or second side 120 (FIG. 5). A shorted or shorting element 124, a feed element 128, and a portion (e.g., one or more grounding tabs or taps, etc.) of the PCB ground 132 are disposed along or on the front side 116 of the PCB 104. The feed element 128 is electrically connected (e.g., soldered, etc.) to a contact or a pin 135 of a spring contact assembly 134 (e.g., spring loaded contact pin or pogo pin, etc.). A stub element 136, a high band radiating element 140, and a portion of the PCB ground 132 are disposed along or on the back side 120 of the PCB 104.

The PCB 104 also includes plated thru holes or vias 144 extending from the front side 116 to the back side 120. The plated thru holes or vias 144 may be used to electrically (e.g., directly or galvanically, etc.) connect elements on opposite sides of the PCB 104. For example, the front and back portions of the PCB ground 132 may be electrically connected by plated thru holes or vias 144. As another example, the shorting element 124 and high band radiating element 140 may be electrically connected by a plated thru hole or via 144.

Figure 6:
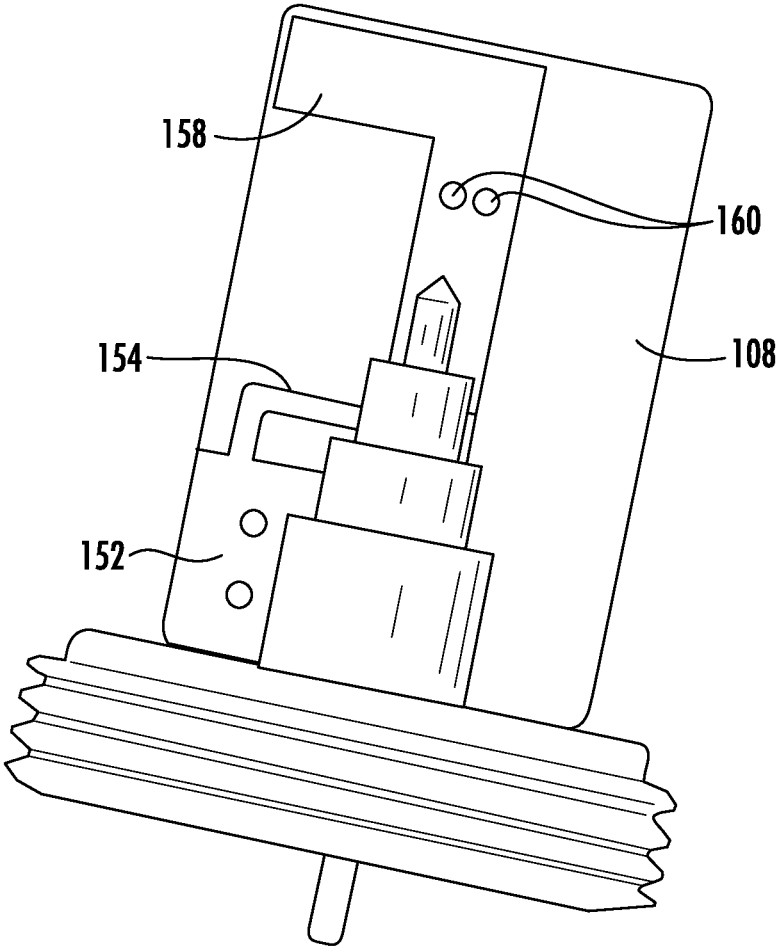
FIG. 6 is a cross-sectional view of the multiband antenna assembly shown in FIG. 2 and illustrating the back of the parasitic PCB.

With reference to FIGS. 2 and 6, the parasitic PCB 108 is also a double-sided PCB with elements on its front or first side 146 (FIG. 2) and back or second side 148 (FIG. 6). A first or front parasitic resonator or radiating element 150 and a portion (e.g., one or more grounding taps or tabs, etc.) of the PCB ground 132 are disposed along or on the front side 146 of the PCB 108. A shorted or shorting element 154 and a second or back parasitic resonator or radiating element 158 are disposed along or on the back side 148 of the PCB 108.

The second or parasitic PCB 108 also includes plated thru holes or vias 160 extending from the front side 146 to the back side 148. The plated thru holes or vias 160 electrically (e.g., directly or galvanically, etc.) connect elements on opposite sides of the parasitic PCB 108. For example, the first and second parasitic resonators or radiating elements 150 and 158 on the respective PCB's front and back sides 146, 148 may be electrically connected by plated thru holes or vias 160. The soldering tab 152 may be soldered to the metal ring 139. The metal ring 139 is connected to the main PCB 104 via soldering at portion 132, which is subsequently shorted to ground via an electrical conductor 166.

During operation, the parasitic elements 150 and 158 of the parasitic PCB 108 are operable as an additional radiator, which is capacitively or parasitically coupled to the main PCB 104 to broaden the bandwidth. Accordingly, the multiband antenna assembly 100 may thus be configured to have broadband characteristics by utilizing the parasitic PCB 108, which is shorted to ground by the shorting element 154 and helps broaden the bandwidth of both the high and low bands.

As shown in FIG. 1, each PCB 104, 108 also includes notches, cutout areas, or openings 162, 164, respectively, in its substrate, board, or body. These openings 162, 164 are configured for receiving upper portions of the spring contact assembly 134 as shown in FIGS. 4 through 6. Also shown in FIG. 1 are an insulator 137 and an electrically-conductive ring 139 (e.g., a metal ring, etc.). The electrically-conductive ring 139 couples to the ground of the PCB 104.

As shown in FIGS. 3 and 5, an electrical conductor 166 (e.g., a metal wire, metal tube, etc.) is electrically connected (e.g., soldered, etc.) to the portion of the ground 132 on the back side 120 of the PCB 104. The conductor 166 is electrically connected (e.g., soldered, etc.) to the connector 168 (e.g., threaded tube or base ring, etc.).

As shown in FIG. 2, the PCBs 104, 108 are configured to be mounted to the connector 168 and to be contained within or under the sheath or radome 112. The connector 168 may be coupled to (e.g., threaded onto, etc.) a housing or shell 170. The lower portion of the housing or shell 170 may be internally threaded to allow the housing or shell 170 to be threaded onto a correspondingly threaded portion of an antenna mount (e.g., a NMO (New Motorola) mount, etc.). In turn, the antenna mount may be installed or mounted to a vehicle surface, such as the roof, trunk, or hood of an automobile. The antenna mount may also be connected to one or more electronic devices (e.g., a radio receiver, a touchscreen display, GPS navigation device, cellular phone, etc.) inside the passenger compartment of the vehicle. Accordingly, the multiband antenna assembly 100 may be operable for transmitting and/or receiving signals to/from the electronic device(s) inside the vehicle when the multiband antenna assembly 100 is coupled to the antenna mount by the connector 168 and spring contact assembly 134 (e.g., spring-loaded center feeding pin or pogo pin, etc.). With the spring contact assembly 134 coupled to the PCBs 104, 108 (e.g., by a solder connection, etc.), the downwardly extending pin 172 of the spring contact assembly 134 may be used to electrically and galvanically contact the center contact of an antenna mount when the connector shell 170 is threaded onto the antenna mount.

In this exemplary embodiment, the distance between the feed 128 and the shorting element 124 is part of the matching factor for the multiband antenna assembly 100. This, in turn, will help improve the voltage standing wave ratio level overall.

The inventors hereof have observed that there is a spike in the VSWR that will limit the bandwidth especially for the high band. Accordingly, the inventors have configured the matching stub element 136 (FIG. 5) such that coupling of the stub element 136 with the high band radiating element 140 helps cancel out or at least reduce the spike of the VSWR, see, for example, FIGS. 9 and 10. This, in turn, helps create a larger bandwidth of the high band.

In this exemplary embodiment, the design of the multiband antenna assembly 100 is generally based on a monopole antenna with a shorting or shorted trace and with matching elements printed on a board without the need of or requiring any lump components like a leaded capacitor, an air wound inductor, or a bended metal strip. This exemplary embodiment of the multiband antenna assembly 100 may provide one or more (but not necessarily any or all) of the following advantages over some existing multiband antenna assemblies for vehicular applications, machine to machine equipment, in-building applications, etc. For example, this exemplary embodiment includes stub matching for broadening bandwidth and parasitic resonators shorted to ground such that there is more bandwidth for the antenna performance. Matching lump components are not used in this exemplary embodiment, which may allow for more consistent radio frequency (RF) performance and allow for improved efficiency. As noted above, matching lump components might lead to component loss and inconsistent results. Eliminating matching lump components may also facilitate the manufacturing process by eliminating the need to manually tune matching lump components in production thereby shortening cycle time.

FIGS. 7 through 10 provide analysis results measured for a prototype of the antenna assembly 100 shown in FIG. 1. These analysis results shown in FIGS. 7 through 10 are provided only for purposes of illustration and not for purposes of limitation.

Figure 7:
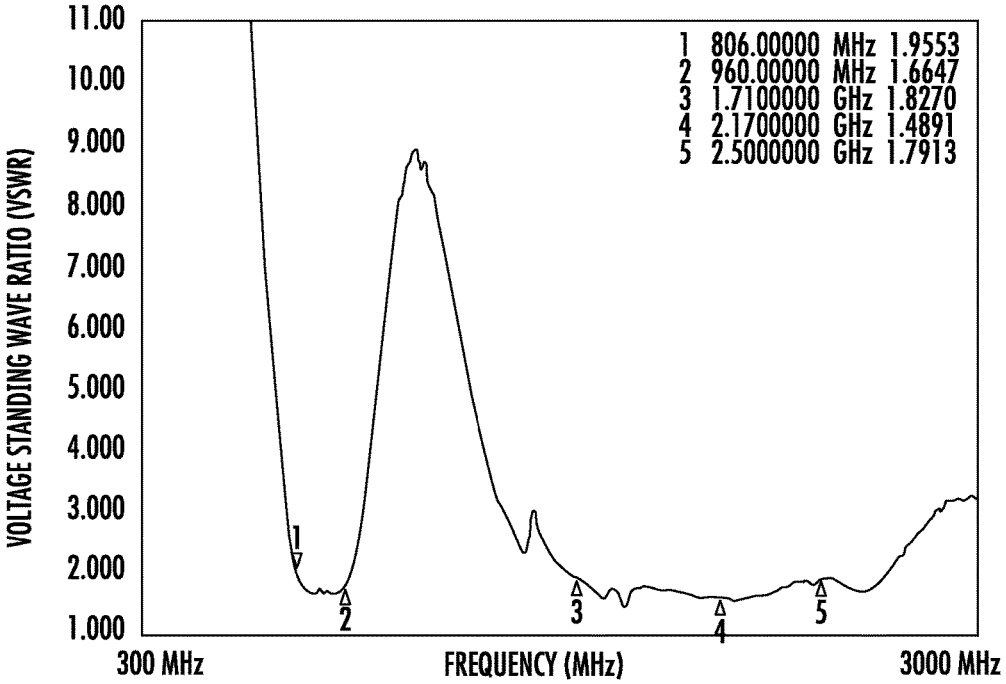
FIG. 7 is an exemplary line graph illustrating voltage standing wave ratio (VSWR) versus frequency in megahertz (MHZ) measured for a prototype of the antenna assembly shown in FIG. 2 with a two feet by two feet square ground plane.
Figure 8A:
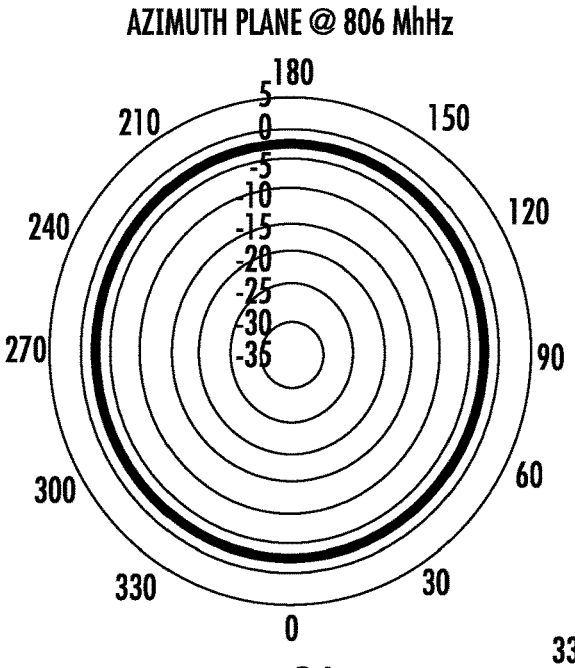
FIGS. 8A through 8F illustrate respective radiation patterns (azimuth plane, phi zero degree plane, and phi ninety degree plane) measured for a prototype of the antenna assembly shown in FIG. 2 at frequencies of 806 MHz and 1710 MHz with a round ground plane with a 70 centimeter diameter.
Figure 8B:
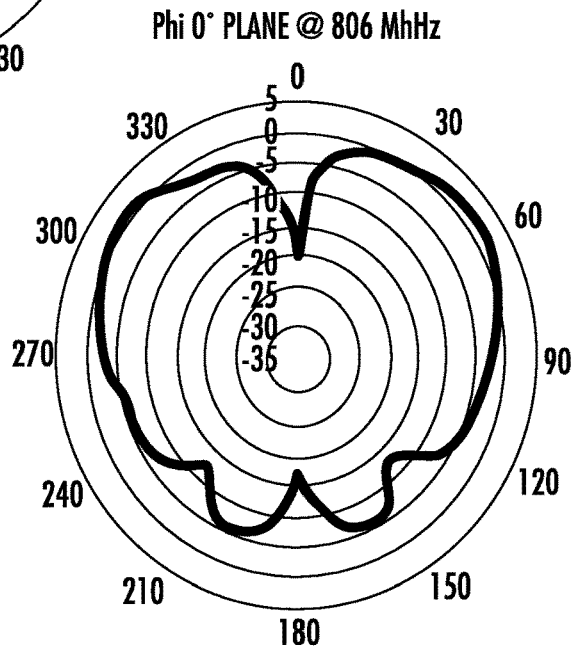
Figure 8C:
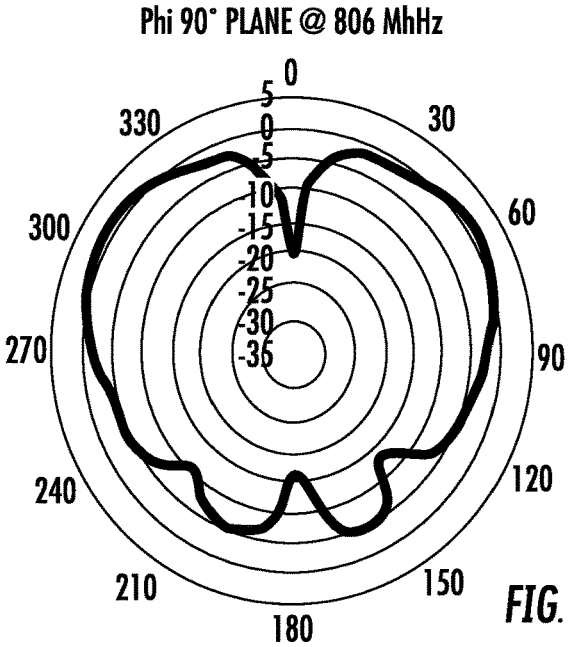
Figure 8D:
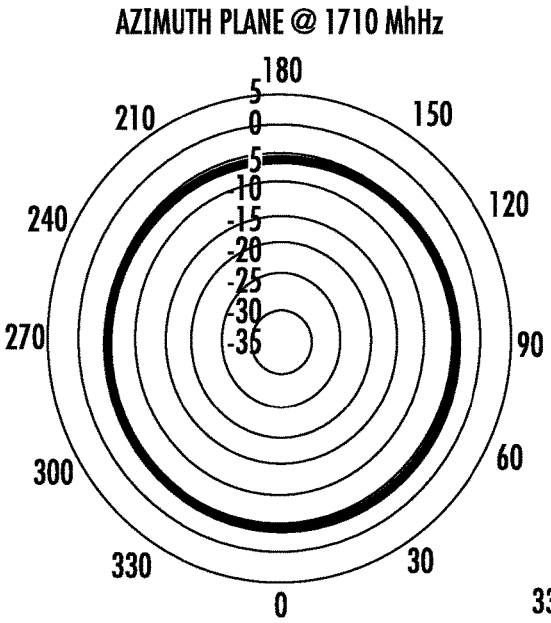
Figure 8E:
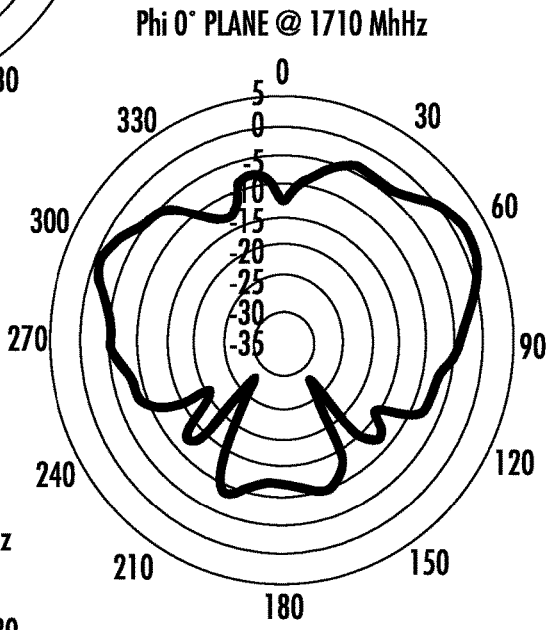
Figure 8F:
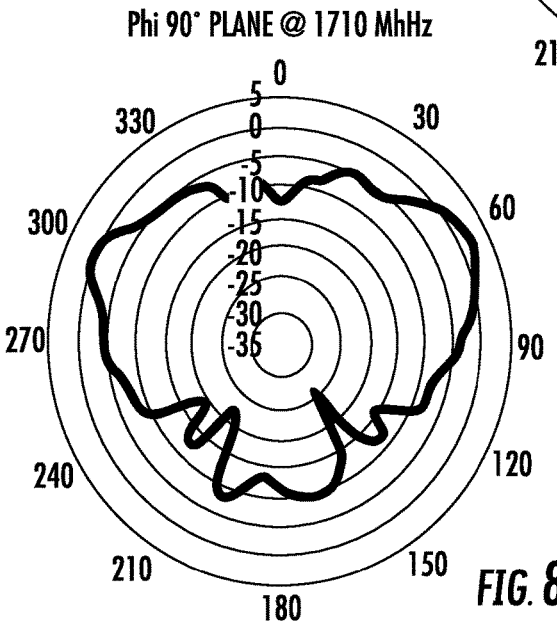

More specifically, FIG. 7 is an exemplary line graph illustrating voltage standing wave ratio (VSWR) versus frequency in megahertz (MHZ) measured for a prototype of the antenna assembly 100. Generally, FIG. 7 shows that this antenna assembly 100 has a relatively good VSWR of less than two for frequencies within a first frequency range (or low band) from about 806 MHz to about 960 MHz and within a second frequency range (or high band) from about 1710 MHz to about 2500 MHz.

The whole trace provides both the low band and high band. But both bands may not be in the right frequency ratio and may be too narrow. The number of turns of the planar helical will affect the frequency ratio, which may need to be fine-tuned. And, the bands may need to be broadened by means of having elements 136 and 140 coupling so as to shift the high band frequency resonance at a desired range. Further broadbanding effort may be accomplished by adding one or more parasitic element(s), which in this exemplary embodiment is accomplished using the parasitic PCB 108 for the construction. But other exemplary embodiments include parasitic elements on the same PCB as other radiating elements. The parasitic elements help improve the bandwidth especially for the low band.

FIGS. 8A through 8F illustrate respective radiation patterns (azimuth plane, phi zero degree plane, and phi ninety degree plane) measured for a prototype of the antenna assembly 100 at frequencies of 806 MHz and 1710 MHz. Generally, FIGS. 8A through 8F show that the antenna assembly 100 has good omnidirectional radiation patterns at frequencies of 806 MHz and 1710 MHz.

Figure 9:
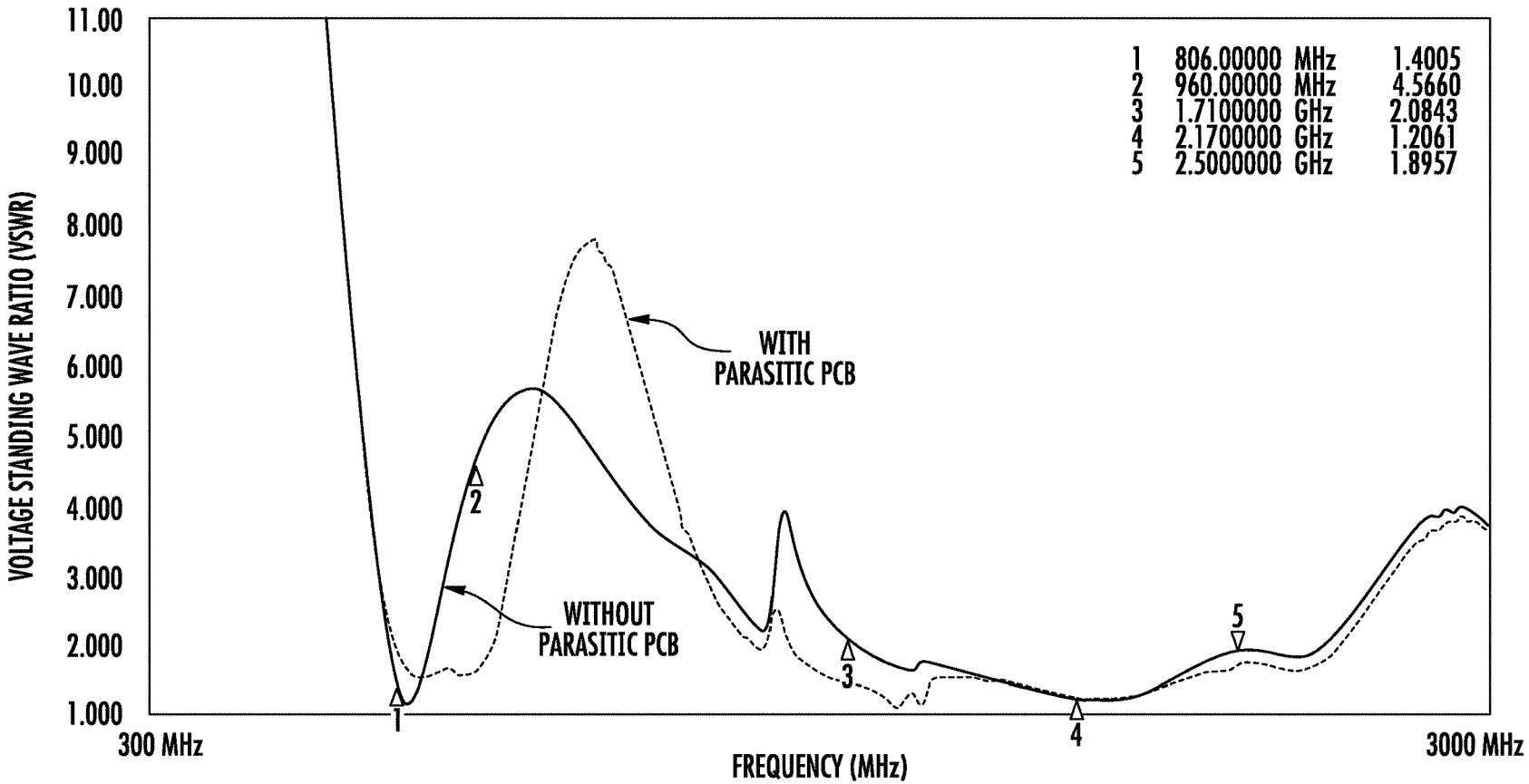
FIG. 9 is an exemplary line graph illustrating voltage standing wave ratio (VSWR) versus frequency in megahertz (MHZ) measured for a prototype of the antenna assembly shown in FIG. 2 with and without a parasitic PCB and with a two feet by two feet square ground plane.

FIG. 9 is an exemplary line graph illustrating voltage standing wave ratio (VSWR) versus frequency in megahertz (MHZ) measured for a prototype of the antenna assembly 100 with and without the coupling of a parasitic PCB. Generally, FIG. 9 shows the improved performance that may be obtained by adding a parasitic PCB.

Figure 10:
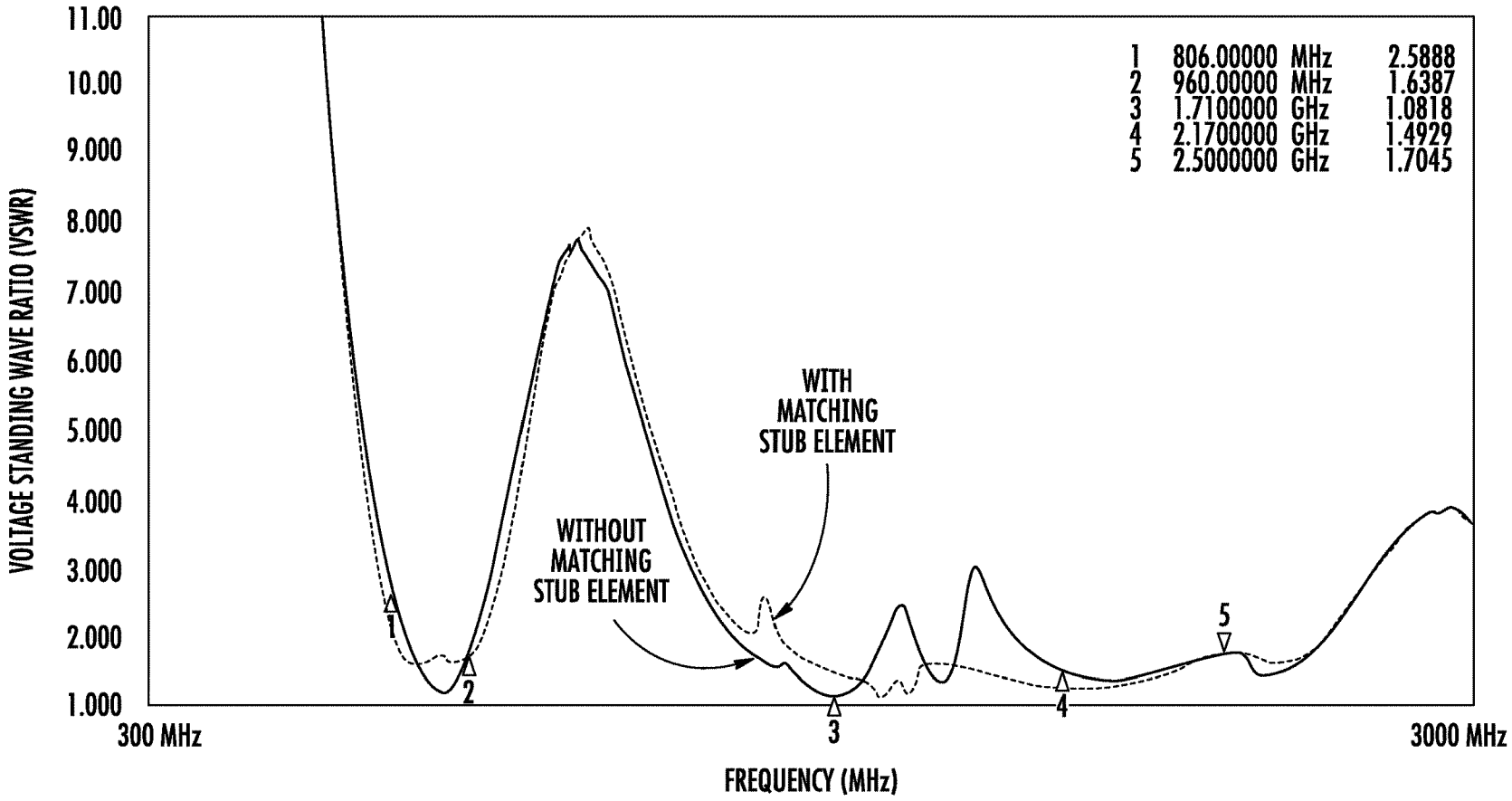
FIG. 10 is an exemplary line graph illustrating voltage standing wave ratio (VSWR) versus frequency in megahertz (MHZ) measured for a prototype of the antenna assembly shown in FIG. 2 with and without a matching stub element and with a two feet by two feet square ground plane.

FIG. 10 is an exemplary line graph illustrating voltage standing wave ratio (VSWR) versus frequency in megahertz (MHZ) measured for a prototype of the antenna assembly 100 with and without the coupling of a high band element with a matching stub element. Generally, FIG. 10 shows the improved performance that may be obtained by adding a matching stub element, including the reduced VSWR spike at high band.

Figure 11:
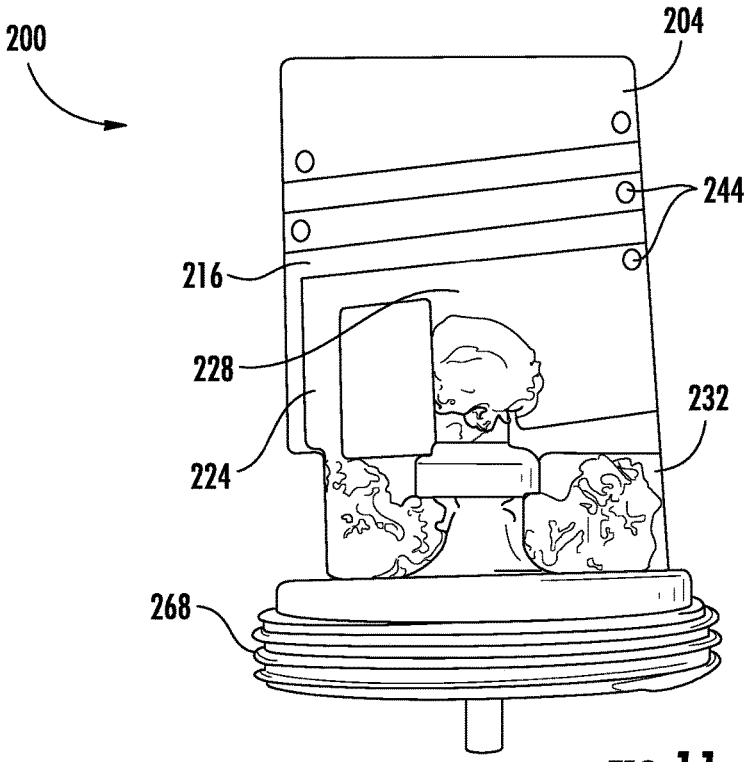
FIG. 11 is a perspective view illustrating an exemplary embodiment of a multiband antenna assembly that is configured to provide at least dual band operation using a single PCB, and illustrating the multiband antenna assembly mounted to an exemplary NMO connector structure.
Figure 12:
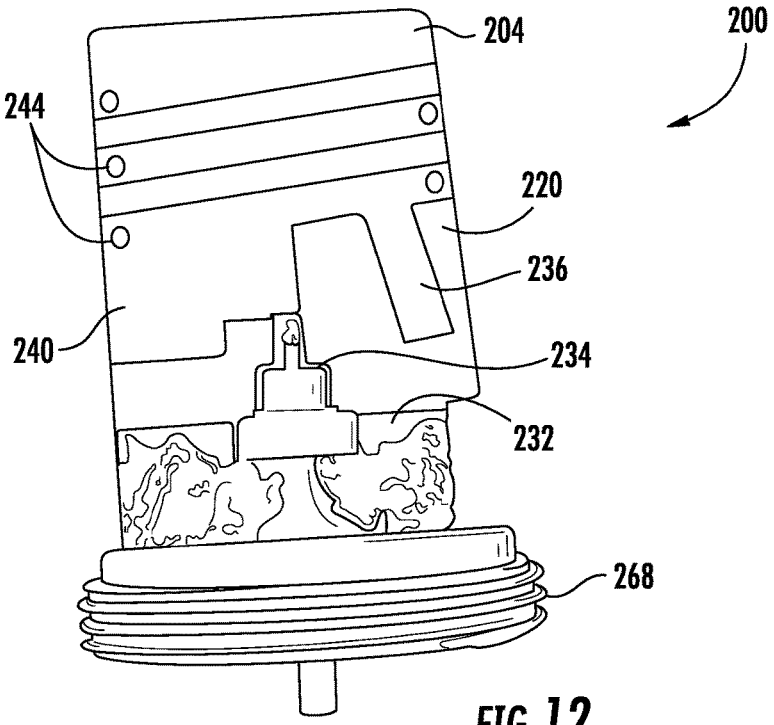
FIG. 12 is a perspective view illustrating the back of the multiband antenna assembly shown in FIG. 11.

FIGS. 11 and 12 illustrate another exemplary embodiment of a multiband antenna assembly 200 embodying one or more aspects of the present disclosure. In this example embodiment, the antenna assembly 200 is configured to provide at least dual band operation using a single PCB 204. FIG. 11 also illustrates the antenna assembly 200 mounted to an exemplary NMO connector structure 268, which may be coupled to an antenna mount in a similar manner as that described above for the antenna assembly 100. Alternative embodiments may include the antenna assembly 200 being used or mounted to different connector structures besides the illustrated NMO connector structure 268.

With continued reference to FIGS. 11 and 12, the PCB 204 includes various elements (e.g., electrically conductive traces, etc.) configured such that the multiband antenna assembly 200 is operable over and covers multiple frequency ranges and bands, including a first frequency range (a low band) from about 821 MHz to about 896 MHz and a second frequency range (or high band) from about 1850 MHz to about 2170 MHz.

The PCB 204 is a double-sided PCB with elements on its front or first side 216 (FIG. 11) and back or second side 220 (FIG. 12). A shorting or shorted element 224, a feed element 228, and a portion (e.g., one or more grounding taps or tabs, etc.) of the PCB ground 232 are disposed along or on the front side 216 of the PCB 204. A stub element 236, a high band radiating element 240, and a portion of the PCB ground 232 are disposed along or on the back side 220 of the PCB 204.

In this exemplary embodiment, the feed element 228 comprises a relatively broad or wide trace feed, which helps broaden the bandwidth of the antenna assembly 200 especially for high band (e.g., 1850 MHz to 2170 MHz, etc.). The feed element 228 is electrically connected (e.g., soldered, etc.) to a contact or a pin of a spring contact assembly 234 (e.g., spring-loaded center feeding or pogo pin, etc.).

The PCB 204 also includes plated thru holes or vias 244 extending from the front side 216 to the back side 220. The plated thru holes or vias 244 may be used to electrically (e.g., directly or galvanically, etc.) connect elements on opposite sides of the PCB 204. For example, the feed element 228 and high band radiating element 240 on the respective PCB's front and back sides 216, 220 may be electrically connected by a plated thru hole or via 244.

In this exemplary embodiment, the distance between the feed element 228 and the shorting element 224 is part of the matching factor for the multiband antenna assembly 200. This, in turn, will help improve the voltage standing wave ratio level overall.

The inventors hereof have observed that there is a spike in the VSWR that will limit the bandwidth especially for the high band. Accordingly, the inventors have configured the matching stub element 236 (FIG. 12) such that coupling of the stub element 236 with the high band radiating element 240 helps cancel out or at least reduce the spike of the VSWR, see, for example, FIG. 13. This, in turn, helps create a larger bandwidth of the high band.

In this exemplary embodiment, the design of the multiband antenna assembly 200 is generally based on a monopole antenna with a shorting or shorted trace and with matching elements printed on a board without the need of or requiring any lump components like a leaded capacitor, an air wound inductor, or a bended metal strip. This exemplary embodiment of the multiband antenna assembly 200 may provide one or more (but not necessarily any or all) of the following advantages over some existing multiband antenna assemblies for vehicular applications, machine to machine equipment, in-building applications, etc. For example, this exemplary embodiment includes stub matching, which helps broaden bandwidth. Matching lump components are not required for this exemplary embodiment, which may allow for more consistent radio frequency (RF) performance and allow for improved efficiency. Eliminating matching lump components may also facilitate the manufacturing process by eliminating the need to manually tune matching lump components in production thereby shortening cycle time.

Figure 13:
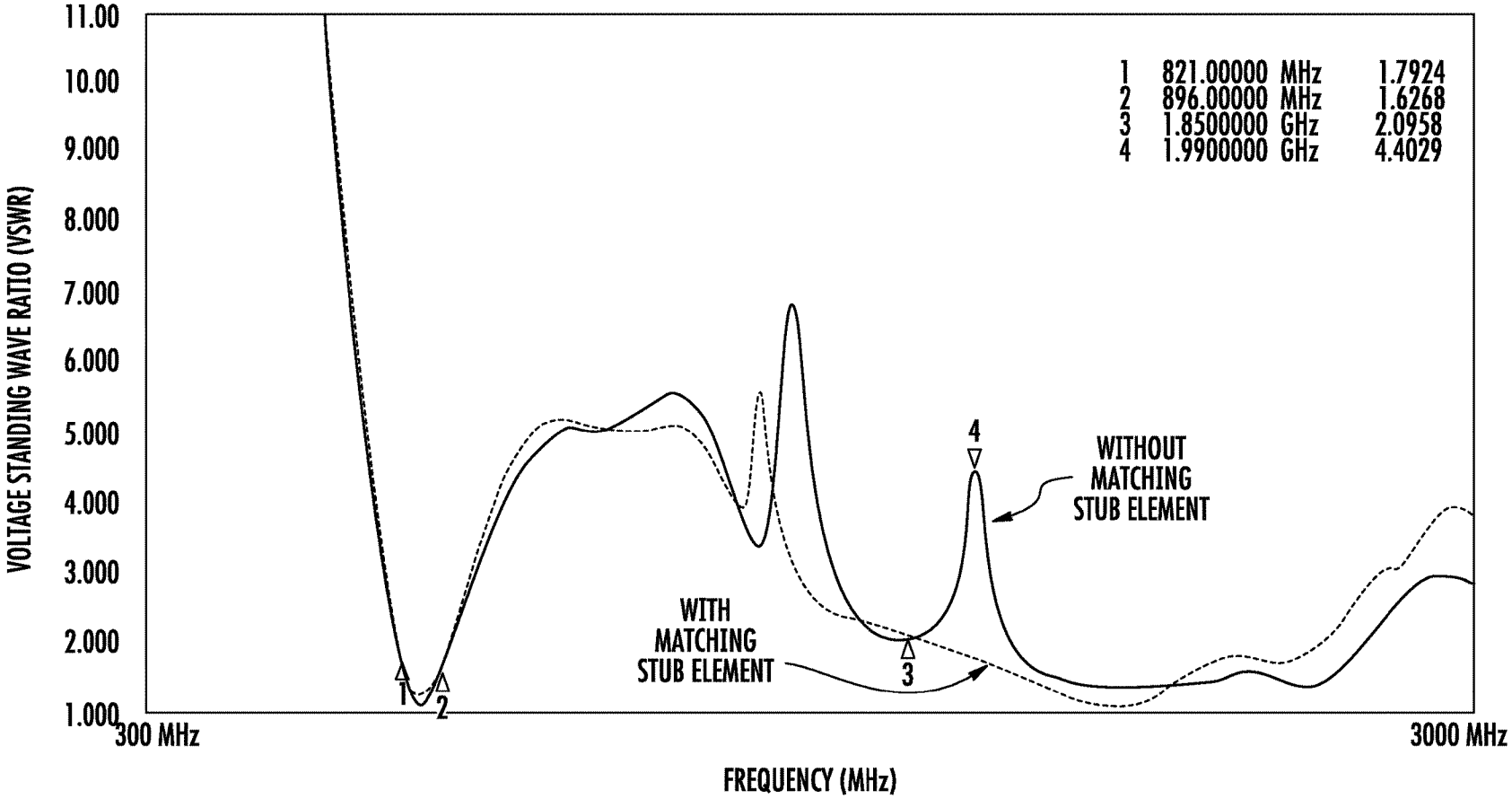
FIG. 13 is an exemplary line graph illustrating voltage standing wave ratio (VSWR) versus frequency in megahertz (MHZ) measured for a prototype of the antenna assembly shown in FIG. 11 with and without a matching stub element and with a two feet by two feet square ground plane.
Figure 14:
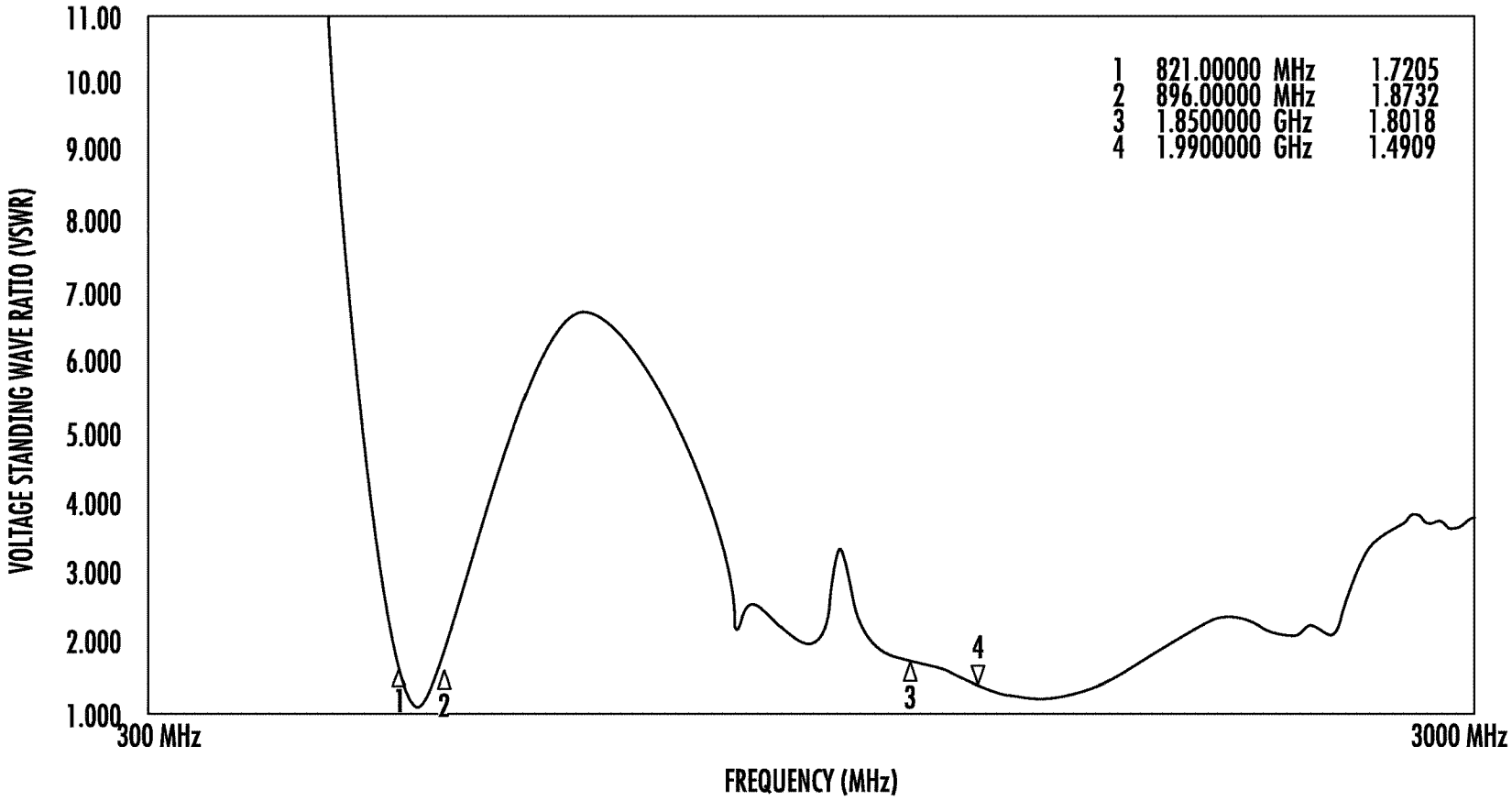
FIG. 14 is an exemplary line graph illustrating voltage standing wave ratio (VSWR) versus frequency in megahertz (MHZ) measured for a prototype of the antenna assembly shown in FIG. 11 with a two feet by two feet square ground plane.
Figure 15A:
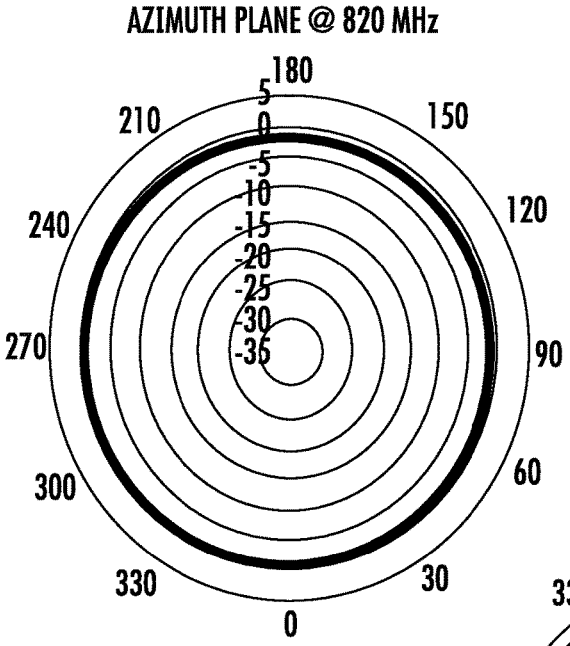
FIGS. 15A through 15F illustrate respective radiation patterns (azimuth plane, phi zero degree plane, and phi ninety degree plane) measured for a prototype of the antenna assembly shown in FIG. 11 at frequencies of 820 MHz and 1850 MHz with a round ground plane with a 70 centimeter diameter.
Figure 15B:
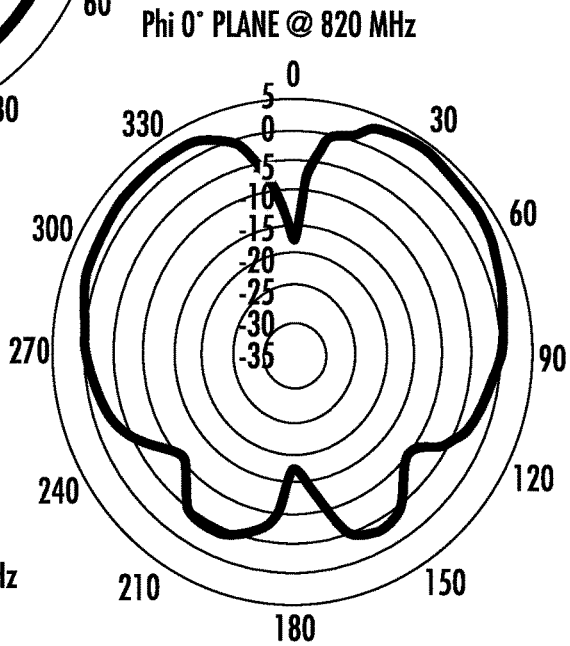
Figure 15C:
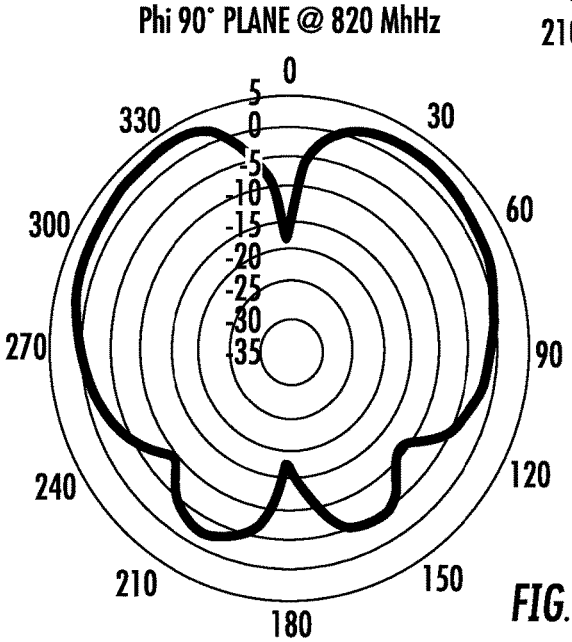
Figure 15D:
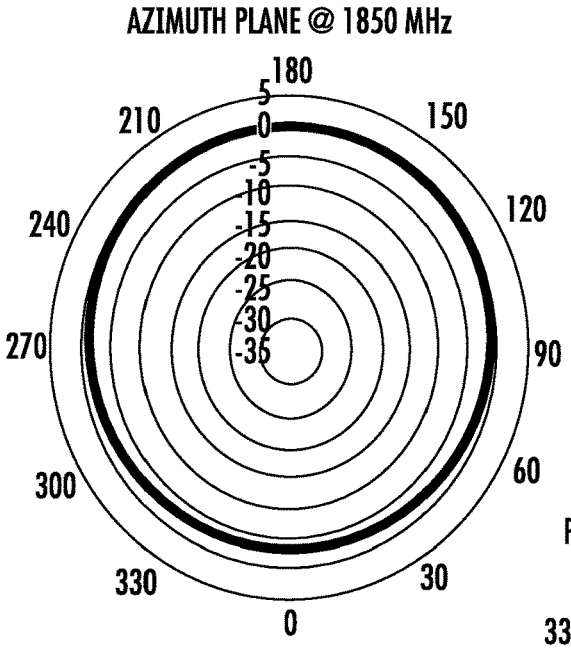
Figure 15E:
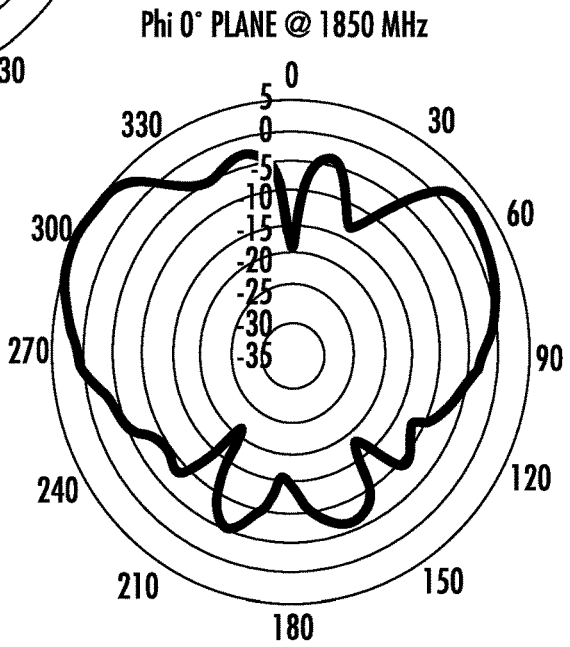
Figure 15F:
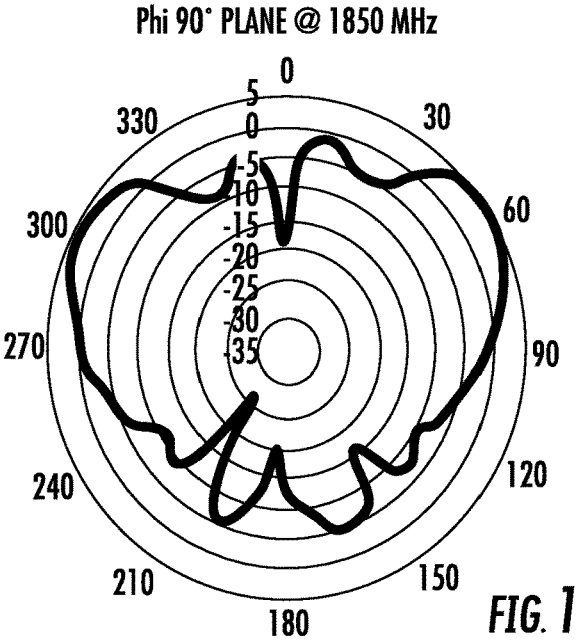

FIGS. 13 through 15 provide analysis results measured for a prototype of the antenna assembly 200 shown in FIGS. 11 and 12. These analysis results shown in FIGS. 13 through 15 are provided only for purposes of illustration and not for purposes of limitation.

More specifically, FIG. 13 is an exemplary line graph illustrating voltage standing wave ratio (VSWR) versus frequency in megahertz (MHZ) measured for a prototype of the antenna assembly 200 with and without a matching stub element. Generally, FIG. 13 shows the improved performance that may be obtained by adding the matching stub element, including the reduced VSWR spike at high band.

FIG. 14 is an exemplary line graph illustrating voltage standing wave ratio (VSWR) versus frequency in megahertz (MHZ) measured for a prototype of the antenna assembly 200 with a two feet by two feet square ground plane. Generally, FIG. 14 shows that this antenna assembly 200 has a relatively good VSWR of less than two for frequencies within a first frequency range (or low band) from about 821 MHz to about 896 MHz and within a second frequency range (or high band) from about 1850 MHz to about 2170 MHz.

The whole trace provides both the low band and high band. But both bands may not be in the right frequency ratio and may be too narrow. The number of turns of the planar helical affects the frequency ratio, which may need to be fine-tuned. And, the bands may need to be broadened by means of having elements 236 and 240 coupling so as to shift the high band frequency resonance at a desired range.

FIGS. 15A through 15F illustrate respective radiation patterns (azimuth plane, phi zero degree plane, and phi ninety degree plane) measured for a prototype of the antenna assembly 200 at frequencies of 820 MHz and 1850 MHz. Generally, FIGS. 15A through 15F show that the antenna assembly 200 has good omnidirectional radiation patterns at frequencies of 820 MHz and 1850 MHz.

Figure 16:
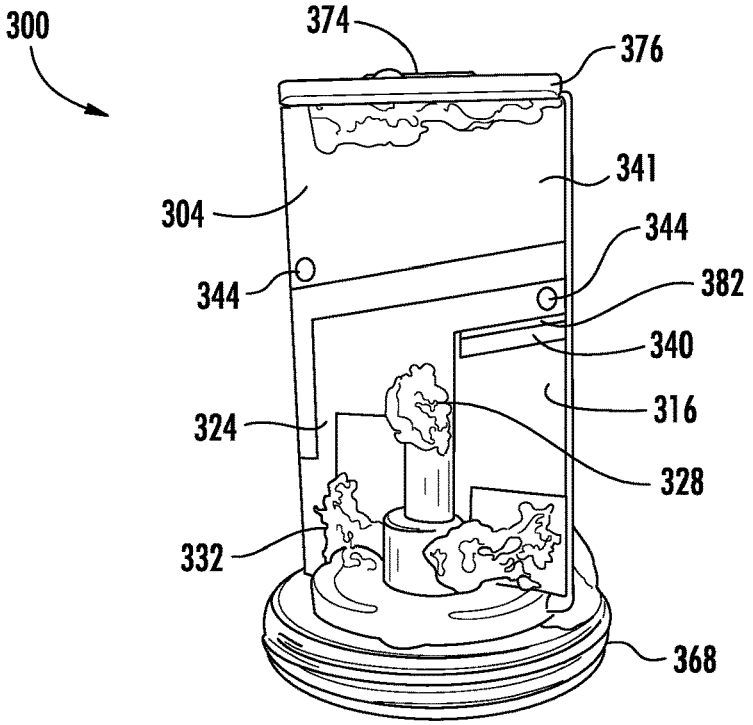
FIG. 16 is a perspective view illustrating an exemplary embodiment of a multiband antenna assembly that includes a PCB and a top loaded conductor, and also illustrating the multiband antenna assembly mounted to an exemplary NMO connector structure.
Figure 17:
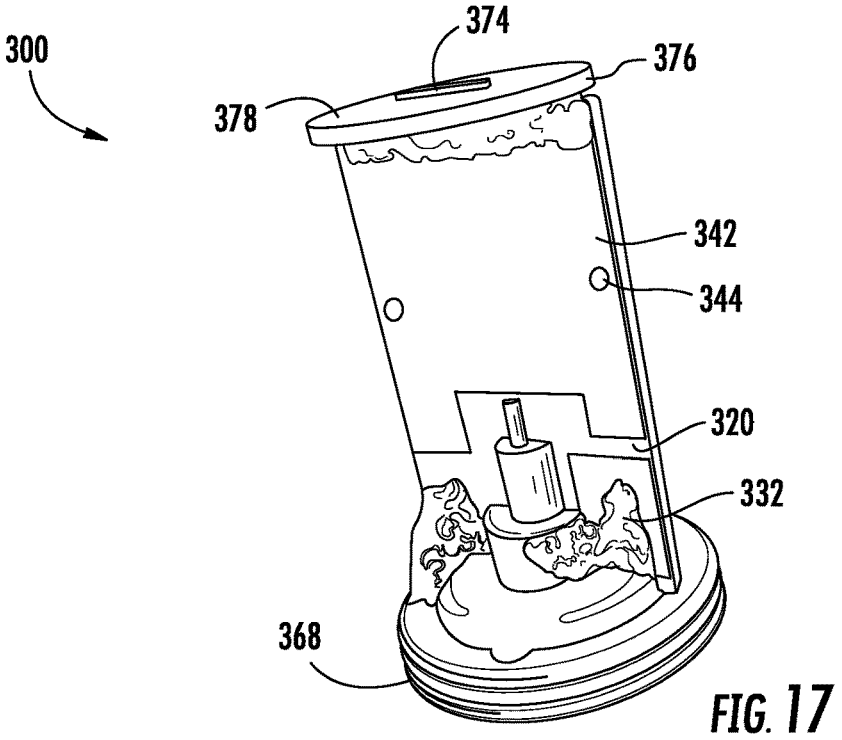
FIG. 17 is a back perspective view of the multiband antenna assembly shown in FIG. 16 and exemplary NMO connector structure.

FIGS. 16 and 17 illustrates another exemplary embodiment of a multiband antenna assembly 300 embodying one or more aspects of the present disclosure. In this example embodiment, the antenna assembly 300 is configured to provide at least dual band operation using a PCB 304 with a top loaded conductor or element 374. FIGS. 16 and 17 also illustrate the antenna assembly 300 mounted to an exemplary NMO connector structure 368, which may be coupled to an antenna mount in a similar manner as that described above for the antenna assembly 100. Alternative embodiments may include the antenna assembly 300 being used or mounted to different connector structures besides the illustrated NMO connector structure 368.

The PCB 304 includes various elements (e.g., electrically conductive traces, etc.) configured such that the multiband antenna assembly 300 is operable over and covers multiple frequency ranges and bands. The antenna's operational frequency ranges and bands will depend upon its PCB radiator structure, which may comprise one of the alternative PCB radiator structures shown in FIG. 17, 19, or 20 that are tuned for different operating frequency ranges.

Figure 18:
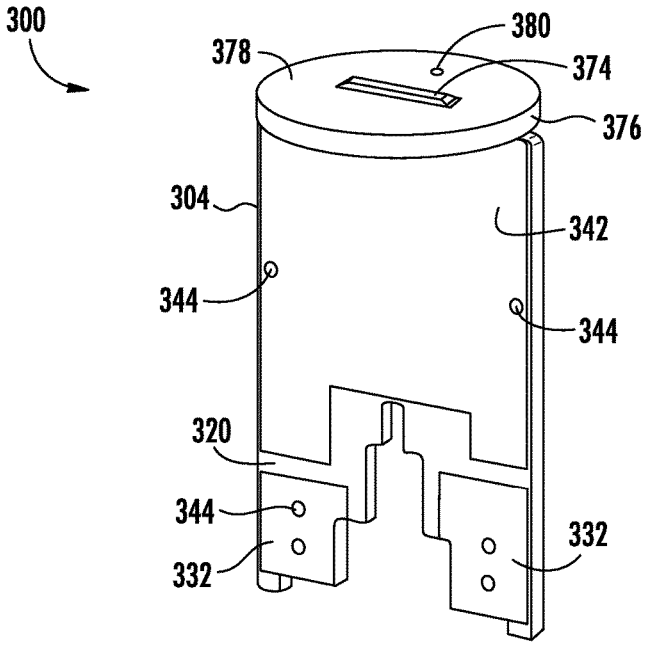
FIG. 18 is a back view showing the PCB radiator structure and top loaded conductor of the multiband antenna assembly shown in FIG. 17.

With continued reference to FIGS. 16, 17, and 18, the PCB 304 is a double-sided PCB with elements on its front or first side 316 (FIG. 16) and back or second side 320 (FIG. 17). A shorting or shorted element 324, a feed element 328, and a portion (e.g., one or more grounding taps or tabs, etc.) of the PCB ground 332 are disposed along or on the front side 316 of the PCB 304. In addition, a high band radiating element or arm 340 and a first vertical loading element 341 are also disposed along or on the front side 316 of the PCB 304. A second vertical loading element 342 and a portion of the PCB ground 332 are disposed along or on the back side 320 of the PCB 304.

The PCB 304 also includes plated thru holes or vias 344 extending from the front side 316 to the back side 320. The plated thru holes or vias 344 may be used to electrically (e.g., directly or galvanically, etc.) connect elements on opposite sides of the PCB 304. For example, the high band radiating element 340 and second vertical loading element 342 on the respective PCB's front and back sides 316, 320 may be electrically connected by a plated thru hole or via 344. The first and second vertical loading elements 341 and 342 on the respective PCB's front and back sides 316, 320 may also be electrically connected by a plated thru hole or via 344.

In operation, the back vertical loading element 342 loads and couples to the front vertical loading element 342, which helps to broaden the bandwidth of the antenna assembly 300. As shown in FIGS. 16 and 18, one of the portions or grounding tabs of the ground 332 extends higher than the other. This allows parasitic coupling to the back vertical element 342 for high band improvement.

The antenna assembly 300 also includes the top loaded printed disc loaded conductor 378 supported by or coupled to a support member 376, which, in turn, is supported by or coupled to the support member 376. The support member 376 comprises a disc that is coupled (e.g., adhesively attached, etc.) to or along the top edge (e.g., upwardly protruding portion 374, etc.) of the PCB 304.

The top loaded conductor 374 and support member 376 may be made from a wide range of materials. In an exemplary embodiment, the top loaded conductor 374 comprises metal, although other electrically-conductive materials may be used. The support member 376 may comprise a generally round or circular double-sided PCB depending on radome form factor and having electrically-conductive elements 378 on its top and bottom sides, with one or more plated thru holes or vias 380 extending between the top and bottom sides of the support member 376. The plated thru holes or vias 380 may be used to electrically (e.g., directly or galvanically, etc.) connect the elements 378 on opposite sides of the support member 376. Alternative embodiments may include top loaded conductors and/or support members configured differently (e.g., shaped differently, made from other electrically conductive materials, etc.).

The inventors hereof have observed that there is a spike in the VSWR that will limit the bandwidth especially for the high band. Accordingly, the inventors have configured the top loaded conductor 374 and support member 376 (e.g., elements 378 on the top and bottom sides and plated thru holes or vias 380) to help reduce the spike of the VSWR for the high band and improve the VSWR level. The top loaded conductor 374 and support member 376 (e.g., elements 378 on the top and bottom sides and plated thru holes or vias 380) help to broaden the bandwidth for the low band frequency and for the high band frequency.

In this exemplary embodiment, the design of the multiband antenna assembly 300 is generally based on a top disc loaded monopole antenna with a shorting or shorted trace and with vertical loading printed on a board without the need of or requiring any matching lump components like a leaded capacitor, an air wound inductor, or a bended metal strip. The distance between the feed element 328 and the shorting element 324 is part of the matching factor for the multiband antenna assembly 300. The vertical loading (e.g., elements 341 and 342) may operate or act similar to a matching stub (e.g., matching stub 136, etc.). The vertical loading may cover a relatively large area that overlaps the trace along the front side of the PCB 304.

This exemplary embodiment of the multiband antenna assembly 300 may provide one or more (but not necessarily any or all) of the following advantages over some existing multiband antenna assemblies for vehicular applications, machine to machine equipment, in-building applications, etc. For example, this exemplary embodiment includes vertical loading with coupling effect to broaden bandwidth and two sided PCB with top loaded disc with a shorting path, which helps improve VSWR and bandwidth of the antenna assembly. Matching lump components are not used in this exemplary embodiment, which may allow for more consistent radio frequency (RF) performance and allow for improved efficiency. Eliminating matching lump components may also facilitate the manufacturing process by eliminating the need to manually tune matching lump components in production thereby shortening cycle time.

Figure 19:
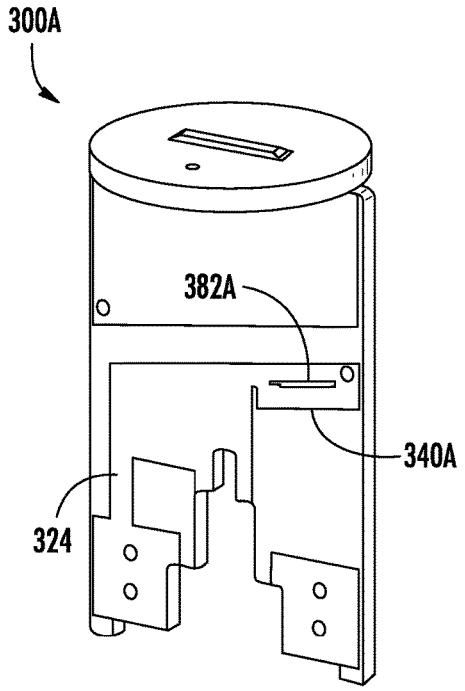
FIGS. 19 and 20 illustrates alternative PCB radiator structure that may instead be used with the multiband antenna assembly shown in FIG. 16.
Figure 20:
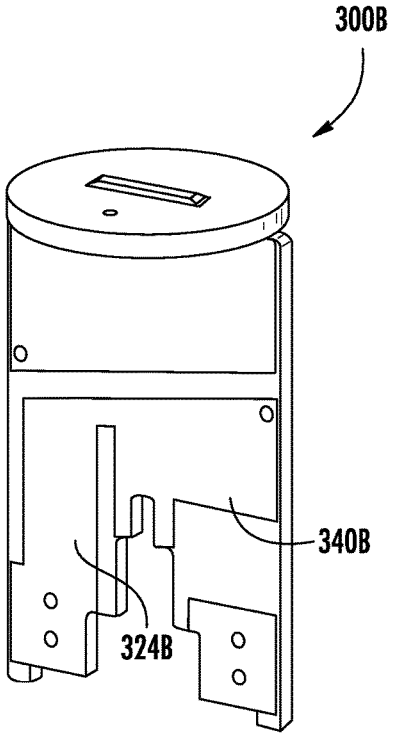

FIGS. 19 and 20 illustrate alternative PCB radiator structures that may be used with the multiband antenna assembly 300 instead of the PCB radiator structure shown in FIG. 16. The differences in the PCB radiator structure may be seen by comparing FIGS. 16, 19, and 20. For example, a comparison of FIG. 16 with FIG. 19 reveals that the antenna assembly 300A (FIG. 19) includes a slot 382A in the high band radiating element 340A that is shorter than the slot 382 in the high band radiating element 340 in the antenna assembly 300 (FIG. 16). Also, the slot 382A is confined within the high band radiating element 340 such that the slot 382A has both ends closed. In comparison, the slot 382 extends to the edge of the high band radiating element 340, and includes open ends. And, the antenna assembly 300B (FIG. 20) does not include any slot in its high band radiating element 340B. Plus, the shorting element 324B (FIG. 20) is broader and wider than the shorting elements 324 (FIG. 16) and 324A (FIG. 19).

The alternative PCB radiator structure shown in FIGS. 16, 19, and 20 is tuned for different operating frequency ranges. For example, the antenna assembly 300 having the PCB radiator structure shown in FIG. 16 may be operable over and cover at least a first frequency range (or low band) from about 746 MHz to about 796 MHz and a second frequency range (or high band) from about 1710 MHz to about 2700 MHz (see FIG. 21). The antenna assembly 300A having the PCB radiator structure shown in FIG. 19 may be operable over and cover at least a first frequency range (or low band) from about 760 MHz to about 870 MHz and a second frequency band (or high band) from about 1710 MHz to about 2700 MHz (see FIG. 23). The antenna assembly 300B having the PCB radiator structure shown in FIG. 20 may be operable over and cover at least a first frequency range (or low band) from about 806 MHz to about 960 MHz and a second frequency range (or high band) from about 1710 MHz to about 2700 MHz (see FIG. 23).

FIGS. 21 through 26 provide analysis results measured for prototypes of antenna assemblies having features shown in FIGS. 16 through 20. These analysis results shown in FIGS. 21 through 26 are provided only for purposes of illustration and not for purposes of limitation.

Figure 21:
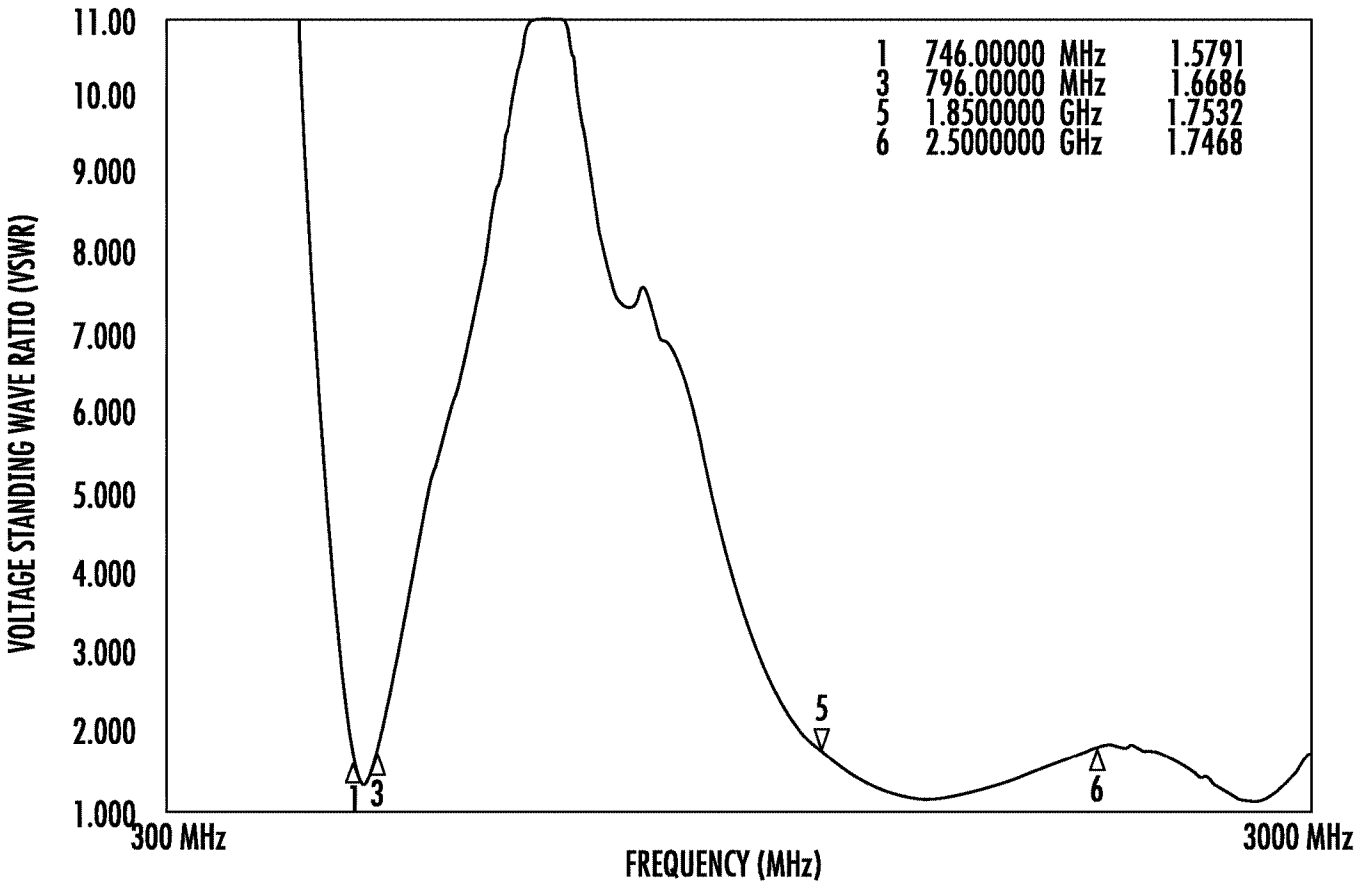
FIG. 21 is an exemplary line graph illustrating voltage standing wave ratio (VSWR) versus frequency in megahertz (MHZ) measured for a prototype of the antenna assembly shown in FIGS. 16 and 17 with a two feet by two feet square ground plane and with NMO connector structure.
Figure 22A:
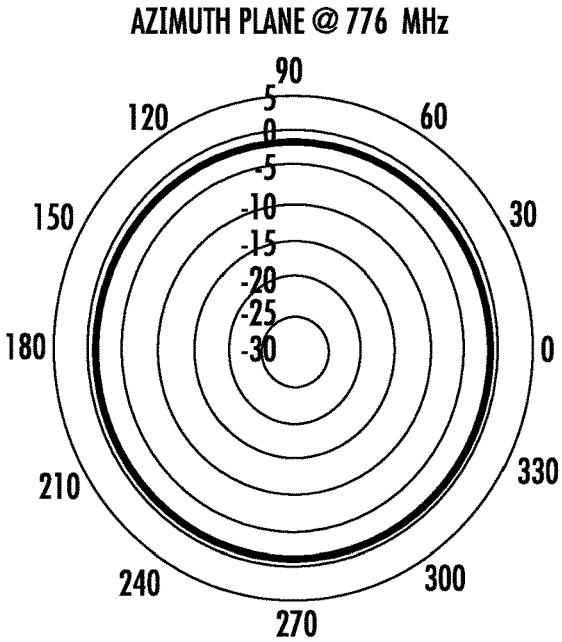
FIGS. 22A through 22F illustrate respective radiation patterns (azimuth plane, phi zero degree plane, and phi ninety degree plane) measured for a prototype of the antenna assembly shown in FIGS. 16 and 17 at frequencies of 776 MHz and 2170 MHz with a round ground plane with a 70 centimeter diameter and with NMO connector structure.
Figure 22B:
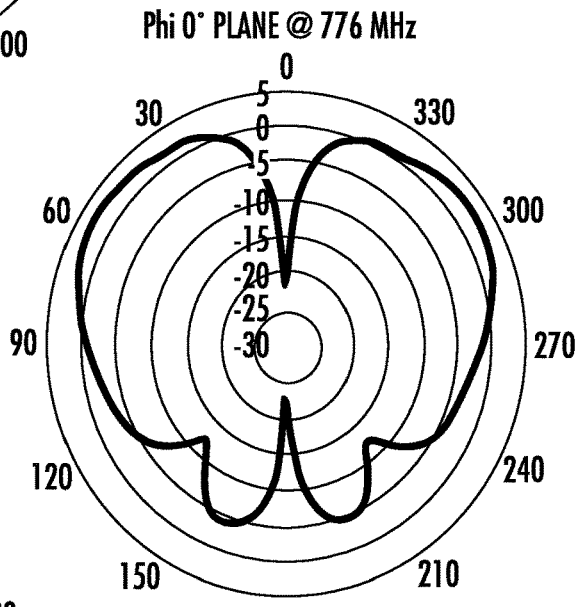
Figure 22C:
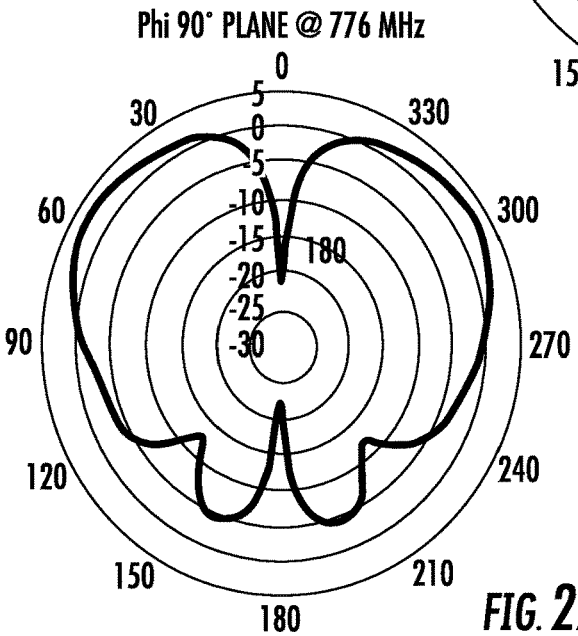
Figure 22D:
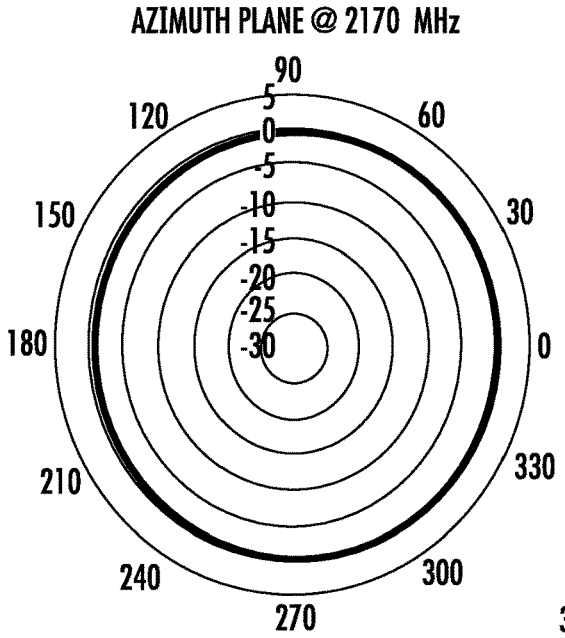
Figure 22E:
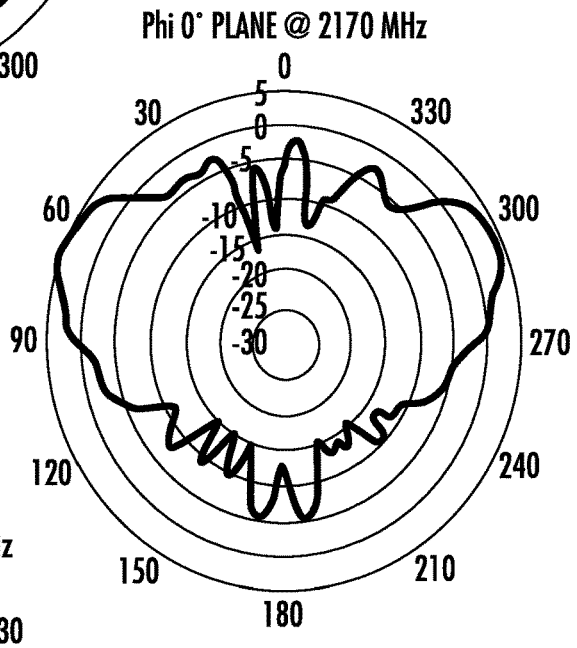
Figure 22F:
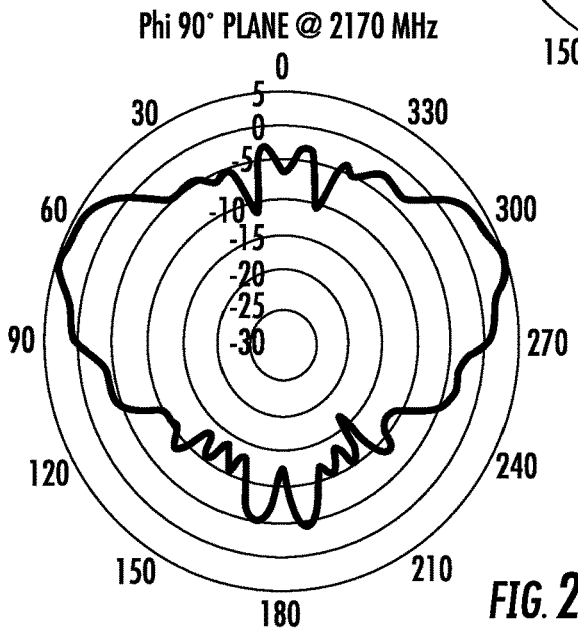

More specifically, FIG. 21 is an exemplary line graph illustrating voltage standing wave ratio (VSWR) versus frequency in megahertz (MHZ) measured for a prototype of the antenna assembly 300 shown in FIGS. 16 and 17. Generally, FIG. 21 shows that this antenna assembly 300 has a relatively good VSWR of less than two for frequencies within a first frequency range (or low band) from about 746 MHz to about 796 MHz and within a second frequency range (or high band) from about 1710 MHz to about 2700 MHz.

FIGS. 22A through 22F illustrate respective radiation patterns (azimuth plane, phi zero degree plane, and phi ninety degree plane) measured for a prototype of the antenna assembly 300 at frequencies of 776 MHz and 2170 MHz. Generally, FIGS. 22A through 22F show that the antenna assembly 300 has good omnidirectional radiation patterns at frequencies of 776 MHz and 2170 MHz.

Figure 23:
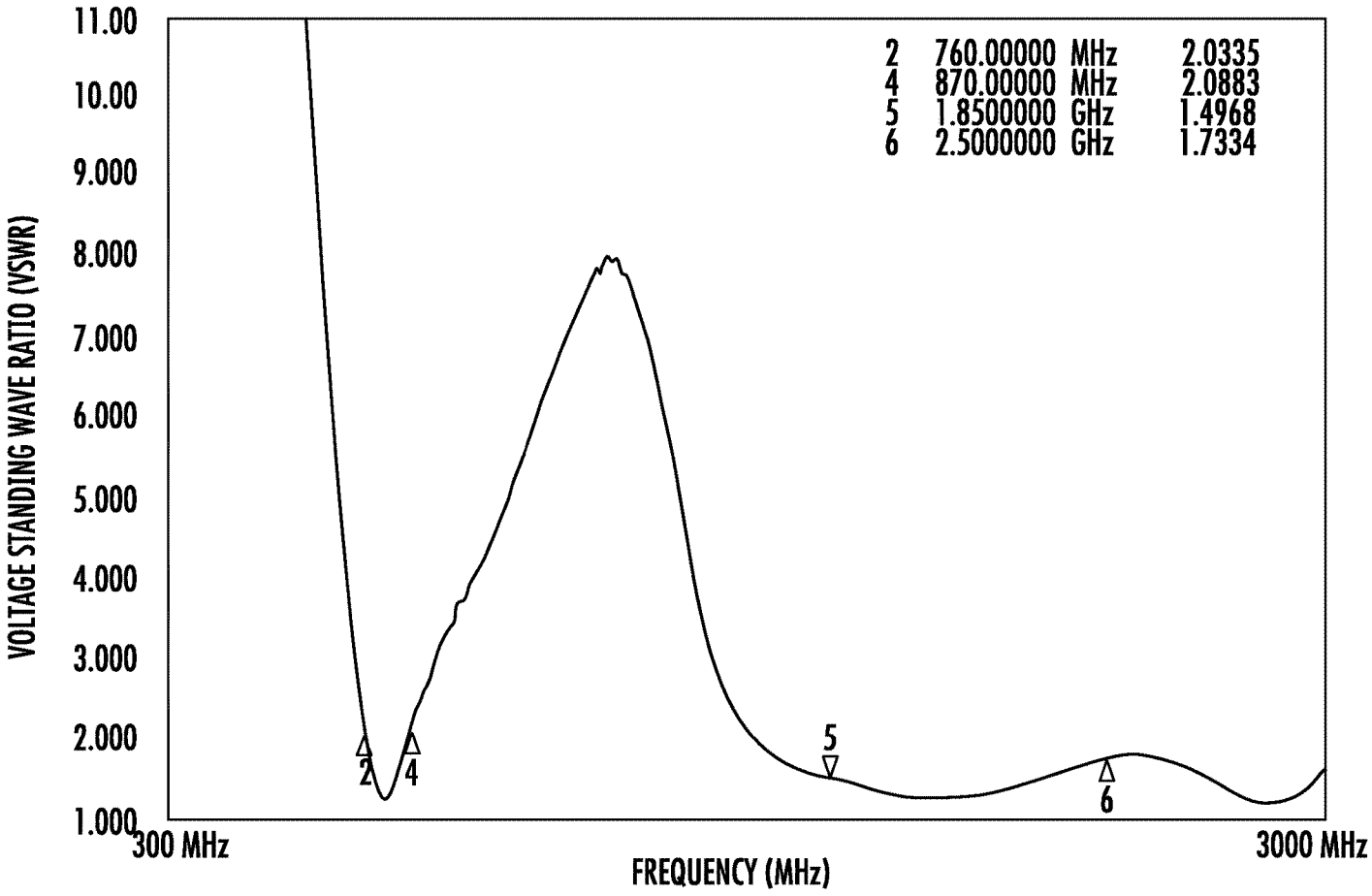
FIG. 23 is an exemplary line graph illustrating voltage standing wave ratio (VSWR) versus frequency in megahertz (MHZ) measured for a prototype antenna assembly having features shown in FIGS. 18 and 19 with a two feet by two feet square ground plane and with NMO connector structure.
Figure 24A:
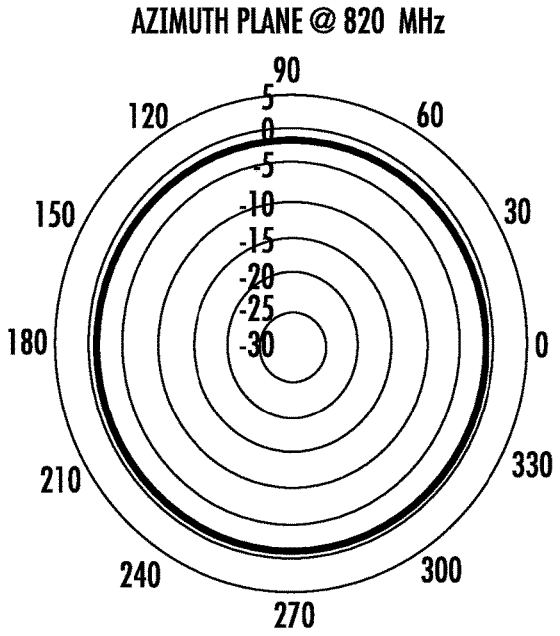
FIGS. 24A through 24F illustrate respective radiation patterns (azimuth plane, phi zero degree plane, and phi ninety degree plane) measured for a prototype antenna assembly having features shown in FIGS. 18 and 19 at frequencies of 820 MHz and 2170 MHz with a round ground plane with a 70 centimeter diameter and with NMO connector structure.
Figure 24B:
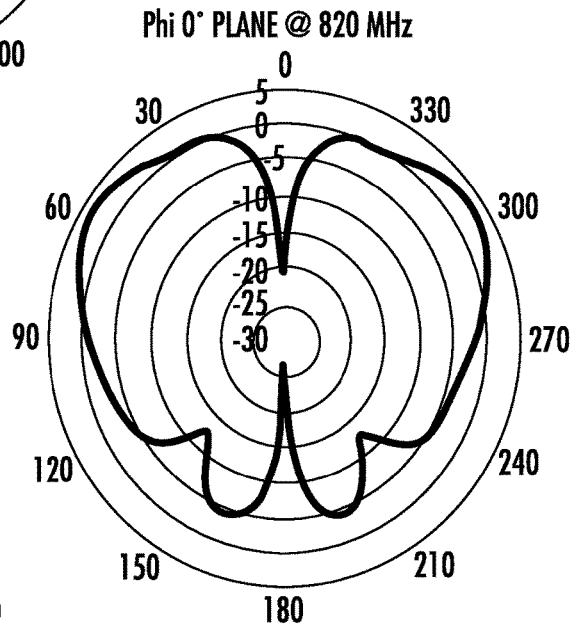
Figure 24C:
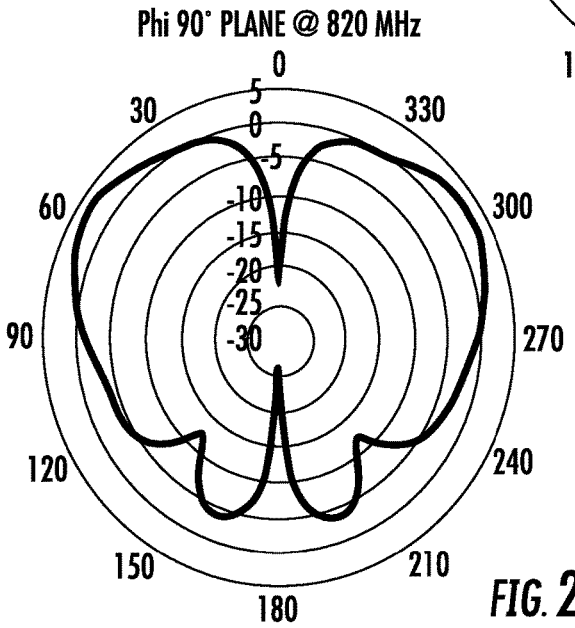
Figure 24D:
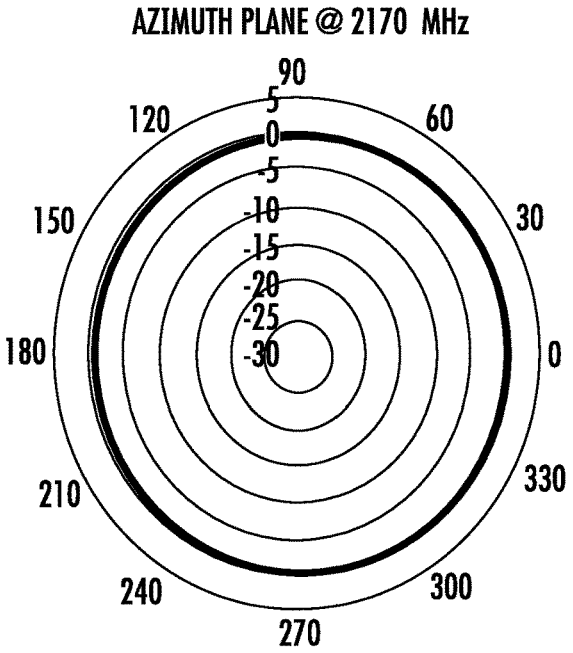
Figure 24E:
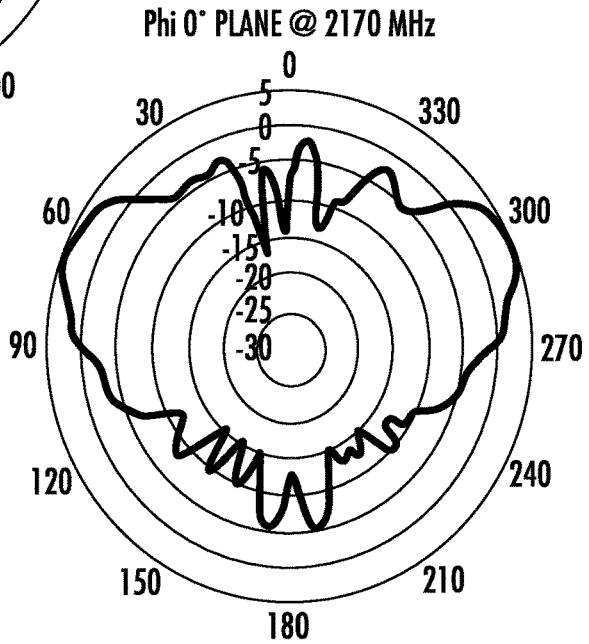
Figure 24F:
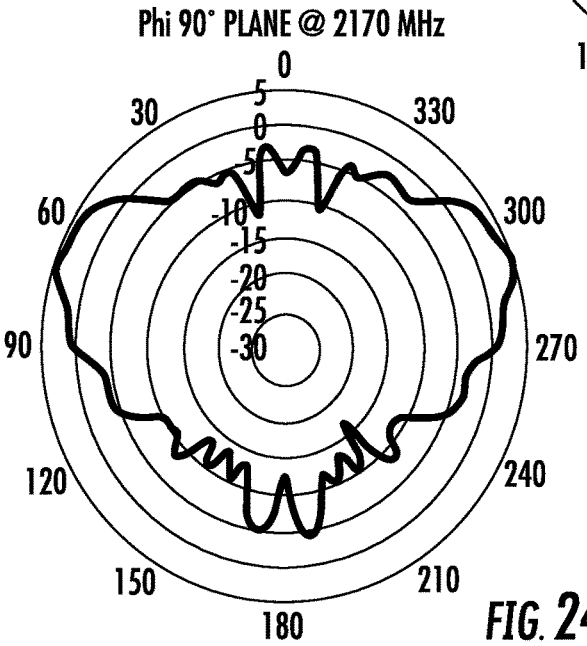

FIG. 23 is an exemplary line graph illustrating voltage standing wave ratio (VSWR) versus frequency in megahertz (MHZ) measured for a prototype antenna assembly having features shown in FIGS. 18 and 19. Generally, FIG. 23 shows that the antenna assembly has a relatively good VSWR of less than two for frequencies within a first frequency range (or low band) from about 760 MHz to about 870 MHz and within a second frequency range (or high band) from about 1710 MHz to about 2700 MHz.

FIGS. 24A through 24F illustrate respective radiation patterns (azimuth plane, phi zero degree plane, and phi ninety degree plane) measured for a prototype antenna assembly having features shown in FIGS. 18 and 19 at frequencies of 820 MHz and 2170 MHz. Generally, FIGS. 24A through 24F show that the antenna assembly has good omnidirectional radiation patterns at frequencies of 820 MHz and 2170 MHz.

Figure 25:
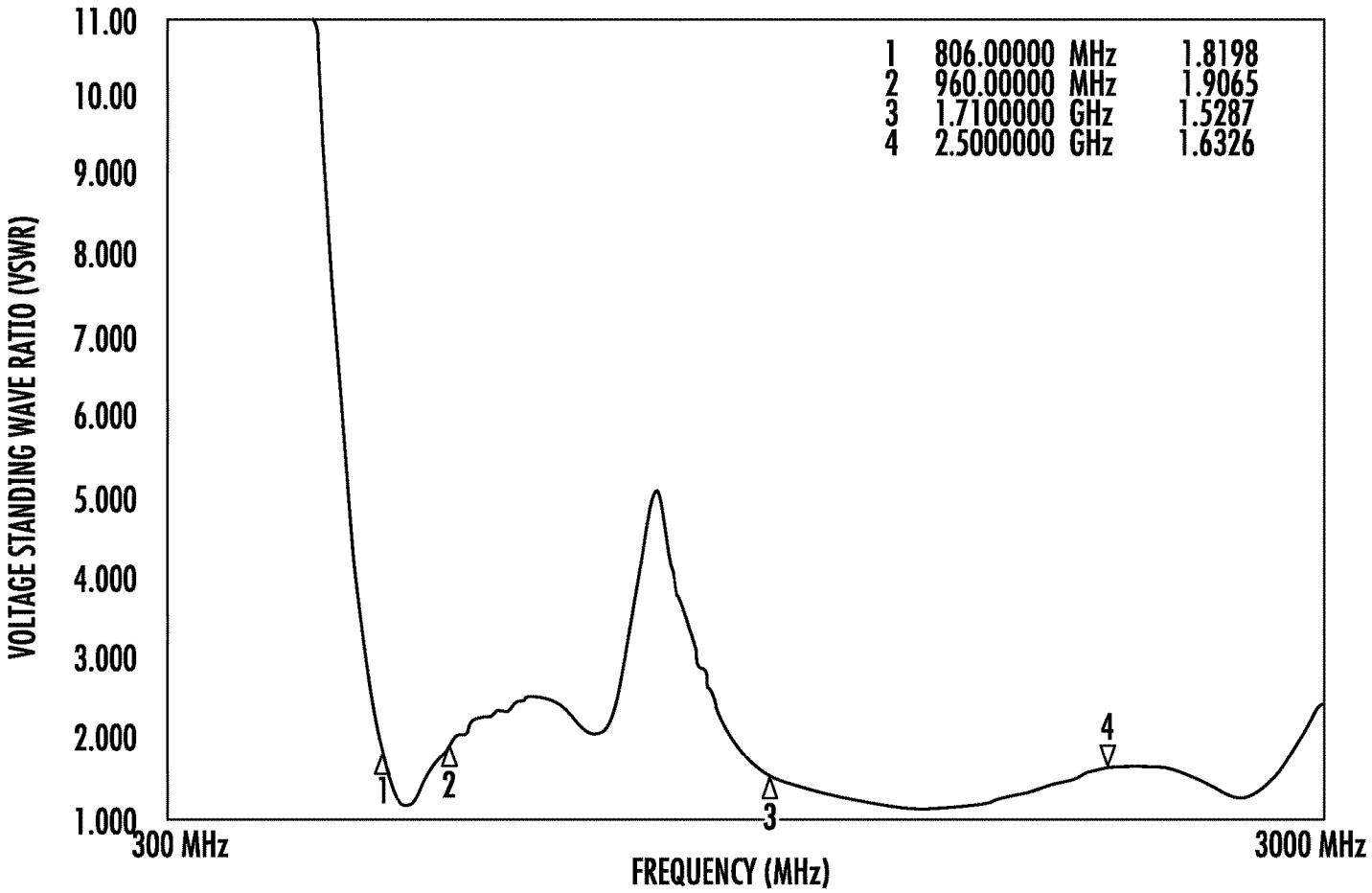
FIG. 25 is an exemplary line graph illustrating voltage standing wave ratio (VSWR) versus frequency in megahertz (MHZ) measured for a prototype antenna assembly having features shown in FIGS. 18 and 20 with a two feet by two feet square ground plane and with NMO connector structure.
Figure 26A:
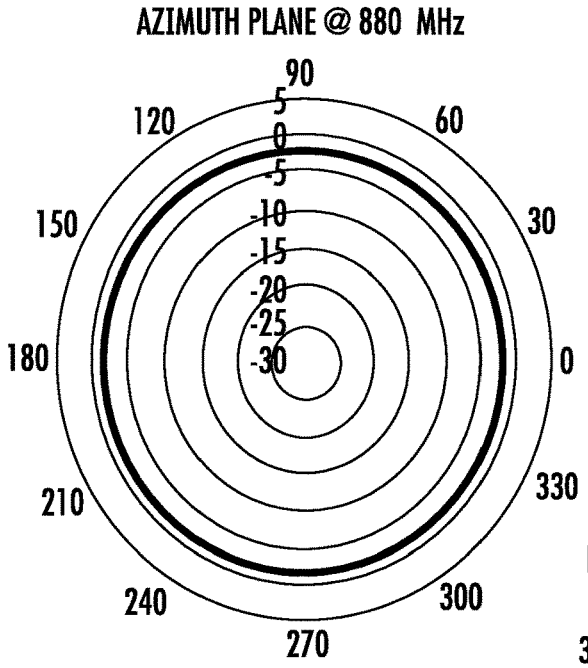
FIGS. 26A through 26F illustrate respective radiation patterns (azimuth plane, phi zero degree plane, and phi ninety degree plane) measured for a prototype antenna assembly having features shown in FIGS. 18 and 20 at frequencies of 880 MHz and 2170 MHz with a round ground plane with a 70 centimeter diameter and with NMO connector structure.
Figure 26B:
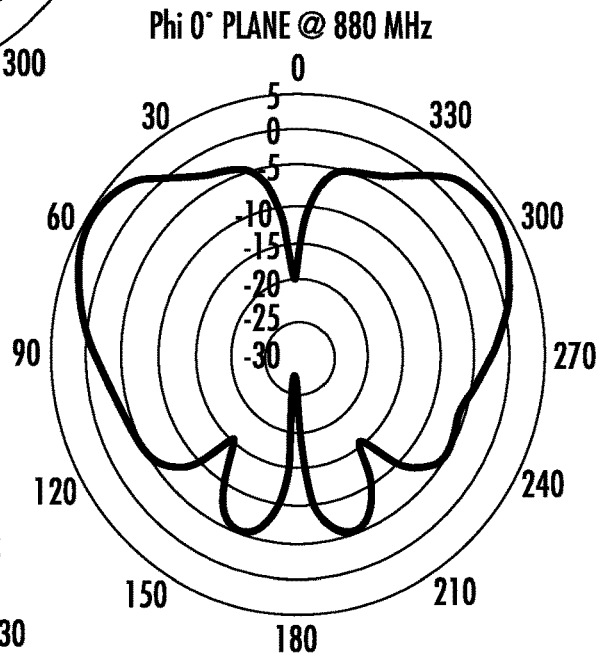
Figure 26C:
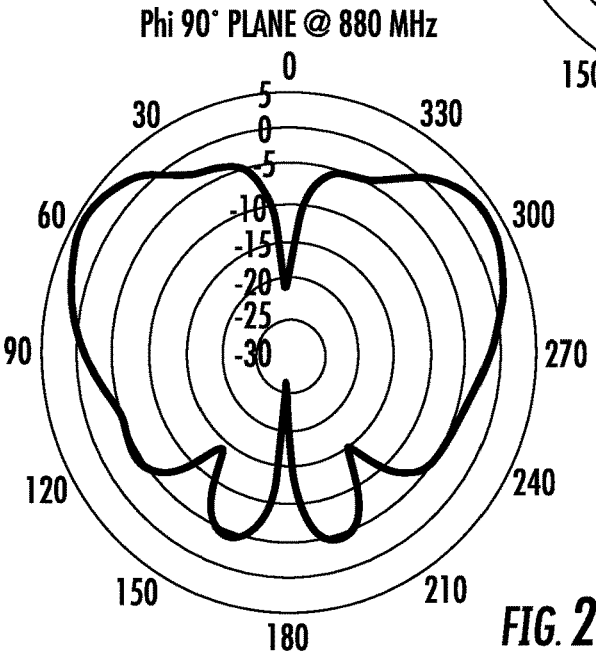
Figure 26D:
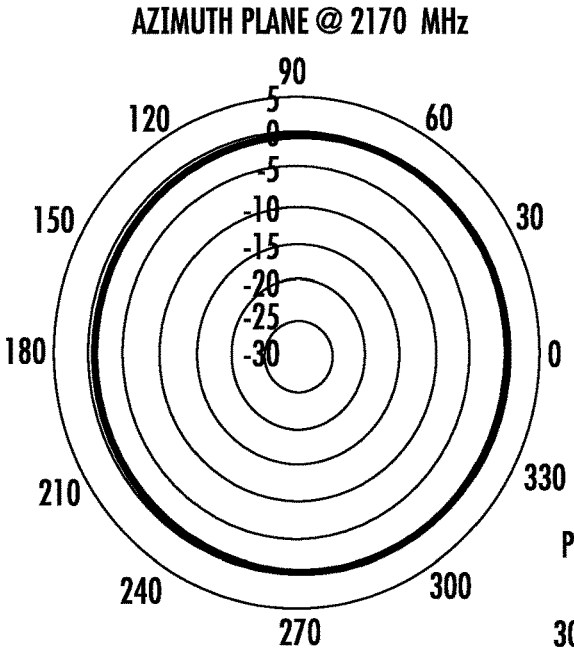
Figure 26E:
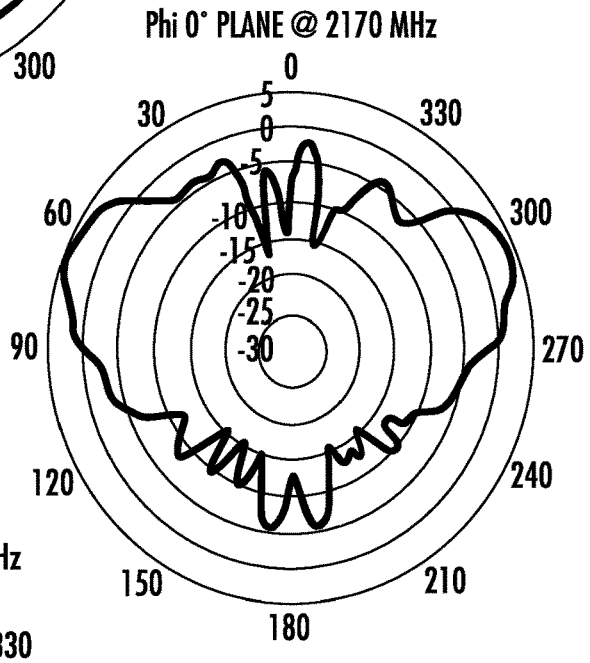
Figure 26F:
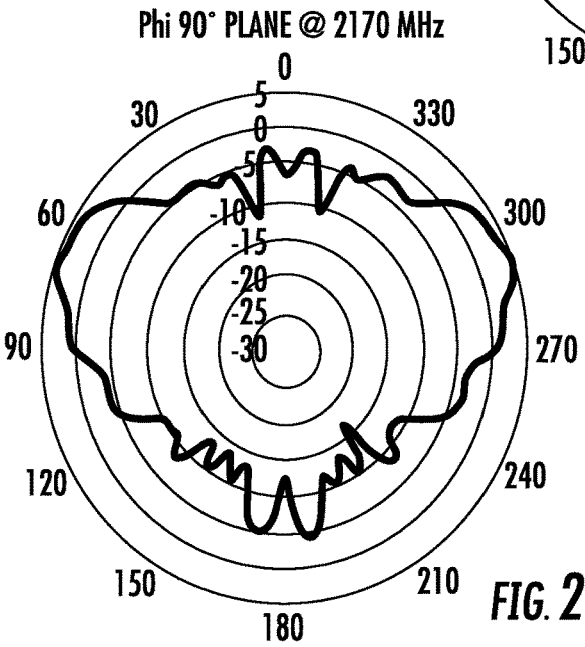

FIG. 25 is an exemplary line graph illustrating voltage standing wave ratio (VSWR) versus frequency in megahertz (MHZ) measured for a prototype antenna assembly having features shown in FIG. 18 and FIG. 20. Generally, FIG. 25 shows that the antenna assembly has a relatively good VSWR of less than two for frequencies within a first frequency range (or low band) from about 806 MHz to about 960 and within a second frequency band (or high band) from about 1710 MHz to about 2700 MHz.

FIGS. 26A through 26F illustrate respective radiation patterns (azimuth plane, phi zero degree plane, and phi ninety degree plane) measured for the antenna assembly having features shown in FIG. 18 and FIG. 20 at frequencies of 880 MHz and 2170 MHz. Generally, FIGS. 26A through 26F show that the antenna assembly has good omnidirectional radiation patterns at frequencies of 820 MHz and 2170 MHz.

FIG. 27 illustrates another exemplary embodiment of a multiband antenna assembly 400 embodying one or more aspects of the present disclosure. In this example embodiment, the antenna assembly 400 is configured to provide at least dual band operation using a PCB 404 and spring fingers 484 (broadly, contact elements) that electrically contact a top loaded portion 486 of a metal cylinder 488 (broadly, a top loaded conductor) when assembled within the radome 412.

FIG. 27 also illustrates the PCB 404 mounted to an exemplary NMO connector structure 468, which may be coupled to an antenna mount in a similar manner as that described above for the antenna assembly 100. Alternative embodiments may include the antenna assembly 400 being used or mounted to different connector structures besides the illustrated NMO connector structure 468.

The PCB 404 includes various elements (e.g., electrically conductive traces, etc.) configured such that the multiband antenna assembly 400 is operable over and covers multiple frequency ranges and bands. The antenna's operational frequency ranges and bands will depend upon its PCB radiator structure, which may comprise one of the alternative PCB radiator structures shown in FIGS. 29, 30, 31, and 32 that are tuned for different operating frequency ranges.

With continued reference to FIG. 27, the PCB 404 is a double-sided PCB with elements on its front or first side 416 (FIG. 27) and back or second side 420 (FIG. 29). A shorting or shorted element 424, a feed element or feedpoint 428, and a portion (e.g., one or more grounding taps or tabs, etc.) of the PCB ground 432 are disposed along or on the front side 416 of the PCB 404. In addition, a high band radiating element or arm 440 and an element 441 (e.g., a radiating trace, etc.) are also disposed along or on the front side 416 of the PCB 404. The radiating trace element 441 is electrically connected (e.g., directly or galvanically, soldered, etc.) to the spring fingers 484.

As shown in FIG. 29, an element 442 (e.g., a radiating trace, etc.) and a portion of the PCB ground 432 are disposed along or on the back side 420 of the PCB 404. First, second, and third elements 443, 445, 447 (e.g., electrically-conductive traces, etc.) are also on or disposed along the back side 420 of the PCB 404.

In this exemplary embodiment, the elements 441 and 442 are radiating traces that provide electrical length to the antenna. Due to a low profile characteristic for ultra high frequency range, electrical length of the antenna may not be able to provide a sufficient low enough profile. The added elements 441 and 442 provide additional electrical length as well as the elements 484 and 486, which play an important role to enhance the bandwidth of the antenna.

The PCB 404 also includes plated thru holes or vias 444 extending from the front side 416 to the back side 420. The plated thru holes or vias 444 may be used to electrically (e.g., directly or galvanically, etc.) connect elements on opposite sides of the PCB 404. For example, plated thru holes or vias 444 are used to electrically connect traces on the PCB's front and back sides 416 and 420 as shown in FIGS. 27 and 29.

Figure 28:
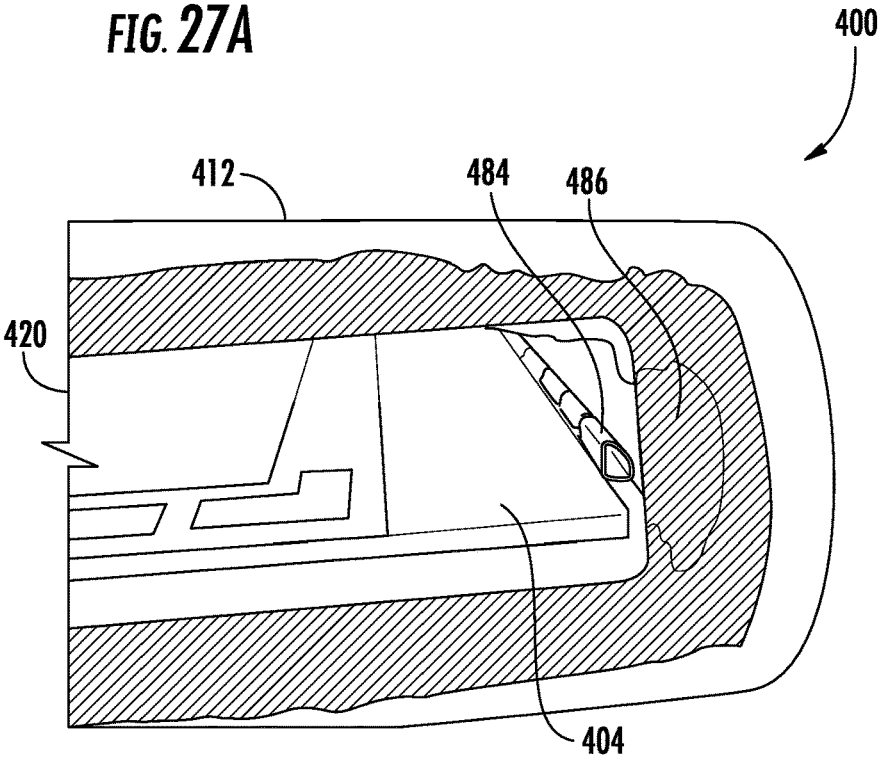
FIG. 28 is a cross-sectional view of the multiband antenna assembly and radome shown in FIG. 27, and illustrating the exemplary manner by which the spring fingers electrically contact the metal at the top of the radome.

FIG. 28 illustrates the exemplary manner by which the spring fingers 484 electrically connect the antenna PCB 404 with the top loaded portion 486 of the metal cylinder 488. This electrical connection helps to broaden the bandwidth of the antenna assembly 400.

The spring fingers 484 may be defined or comprise part of a slotted shielding strip or finger gasket that is soldered to the PCB 404. The finger gasket may include an array of slots that define the spring fingers 484 between adjacent pairs of the slots. The spring fingers 484 may be configured to be resiliently flexible such that when compressively sandwiched between the top loaded conductive portion 486 and the PCB 404, the spring fingers 484 are able to flex or compress downwardly towards the PCB 404. This, in turn, helps establish and maintain a good electrical connection between the top loaded conductive portion 486 and PCB 404 by the spring fingers 484.

In an exemplary embodiment, the spring fingers 484 are provided by or part of a fingerstock gasket from Laird Technologies, Inc. In this exemplary embodiment, the spring fingers 484 provide electrical contact, which is wide enough to have good loading to the antenna before further loading by the top loaded portion 486 of the metal cylinder 488. Alternative embodiments may include other means for providing the electrical contact besides spring fingers of fingerstock gaskets. For example, another exemplary embodiment may include multiple pogo pins to establish and maintain a good electrical connection between the top loaded conductive portion 486 and PCB 404. In a further exemplary embodiment, the PCB 404 and top loaded conductive portion 486 may be directly soldered together with the solder establishing the electrical contact therebetween, for example, if the top loaded portion 486 is not molded together with the radome 412.

A wide range of electrically-conductive materials, preferably resiliently flexible, may be used for the spring fingers 484, such as sheet metal, beryllium copper alloy (e.g., beryllium copper alloy 25, etc.), stainless steel, phosphor bronze, copper-clad steel, brass, monel, aluminum, steel, nickel silver, other beryllium copper alloys, among others. Furthermore, the material can optionally be pre-plated or post-plated for galvanic compatibility with the surface on which it is intended to be mounted.

In this example embodiment, the top loaded conductor comprises a top electrically loaded portion 486 (e.g., thicker metal portion, etc.) at the top of the radome 412 (e.g., a plastic dielectric cylinder, etc.). The metal cylindrical shell 488 is configured such that it provides grounding contact between the antenna and the ground plane when attached to the NMO mount.

The radome 412 may comprise a suitable dielectric material (e.g., plastic, polytetrafluoroethylene (PTFE), etc.). In this exemplary embodiment, the radome 412 comprised dielectric material 490 overmolded onto the metal cylinder shell 488. Accordingly, the radome 412 comprises the dielectric material 490, the metal cylinder 488, and the top loaded metal portion 486 in this illustrated example. But alternative embodiments may include radomes and/or top loaded conductors that are configured differently, such as with different shapes, in different sizes, and/or made from other materials and/or processes.

In this exemplary embodiment, the distance between the feed 428 and the shorting element 424 is part of the matching factor for the multiband antenna assembly 400. This helps improve the VSWR level overall.

This exemplary embodiment of the multiband antenna assembly 400 may provide one or more (but not necessarily any or all) of the following advantages over some existing multiband antenna assemblies for vehicular applications, machine to machine equipment, in-building applications, etc. For example, this exemplary embodiment includes the top loaded conductor (e.g., top loaded metal cylinder, etc.) to broaden bandwidth. This exemplary embodiment also includes resiliently flexible contact elements (e.g., spring fingers of a finger gasket or shielding strip, etc.) for coupling between the top loaded conductor and the PCB. This exemplary embodiment also includes a single PCB with multiple frequency band selection by simple tuning (e.g., removing traces, etc.) on the PCB. The antenna assembly provides DC (direct current) shorted to ground (e.g., by shorting element 424, etc.), which provides electrostatic discharge (ESD) protection. The antenna assembly may provide an additional band for the cellular frequency band. Matching lump components are not used in this exemplary embodiment, which may allow for more consistent radio frequency (RF) performance and allow for improved efficiency. Eliminating matching lump components may also facilitate the manufacturing process by eliminating the need to manually tune matching lump components in production thereby shortening cycle time. In addition, it improves the antenna power handling that may be limited by the lump components selection.

FIGS. 29, 30, 31, and 32 illustrate alternative PCB radiator structures that may be used or provided on the back side of the multiband antenna assembly 400 shown in FIG. 27. The differences in the PCB radiator structure may be seen by comparing FIGS. 29, 30, 31, and 32. For example, the antenna assembly 400A (FIG. 30) does not include the trace 443, which may have been nonexistent or otherwise removed (e.g., cutoff, etc.). The antenna assembly 400B (FIG. 31) does not include trace 443 or 445. The antenna assembly 400B (FIG. 31) does not include trace 443, 445, or 447.

The alternative PCB radiator structure shown in FIGS. 29, 30, 31, and 32 are tuned for different operating frequency ranges. For example, the antenna assembly 400 having the PCB radiator structure shown in FIG. 29 (with all three traces 443, 445, and 447) may be operable over and cover at least a first frequency range (or low band) from about 450 MHz to about 512 MHz and a second frequency range (or high band) from about 1710 MHz to about 2700 MHz (see FIG. 33). The antenna assembly 400A having the PCB radiator structure shown in FIG. 30 (without trace 443) may be operable over and cover at least a first frequency range (or low band) from about 430 MHz to about 490 MHz and a second frequency range (or high band) from about 1710 MHz to about 2700 MHz (see FIG. 35). The antenna assembly 400B having the PCB radiator structure shown in FIG. 31 (without traces 443 and 445) may be operable over and cover at least a first frequency range (or low band) from about 406 MHz to about 440 MHz and a second frequency range (or low band) from about 1710 MHz to about 2700 MHz (see FIG. 36). The antenna assembly 400C having the PCB radiator structure shown in FIG. 32 (without traces 443, 445, and 447) may be operable over and cover at least a first frequency range (or low band) from about 380 MHz to about 410 MHz and a second frequency range (or high band) from about 1850 MHz to about 2700 MHz (see FIG. 37). Accordingly, FIGS. 29 through 32 generally show the flexibility of this antenna design to achieve different frequency bands by cutting off or otherwise removing the traces or portions of the traces from the original traces shown in FIG. 29.

FIGS. 33 through 37 provide analysis results measured for prototypes of antenna assemblies having features shown in FIGS. 27 through 32. These analysis results shown in FIGS. 33 through 37 are provided only for purposes of illustration and not for purposes of limitation.

More specifically, FIG. 33 is an exemplary line graph illustrating voltage standing wave ratio (VSWR) versus frequency in megahertz (MHZ) measured for a prototype antenna assembly having features shown in FIGS. 27 and 29 with a two feet by two feet square ground plane. Generally, FIG. 33 shows that the antenna assembly has a relatively good VSWR of less than two for frequencies within a first frequency range (or low band) from about 450 MHz to about 512 and within a second frequency range (or high band) from about 1710 MHz to about 2700 MHz.

FIGS. 34A through 34I illustrate respective radiation patterns (azimuth plane, phi zero degree plane, and phi ninety degree plane) for a prototype antenna assembly having features shown in FIGS. 27 and 29 measured on a round plane having a seventy centimeter diameter at frequencies of 480 MHz, 1850 MHz, and 2500 MHz. Generally, FIGS. 34A through 34I show that the antenna assembly has good omnidirectional radiation patterns at frequencies of 480 MHz, 1850 MHz, and 2500 MHz.

FIG. 35 is an exemplary line graph illustrating voltage standing wave ratio (VSWR) versus frequency in megahertz (MHZ) measured for a prototype antenna assembly having features shown in FIGS. 27 and 30. Generally, FIG. 36 shows that the antenna assembly has a relatively good VSWR of less than two for frequencies within a first frequency range (or low band) from about 430 MHz to about 490 and within a second frequency (or high band) from about 1710 MHz to about 2700 MHz.

FIG. 36 is an exemplary line graph illustrating voltage standing wave ratio (VSWR) versus frequency in megahertz (MHZ) measured for a prototype antenna assembly having features shown in FIGS. 27 and 31. Generally, FIG. 36 shows that the antenna assembly has a relatively good VSWR of less than two for frequencies within a first frequency range (or low band) from about 406 MHz to about 440 and within a second frequency range (or high band) from about 1710 MHz to about 2700 MHz.

FIG. 37 is an exemplary line graph illustrating voltage standing wave ratio (VSWR) versus frequency in megahertz (MHZ) measured for a prototype antenna assembly having features shown in FIGS. 27 and 32. Generally, FIG. 37 shows that the antenna assembly has a relatively good VSWR of less than two for frequencies within a first frequency range (or low band) from about 380 MHz to about 410 and within a second frequency (or high band) from about 1850 MHz to about 2700 MHz.

FIGS. 38 and 39 illustrate another exemplary embodiment of a multiband antenna assembly 500 embodying one or more aspects of the present disclosure. In this example embodiment, the antenna assembly 500 is configured to provide at least dual band operation using a PCB 504 having various elements (e.g., electrically conductive traces, etc.) thereon configured such that the multiband antenna assembly 500 is operable over and covers multiple frequency ranges and bands. In this exemplary embodiment, the PCB 504 is directly soldered onto an exemplary NMO connector structure or base ring 568, thereby eliminating the need for a grounding pin. The base ring 568 may be coupled to an antenna mount in a similar manner as that described above for the antenna assembly 100. Alternative embodiments may include the antenna assembly 500 being used or mounted to different connector structures besides the illustrated NMO connector structure 568.

In some embodiments, a top loaded conductor or element (e.g., top loaded conductor 374 shown in FIGS. 16 and 17, etc.) may be mounted to the top of the PCB 504 by inserting the protruding top portion of the PCB 504 into a slot of a support member or disk 378, which is supporting the top loaded conductor 374. Other exemplary embodiments may be configured for use without any top loaded conductor. In such other embodiments, the top of the PCB 504 may be flat without the upwardly protruding portion.

The PCB 504 is a double-sided PCB with elements on its front or first side 516 (FIGS. 38 and 40) and on its back or second side 520 (FIGS. 39 and 41). A shorting or shorted element 524, a matching stub element 536, and a portion (e.g., one or more grounding taps or tabs, etc.) of the PCB ground 532 are disposed along or on the front side 516 of the PCB 504. In addition, a high band radiating element or arm 540 and a first vertical loading element 541 are also disposed along or on the front side 516 of the PCB 504.

A main radiator arm or element 542, an extension arm 549, and a parasitic element 550 are disposed along or on the back side 520 of the PCB 504. A feed element 528 and a portion of the PCB ground 532 are also disposed along or on the back side 520 of the PCB 504. The feed element 528 is electrically connected (e.g., soldered, etc.) to a contact or a pin of a spring contact assembly (e.g., spring loaded contact pin or pogo pin, etc.).

The PCB 504 also includes plated thru holes or vias 544 extending from the front side 516 to the back side 520. The plated thru holes or vias 544 may be used to electrically (e.g., directly or galvanically, etc.) connect elements on opposite sides of the PCB 504. For example, the first vertical loading element 541 and main radiator arm 542 on the respective PCB's front and back sides 516, 520 may be electrically connected by a plated thru hole or via 544. The portions of the ground 532 on the PCB's front and back sides 516, 520 may also be electrically connected by plated thru holes or vias 544.

In operation, the main radiator arm 542 is operable to cover a bandwidth from 2.3 GHz to 2.7 GHz. The extension arm 549 couples to ground and is operable for increasing bandwidth of the antenna assembly 500 to cover a bandwidth from 4.9 GHz to 5.15 GHz. The parasitic element 550 is operable for further increasing bandwidth of the antenna assembly 500 to cover the bandwidth from 4.9 GHz to 5.9 GHz. Accordingly, the antenna assembly 500 is operable with and covers frequencies within a first frequency range (or low band) from 2.3 GHz to 2.7 GHz and within a second frequency range (or high band) from 4.9 GHz to 5.9 GHz.

FIGS. 42 through 44 provide analysis results measured for antenna prototypes. These analysis results shown in FIGS. 42 through 44 are provided only for purposes of illustration and not for purposes of limitation.

More specifically, FIG. 42 is an exemplary line graph illustrating voltage standing wave ratio (VSWR) versus frequency in gigahertz (GHz) measured for a prototype of an antenna assembly without the parasitic element 550 before and after adding a short extension arm. As shown by the line representing the VSWR before the addition of a short extension arm, the main radiator arm 542 is operable to cover a bandwidth from 2.3 GHz to 2.7 GHz. A comparison of the two lines reveals that adding a short extension arm to the main radiator arm 542 creates strong resonance around 4.9 GHz.

FIG. 43 is an exemplary line graph illustrating voltage standing wave ratio (VSWR) versus frequency in gigahertz (MHZ) measured for antenna prototypes after lengthening the extension arm 549 and then after adding a parasitic element 550. As shown by FIG. 43, lengthening the extension arm 549 to couple to the ground increases bandwidth to cover a bandwidth from 4.9 GHz to 5.15 GHz. And, adding the parasitic element 550 increases bandwidth to cover a bandwidth form 4.9 GHz to 5.9 GHz. FIG. 44 also shows that this antenna assembly 500 has a relatively good VSWR of less than two for frequencies within a first frequency range (or low band) from 2.3 GHz to 2.7 GHz and within a second frequency range (or high band) from 4.9 GHz to 5.9 GHz.

FIGS. 44A through 44F illustrate respective radiation patterns (azimuth plane, phi zero degree plane, and phi ninety degree plane) measured for a prototype of the antenna assembly 500 shown in FIGS. 38 and 39 at a frequencies of 2.45 GHz and 5.47 GHz. Generally, FIGS. 44A through 44F show that the antenna assembly 500 has good omnidirectional radiation patterns at frequencies of 2.45 GHz and 5.47 GHz.

In this exemplary embodiment, the multiband antenna assembly 500 may be configured for use as a low visibility dual band (e.g., a first bandwidth from 2.3 GHz to 2.7 GHz, a second bandwidth 4.9 GHz to 5.9 GHz (FIG. 43), etc.) vehicular antenna that is mountable to a vehicle (e.g., automobile, etc.) by a NMO connector structure and antenna mount. This exemplary embodiment of the multiband antenna assembly 500 may provide one or more (but not necessarily any or all) of the following advantages over some existing multiband antenna assemblies for vehicular applications, machine to machine equipment, in-building applications, etc. For example, this exemplary embodiment includes the PCB 504 directly soldered onto the base ring 568 (FIGS. 38 and 39), thus eliminating the need to use a grounding pin. Also, matching lump components are not used in this exemplary embodiment. Eliminating the grounding pin and matching lump components reduces the part count as well as providing an ease of manufacturability. This exemplary embodiment may also have a consistent RF performance, an improved radiation pattern for the 2.4 GHz band (FIG. 44A), and a broader bandwidth for lowband as compared with some existing antenna assemblies that have lump components.

The inventors hereof have recognized that a monopole antenna design may have limited antenna application with NMO connectors construction over a relatively large or big ground plane. For example, the configuration of an antenna assembly may need to be changed totally due to its structural difference in order to implement the antenna assembly differently, such as a pig tail type application with a pair of coaxial cables without a direct N-type connector or NMO connector. Additionally, the inventors hereof have recognized that some existing antenna assemblies with pig tail type connectors have limited bandwidth for both low band and high band, and the overall length of the antenna is not sufficient enough especially to fit into a small radome. After recognizing the above, the inventors developed and disclose herein exemplary embodiments of antenna assemblies in which a combination of antenna and connector structure is transformed or reconfigured to a low profile two-dimensional planar structure, which includes connector structure. Advantageously, the low profile design and wideband allows integration of the antenna assembly in a multiple input multiple output (MIMO) application in which multiple antennas (e.g., two or three LTE (long term evolution) antennas, etc.) are within a single radome.

FIGS. 45 and 46 illustrate another exemplary embodiment of a multiband antenna assembly 600 embodying one or more aspects of the present disclosure. In this example embodiment, the NMO connector structure has been transformed or converted into a printed two-dimensional planar configuration in which the NMO connector structure may be replaced and realized by electrically-conductive traces on a printed circuit board 604. Advantageously, the antenna assembly 600 is configured to operate in a wide range of antenna applications with various types of feeding techniques to cater for the various applications.

The antenna assembly 600 is configured to provide at least dual band operation using a PCB 604 having various elements (e.g., electrically conductive traces, etc.) thereon and a top loaded conductor or element 674. The top loaded conductor 674 may be similar or identical to the top loaded conductor 374 described above. Other exemplary embodiments may be configured for use without any top loaded conductor.

The PCB 604 is a double-sided PCB with elements on its front or first side 616 (FIGS. 45 and 47) and back or second side 620 (FIGS. 46 and 48). A shorting or shorted element 624, a feed element 628, and a portion (e.g., one or more grounding taps or tabs, etc.) of the PCB ground 632 are disposed along or on the front side 616 of the PCB 604. In addition, a high band radiating element or arm 640, a first vertical loading element 641, and a grounding element 650 are also disposed along or on the front side 616 of the PCB 604.

A second vertical loading element 642 and a portion of the PCB ground 632 are disposed along or on the back side 620 of the PCB 604. Extended stubs 633 and a feeding area 635 are also disposed along or on the second side 620 of the PCB 604. The two stubs or parasitic elements 633 represent the shell of the NMO mount. In this exemplary embodiment, the bottom of the antenna has traces configured to generally represent the NMO mount structure as a two dimensional planar structure. Also, the matching stub at the bottom of element 642 extends down to have a coupling effect to the ground and have broad bandwidth for high band.

In this exemplary embodiment, the antenna assembly 600 does not include a contact assembly having a center feeding pin (e.g., contact assembly 134 with pin 135 shown in FIG. 1, etc.). Instead, the center feeding pin is replaced and represented by the feeding element 628 (FIGS. 45 and 47), which is configured as a 50 Ohm transmission line having an extended length such that it extends to the feeding area 635 (FIG. 48).

Also in this exemplary embodiment, the antenna assembly 600 does not include a NMO connector structure or shorting pin (e.g., connector 168 and electrical conductor 166 shown in FIG. 1, etc.). Instead, the shorting pin and NMO connector structure are directly converted to printed element structure on the PCB 604. For example, the NMO connector structure is represented as a two-dimensional planar structure by extending the ground element 632 to create stubs 633 (FIG. 48) extending upwardly from the ground element 632 along opposite side edges of the PCB 604. In operation, the stubs 633 enhance the bandwidth of high band, as the stubs act as a parasitic resonator at high band and change the matching of the antenna assembly 600. The distance between the feed element 628 and the shorted element 624 is part of the matching factor for the multiband antenna assembly 600.

As shown by FIGS. 46 and 47, the antenna assembly 600 is directly fed in such a way that the braid of a coaxial cable 692 is soldered 693 to the ground portion 632 on the PCB's back side 620 (FIG. 46). And, the center conductor of the coaxial cable 692 is soldered 694 to the feeding element 628 on the PCB's front side 616 (FIG. 45). This unique feeding technique speeds up the process cycle and facilitates manufacturing process.

The PCB 604 also includes plated thru holes or vias 644 extending from the front side 616 to the back side 620. The plated thru holes or vias 644 may be used to electrically (e.g., directly or galvanically, etc.) connect elements on opposite sides of the PCB 604. For example, the high band radiating element 640 and second vertical loading element 642 on the respective PCB's front and back sides 616, 620 may be electrically connected by a plated thru hole or via 644. The first and second vertical loading elements 641 and 642 on the respective PCB's front and back sides 616, 620 may also be electrically connected by a plated thru hole or via 644. The portions of the ground 632 on the PCB's front and back sides 616, 620 may also be electrically connected by plated thru holes or vias 644.

In operation, the back vertical loading element 642 loads and couples to the front vertical loading element 641, which helps to broaden the bandwidth of the antenna assembly 600. As shown in FIGS. 46 and 48, one of the portions or grounding tabs of the ground 632 extends higher than the other. This allows parasitic coupling to the back vertical element 642 for high band improvement.

The antenna assembly 600 also includes the top loaded conductor 674 supported by or coupled to the support member 676. The support member 676 comprises a disc that is coupled (e.g., adhesively attached, etc.) to or along the top edge of the PCB 604.

FIG. 49 is an exemplary line graph illustrating voltage standing wave ratio (VSWR) versus frequency in megahertz (MHZ) measured for a prototype of the antenna assembly 600 shown in FIGS. 45 and 46 on a two feet by two feet ground plane. These analysis results shown in FIG. 49 are provided only for purposes of illustration and not for purposes of limitation. Generally, FIG. 49 shows that this antenna assembly 600 has a relatively good VSWR of about two or less for frequencies within a first frequency range (or low band) (e.g., from 824 MHz to 960 MHz) and within a second frequency range (or high band) (e.g., from 1710 MHz to about 2700 MHz).

This exemplary embodiment of the multiband antenna assembly 600 may provide one or more (but not necessarily any or all) of the following advantages over some existing multiband antenna assemblies for vehicular applications, machine to machine equipment, in-building applications, etc. For example, this exemplary embodiment allows for mounting configurations different than mounting via NMO antenna mounts and allows the antenna assembly to be fed with a cable easily. This also allows different types of feeding techniques to suit different types of applications. This exemplary embodiment includes parasitic stubs enhancing the bandwidth for high band and a two sided PCB with top loaded disc with a shorting path, which helps improve VSWR and bandwidth of the antenna assembly. Also, matching lump components are not used in this exemplary embodiment, which may improve efficiency and facilitate the manufacturing process. This exemplary embodiment may also have a consistent RF performance and provide more bandwidth for the antenna performance.

There are a variety of blade/sharkfin antenna assemblies for vehicular applications, in which antennas are within a housing or radome having a shape resembling a shark fin or blade. For example, many varieties of shark fin style antennas exist that include multiple narrowband antennas located together under a single radome or housing. But to accommodate a shark fin radome profile for wideband LTE antenna applications, the inventors hereof have recognized that the antenna should be fed sideways by extending the transmission line with a ninety degree bending. Accordingly, the inventors have developed and disclose herein exemplary embodiments of antenna assemblies configured (e.g., shaped, sized, feeding technique, etc.) for use with sharkfin or blade shaped radomes.

FIGS. 50 and 51 illustrate another exemplary embodiment of a multiband antenna assembly 700 embodying one or more aspects of the present disclosure. In this example embodiment, the multiband antenna assembly 700 is configured for use with a shark fin shaped radome for vehicular application, e.g., automobile roof mount shark fin style antenna, etc.

The antenna assembly 700 is configured to provide at least dual band operation using a PCB 704 having various elements (e.g., electrically conductive traces, etc.) thereon. The PCB 704 is a double-sided PCB with elements on its front or first side 716 (FIG. 50) and back or second side 720 (FIG. 51). The PCB 704 is configured (e.g., shaped, sized, etc.) for use with a shark fin-shaped radome or housing. In this illustrated example, the PCB 704 has a shape corresponding to a shark fin-shaped radome or housing.

A shorting or shorted element 724, low band shorting points 795, and a feed element 728 is disposed along or on the front side 716 of the PCB 704. A main radiator arm or element 742, an extension arm 749, a grounding element 750 and a portion (e.g., one or more grounding taps or tabs, etc.) of the PCB ground 732 are also disposed on the PCB's front side 716. A slot 796 is between the shorting element 724 and the radiator element 742. A matching stub element 736 extends (e.g., perpendicular, etc.) from the extension arm 749.

A vertical loading element 741 and a portion of the PCB ground 732 are disposed along or on the back side 720 of the PCB 704. In this example, the PCB ground 732 includes an extended ground wing 797. Extended stubs 733 are disposed along or on the PCB's back side 720. Also the PCB ground 732 is shown soldered to a ground plane 798.

The PCB 704 also includes plated thru holes or vias 744 extending from the front side 716 to the back side 720. The plated thru holes or vias 744 may be used to electrically (e.g., directly or galvanically, etc.) connect elements on opposite sides of the PCB 704. For example, the grounding element 750 is shorted to ground by plated through holes 744.

In this example, the feeding element 728 is configured as a 50 Ohm transmission line having a bend (e.g., ninety degree bend, etc.) so as to allow the antenna assembly 700 to be fed sideways. As shown in FIGS. 50 and 51, the braid of a coaxial cable 792 is soldered 793 to the grounding portions 732 on the PCB's front and back sides 716, 720. The center conductor of the coaxial cable 792 is soldered 794 to the feeding element 728 on the PCB's front side 716 (FIG. 50). The solder 793 and 794 are separated by the insulator with the center core as represented by the rectangle shown in FIG. 50. Accordingly, this unique feeding technique allows the antenna assembly 700 to be fed sideways to accommodate for a shark fin radome profile, a pig tail type connection, and allow incorporation of various antennas under or in the radome.

Also in this example, the ground area 797 of the typical wing shape size is maximized (or at least increased) at both the left and right sides to control the gap in between ground and live element, which allows wideband characteristic at the high band. In operation, the shorting points 795 excite the first resonance frequency of the low band, and the width of the slot 796 controls the second resonance frequency at the low band. The antenna assembly 700 has a generally "W" shape wideband resonance for 698 MHz to 960 MHz as shown by the exemplary line graph in FIG. 52 illustrating voltage standing wave ratio (VSWR) versus frequency in megahertz (MHZ). In this exemplary embodiment, the antenna assembly 700 does not include a contact assembly having a center feeding pin (e.g., contact assembly 134 with pin 135 shown in FIG. 1, etc.). Instead, the center feeding pin is replaced and represented by the feeding element 728 (FIGS. 45 and 47), which is configured as a 50 Ohm transmission line having a bent portion that extends to a feeding area for connection to the coaxial cable 792.

Also in this exemplary embodiment, the antenna assembly 700 does not include a NMO connector structure or shorting pin (e.g., connector 168 and electrical conductor 166 shown in FIG. 1, etc.). Instead, the shorting pin and NMO connector structure are directly converted to printed element structure on the PCB 704. For example, the NMO connector structure is represented as a two-dimensional planar structure by extending the ground element 732 to create stubs 733 (FIG. 51) extending upwardly from the ground element 732. In operation, the stubs 733 enhance the bandwidth of high band, as the stubs act as a parasitic resonator at high band and change the matching of the antenna assembly 700. The distance between the feed element 728 and the shorted element 724 is part of the matching factor for the multiband antenna assembly 700.

FIG. 52 is an exemplary line graph illustrating voltage standing wave ratio (VSWR) versus frequency in megahertz (MHZ) measured for a prototype of the antenna assembly 700 shown in FIGS. 50 and 51 with a two feet by two feet ground plane. These analysis results shown in FIG. 52 are provided only for purposes of illustration and not for purposes of limitation. Generally, FIG. 52 shows that this antenna assembly 700 has a relatively good VSWR of less than two for frequencies within a first frequency range (or low band) (e.g., from 698 MHz to 960 MHz) and within a second frequency range (or high band) (e.g., from 1710 MHz to about 2700 MHz).

This exemplary embodiment of the multiband antenna assembly 700 may provide one or more (but not necessarily any or all) of the advantages mentioned above for the antenna assembly 600. In addition, the antenna assembly 700 may also have the extended ground plane wing to improve the bandwidth of highband and be configured (e.g., shaped, sized, etc.) for use with sharkfin antennas or blade antennas. The antenna assembly 700 may also maintain a good VSWR of 2:1 with various types of feeding techniques.

FIG. 53 illustrates an exemplary embodiment of a multiple-antenna system or assembly 800 embodying one or more aspects of the present disclosure. In this example embodiment, the multiple-antenna system 800 includes three antenna assemblies 700 as shown in FIGS. 50 and 51 and described above. In this example, the three antenna assemblies 700 are mounted (e.g., vertically, perpendicularly, etc.) to a ground plane 898 such that there is a 120° separation between each pair of the antenna assemblies 700.

Each antenna assembly 700 may be configured to cover a first frequency band (e.g., 698 MHz to 960 MHz, etc.) and a second frequency band (e.g., 1710 MHz to 2700 MHz, etc.). The antenna system 800 may be configured to be used as a ceiling mount antenna for LTE MIMO applications. The antenna system 800 may include a single low profile radome or cover that is positioned over all three antenna assemblies 700.

FIGS. 54A through 54F are exemplary line graphs respectively illustrating voltage standing wave ratio (VSWR) and isolation (in decibels) versus frequency in megahertz (MHz) measured for each of the three antenna assemblies 700 of a prototype of the multiple-antenna system 800 shown in FIG. 53. These analysis results shown in FIGS. 54A through 54F are provided only for purposes of illustration and not for purposes of limitation.

More specifically, FIGS. 54A, 54B, and 54C includes exemplary line graphs respectively illustrating VSWR for the first antenna assembly 700A, second antenna assembly 700B, and the third antenna assembly 700C. FIGS. 54D, 54E, and 54F includes exemplary line graphs respectively illustrating isolation between the first and second antenna assemblies 700A and 700B, isolation between the second and third antenna assemblies 700B and 700C, and isolation between the first and third antenna assemblies 700A and 700C. Generally, FIGS. 54A through 54F show that the multiple-antenna system 800 has a relatively good VSWR and good isolation between the antenna assemblies 700 for frequencies within a first frequency range (or low band) (e.g., from 698 MHz to 960 MHz) and within a second frequency range (or high band) (e.g., from 1710 MHz to about 2700 MHz).

FIGS. 55 and 56 illustrate another exemplary embodiment of a multiband antenna assembly 900 embodying one or more aspects of the present disclosure. The antenna assembly 900 is configured to provide at least dual band operation using a PCB 904 having various elements (e.g., electrically conductive traces, etc.) on the first and second sides 916, 920 thereof. In this example embodiment, the multiband antenna assembly 900 is configured for use as a blade style antenna.

In this example, a sideways center feeding technique is used for the multiband antenna assembly 900. As shown in FIG. 55, the antenna assembly 900 is directly fed in such a way that the braid of a coaxial cable 992 is soldered 993 to the ground portion 932 on the side 920 of the PCB 904. The center conductor of the coaxial cable 992 is soldered 994 to the feeding element 928 on the side 916 of the PCB 904 as shown in FIG. 56.

The multiband antenna assembly 900 also includes additional elements on the PCB's sides 916, 920 that may be similar to the corresponding elements and features in other exemplary embodiments (e.g., 600, 700, etc.). For example, a shorting or shorted element 924, low band shorting points 995, feed element 928, main radiator arm or element 942, extension arm 949, first vertical loading element 941, and ground element 950 are on the PCB's side 916 (FIG. 56). A slot is between the shorting element 924 and the radiator element 942. A matching stub element 936 extends (e.g., perpendicular, etc.) from the extension arm 949.

A vertical loading element 919 and a portion of the PCB ground 932 are disposed along or on the side 920 of the PCB 904 as shown in FIG. 55. In this example, the PCB ground 932 includes an extended ground wing 997. Extended stubs 933 are disposed along or on the PCB's side 920. Also the PCB ground 932 is shown soldered to a ground plane 998. In this example, the ground area 997 of the typical wing shape size is maximized (or at least increased) at both the left and right sides to control the gap in between ground and live element, which allows wideband characteristic at the high band.

The PCB 904 also includes plated thru holes or vias 944 extending from the front side 916 to the back side 920. The plated thru holes or vias 944 may be used to electrically (e.g., directly or galvanically, etc.) connect elements on opposite sides of the PCB 904.

FIGS. 57 and 58 illustrate another exemplary embodiment of a multiband antenna assembly 1000 embodying one or more aspects of the present disclosure. The antenna assembly 1000 is configured similarly and includes similar elements (e.g., electrically conductive traces, etc.) on the first and second sides 1016, 1020 of a PCB 1004 as the antenna assembly 900 shown in FIGS. 55 and 56 and described above. But in this example embodiment, a bottom center feeding technique is used for the multiband antenna assembly 1000.

As shown in FIG. 58, the antenna assembly 1000 is directly fed in such a way that the braid of a coaxial cable is soldered 1093 to the ground portion 1032 on the side 1020 of the PCB 1004. The center conductor of the coaxial cable is soldered 1094 to the feeding element 1028 on the side 1016 of the PCB 1004 as shown in FIG. 57.

Although exemplary embodiments (e.g., 100, 200, 300, 400, 500, etc.) of the antenna assemblies have been described as being mounted to vehicles or automobiles by NMO connector structures and NMO antenna mounts, antenna assemblies may also be mounted differently within the scope of the present disclosure. For example, an antenna assembly may be installed by a different connector structure, by a different antenna mount, and/or to a truck, a bus, a recreational vehicle, a boat, a vehicle without a motor, etc. within the scope of the present disclosure. In addition, the frequency bands disclosed herein are examples only as exemplary embodiments of an antenna assembly may be configured to be resonant at other frequencies and/or frequency bands than the frequency bands disclosed herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages, and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values (e.g., frequency ranges, etc.) for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multiband antenna assembly comprising a printed circuit board having a plurality of elements thereon, the plurality of elements including:

a radiating element;

a feed element configured to be operable as a feeding point for the multiband antenna assembly;

a shorting element configured to be operable for electrically shorting the radiating element to ground; and a matching element;

whereby the antenna assembly is operable within at least a first frequency range and a second frequency range different than the first frequency range without requiring any matching lump components coupled to the printed circuit board;

wherein:

the multiband antenna assembly is configured to be mountable to a surface of a vehicle, machine, or building such that the radiating element on the printed circuit board is vertical and/or perpendicular relative to a ground plane defined by the surface; and the multiband antenna assembly is coupled to a NMO connector structure; and the multiband antenna assembly is configured to be omnidirectional at horizon parallel to the ground plane; and the multiband antenna assembly is configured to be omnidirectional in the azimuth plane, phi zero degree plane, and phi ninety degree plane and have a voltage standing wave ratio (VSWR) less than two within at least the first frequency range and the second frequency range; and the printed circuit board includes opposite first and second sides, the first and second sides including stepped trace portions of a ground of the printed circuit board; and the printed circuit board includes one or more plated thru holes for electrically connecting the stepped trace portions on the opposite first and second sides, respectively of the printed circuit board.

2. The multiband antenna assembly of claim 1, wherein:

the feed element is configured to extend to a feeding area for allowing direct electrical connection with a coaxial cable for center feeding of the multiband antenna assembly directly by the coaxial cable; and the shorting element comprises a trace on the printed circuit board such that the radiating element is shorted to ground by the trace on the printed circuit board; and the matching element comprises an electrically conductive trace on the printed circuit board; and the multiband antenna assembly does not include any matching lump components coupled to the printed circuit board.

3. The multiband antenna assembly of claim 1, wherein:

the plurality of elements comprise electrically conductive traces on the printed circuit board including one or more radiating traces that provide additional electrical length for enhancing bandwidth and thereby allowing a lower profile radome; and the feed element and the shorting element are spaced apart by a predetermined distance that is part of a matching factor for the multiband antenna assembly.

4. The multiband antenna assembly of claim 1, wherein the matching element comprises a stub or vertical loading element configured to couple with the radiating element to thereby help at least reduce a spike of voltage standing wave ratio (VSWR) at high band; and wherein the multiband antenna assembly further comprises a cylindrical radome.

5. The multiband antenna assembly of claim 1, further comprising:

one or more radiating elements parasitically coupled to the radiating element of the printed circuit board; and a shorting element for electrically shorting the one or more radiating elements to ground;

wherein the one or more radiating elements and the shorting element comprise electrically-conductive traces, whereby the one or more radiating elements are operable as an additional radiator for the multiband antenna assembly to thereby help broaden the bandwidth; and wherein the multiband antenna assembly includes a center coaxial feed structure including the feed element for direct electrical connection with a coaxial cable.

6. The multiband antenna assembly of claim 1, wherein:

the first side of the printed circuit board includes the shorting element, the feed element, and a first portion of a ground, the second side of the printed circuit board includes the matching element, the radiating element, and a second portion of the ground; and the multiband antenna assembly further comprises a second printed circuit board including a first side and a second side, the first side including a first radiating element and a first portion of a ground, the second side including a second radiating element, a second portion of the ground, and a shorting element for electrically shorting the second radiating element to the ground; and the first and second radiating elements of the second circuit board are parasitically coupled to the radiating element of the printed circuit board.

7. The multiband antenna assembly of claim 1, wherein:

the first side of the printed circuit board includes the shorting element, the feed element, and a first portion of a ground;

the second side of the printed circuit board includes the matching element, the radiating element, and a second portion of the ground;

the feed element comprises a broad trace feed configured for helping broaden bandwidth of the multiband antenna assembly; and the radiating element is electrically connected to the feed element.

8. The multiband antenna assembly of claim 1, further comprising:

a second printed circuit board coupled to an upper portion of the printed circuit board, the second printed circuit board having a first side, a second side, and one or more electrically-conductive elements on the first and second sides; and/or a top loaded conductor supported on the second printed circuit board, whereby the top loaded conductor and second printed circuit board are configured to help at least reduce a spike of voltage standing wave ratio (VSWR) at high band, improve the VSWR level, and/or broaden the bandwidth.

9. The multiband antenna assembly of claim 1, wherein:

the first side of the printed circuit board includes the shorting element, the feed element, the radiating element, a first vertical loading element, and a first portion of a ground; and the second side of the printed circuit board includes a second vertical loading element and a second portion of the ground;

the second vertical loading element is configured to couple with the first vertical loading element for helping broaden bandwidth; and the antenna assembly further comprises a top loaded conductor along an upper portion of the printed circuit board.

10. The multiband antenna assembly of claim 1, wherein:

the ground of the printed circuit board comprises one or more grounding taps at least one of which is electrically connected to the shorting element; and/or the multiband antenna assembly further comprises one or more resiliently flexible contact elements along an upper portion of the printed circuit board, for contacting a portion of a radome when assembled within the radome.

11. The multiband antenna assembly of claim 1, further comprising a fingerstock gasket including one or more spring fingers, the fingerstock gasket along an upper portion of the printed circuit board such that the one or more spring fingers contact a portion of a radome when assembled within the radome, and wherein the portion of the radome comprises a top loaded portion of a metal cylinder, whereby the electrical connection between the printed circuit board and the top loaded portion of the metal cylinder helps to broaden bandwidth of the multiband antenna assembly.

12. The multiband antenna assembly of claim 1, further comprising a fingerstock gasket including one or more spring fingers, the fingerstock gasket along an upper portion of the printed circuit board such that the one or more spring fingers contact a portion of a radome when assembled within the radome, and wherein:

the first side of the printed circuit board includes the shorting element, the feed element, the band radiating element, a first portion of a ground, and a first loading element that is electrically connected to the fingerstock gasket; and the second side of the printed circuit board includes a second portion of the ground and a second loading element that is electrically connected to the first loading element.

13. The multiband antenna assembly of claim 1, wherein:

the first side of the printed circuit board includes the shorting element, the matching element, a first portion of a ground, a high band radiating element, and a first loading element; and the second side of the printed circuit board includes a main radiator arm, an extension arm, a parasitic element, the feed element, and a second portion of the ground.

14. The multiband antenna assembly of claim 13, wherein:

the main radiator arm is operable to cover a bandwidth from 2.3 GHz to 2.7 GHz;

the extension arm couples to ground and is operable for increasing bandwidth of the antenna assembly to cover a bandwidth from 4.9 GHz to 5.15 GHz; and the parasitic element is operable for further increasing bandwidth of the antenna assembly to cover a bandwidth from 4.9 GHz to 5.9 GHz.

15. The multiband antenna assembly of claim 1, wherein:

the plurality of elements further comprise an extended ground wing and an extended stub; and/or the feed element is configured to extend to a feeding area, for allowing connection with a coaxial cable for center or bottom feeding of the multiband antenna assembly directly by the coaxial cable when a braid of the coaxial cable is soldered to a first side of the printed circuit board and a center conductor of the coaxial cable is soldered to a second side of the printed circuit board; and/or the feed element includes a bend to allow the multiband antenna assembly to be fed sideways.

16. A shark fin style antenna including the multiband antenna assembly of claim 1, wherein the printed circuit board is configured with a shape corresponding to a shark fin-shaped radome.

17. A multiple input multiple output (MIMO) antenna system comprising three multiband antenna assemblies of claim 1 mounted to a ground plane with 120° separation between the multiband antenna assemblies.

18. A multiband antenna assembly comprising a printed circuit board having a plurality of elements thereon, the plurality of elements including:

a radiating element;

a feed element configured to be operable as a feeding point for the multiband antenna assembly;

a shorting element configured to be operable for electrically shorting the radiating element to ground; and a matching element;

whereby the multiband antenna assembly is operable within at least a first frequency range and a second frequency range different than the first frequency range without requiring any matching lump components coupled to the printed circuit board; wherein:

the printed circuit board includes a first side and a second side, the first side including the shorting element, the feed element, and a first portion of a ground, the second side including the matching element, the radiating element, and a second portion of the ground; and the multiband antenna assembly further comprises a second printed circuit board including a first side and a second side, the first side including a first radiating element and a first portion of a ground, the second side including a second radiating element, a second portion of the ground, and a shorting element for electrically shorting the second radiating element to the ground; and the first and second radiating elements of the second circuit board are parasitically coupled to the radiating element of the printed circuit board;

the printed circuit board includes plated thru holes for electrically connecting elements on the opposite first and second sides of the printed circuit board, including the first and second portions of the ground of the printed circuit board and the shorting element with the radiating element; and the second printed circuit board includes plated thru holes for electrically connecting elements on the opposite first and second sides of the second printed circuit board, including the first and second radiating elements and the first and second portions of the ground of the second printed circuit board.

19. A multiband antenna assembly comprising a printed circuit board having a plurality of elements thereon, the plurality of elements including:

a radiating element;

a feed element configured to be operable as a feeding point for the multiband antenna assembly;

a shorting element configured to be operable for electrically shorting the radiating element to ground; and a matching element;

wherein the multiband antenna assembly is coupled to a NMO connector structure, which is configured to couple to a NMO antenna mount that is mountable to a surface of a vehicle such that the radiating element is vertical and/or perpendicular to a ground plane defined by the surface of the vehicle, whereby the multiband antenna assembly is configured to be operable for transmitting and/or receiving signals to/from one or more electronic devices inside a passenger compartment of a vehicle when connected to the antenna mount; and wherein the feed element is electrically connected to a contact of a spring contact assembly, the spring contact assembly including a pin for electrically contacting a center contact of the NMO antenna mount when the NMO connector structure is coupled to the NMO antenna mount;

wherein the printed circuit board includes opposite first and second sides, the first side including one or more ground traces of a ground of the printed circuit board, the second side including one or more ground traces of the ground of the printed circuit board, and the printed circuit board includes one or more plated thru holes for electrically connecting the ground traces on the opposite first and second sides, respectively of the printed circuit board; and wherein the printed circuit board includes an opening configured for receiving an upper portion of the spring contact assembly including an insulator and an electrically-conductive ring that couples to the ground of the printed circuit board.

20. The multiband antenna assembly of claim 19, wherein:

the multiband antenna assembly is configured to be omnidirectional in the azimuth plane, phi zero degree plane, and phi ninety degree plane and have a voltage standing wave ratio (VSWR) less than two within at least the first frequency range and the second frequency range;

the printed circuit board includes opposite first and second sides, the first and second sides including stepped trace portions of a ground of the printed circuit board; and the printed circuit board includes one or more plated thru holes for electrically connecting the stepped trace portions on the opposite first and second sides, respectively of the printed circuit board.

* * * * *